US011752407B2

(12) United States Patent
Adams et al.

(10) Patent No.: US 11,752,407 B2
(45) Date of Patent: Sep. 12, 2023

(54) GOLF SHAFT SYSTEM AND GOLF SHAFT

(71) Applicant: Breakthrough Golf Technology LLC, Dallas, TX (US)

(72) Inventors: Byron H. Adams, Indian Wells, CA (US); Blair M. Philip, Dallas, TX (US); Jeffrey T. Halstead, Wylie, TX (US); Robert E. Stephens, Fort Worth, TX (US); Trever M. Napier, Plano, TX (US)

(73) Assignee: BREAKTHROUGH GOLF TECHNOLOGY LLC, Dallas, TX (US)

( * ) Notice: Subject to any disclaimer, the term of this patent is extended or adjusted under 35 U.S.C. 154(b) by 0 days.

(21) Appl. No.: 17/838,957

(22) Filed: Jun. 13, 2022

(65) Prior Publication Data

US 2022/0314083 A1 Oct. 6, 2022

Related U.S. Application Data

(63) Continuation of application No. 17/101,136, filed on Nov. 23, 2020, now Pat. No. 11,358,041, which is a continuation of application No. 16/721,025, filed on Dec. 19, 2019, now Pat. No. 10,857,433, which is a continuation-in-part of application No. 16/237,894, filed on Jan. 2, 2019, now Pat. No. 10,729,952, which is a continuation of application No. 15/884,683, filed on Jan. 31, 2018, now Pat. No. 10,213,666.

(51) Int. Cl.

| | |
|---|---|
| ***A63B 53/10*** | (2015.01) |
| ***A63B 53/12*** | (2015.01) |
| ***A63B 60/08*** | (2015.01) |
| ***A63B 60/26*** | (2015.01) |
| ***A63B 53/00*** | (2015.01) |

(52) U.S. Cl.

CPC ..... *A63B 53/10* (2013.01); *A63B 53/007* (2013.01); *A63B 53/12* (2013.01); *A63B 60/08* (2015.10); *A63B 60/26* (2015.10); *A63B 53/005* (2020.08); *A63B 2209/00* (2013.01)

(58) Field of Classification Search

CPC ..... A63B 53/10; A63B 53/12; A63B 53/007; A63B 53/005; A63B 60/08; A63B 60/26; A63B 60/02; A63B 60/42; A63B 2209/00

USPC ..... 473/316–323

See application file for complete search history.

(56) References Cited

U.S. PATENT DOCUMENTS

| | | | |
|---|---|---|---|
| 782,955 | A | 2/1905 | Emens |
| 1,312,485 | A | 8/1917 | Krauth |
| 1,426,202 | A | 8/1922 | Lard |
| 1,623,523 | A | 4/1927 | Bourke |
| 1,792,852 | A | 2/1931 | Mattern |

(Continued)

FOREIGN PATENT DOCUMENTS

| | | |
|---|---|---|
| JP | 4142181 | 8/2008 |
| KR | 300828979 | 12/2015 |

OTHER PUBLICATIONS

Northwestern Golf Driver with Power Kick Shaft from the 1980s.

(Continued)

*Primary Examiner* — John E Simms, Jr.

(74) *Attorney, Agent, or Firm* — DAWSEY CO., LPA; David J. Dawsey

(57) ABSTRACT

A golf club shaft system and golf club shaft possessing unique characteristics including flexural and torsional rigidity profiles.

20 Claims, 27 Drawing Sheets

(56) References Cited

U.S. PATENT DOCUMENTS 1,802,507 A 4/1931 Hadden
1,844,812 A 2/1932 Thorpe
1,994,069 A 3/1935 Fletcher
2,085,915 A 7/1937 MacCallum
2,150,737 A 3/1939 Chittick
2,367,196 A 1/1945 Butler
2,455,525 A 12/1948 Schulz
2,473,351 A 6/1949 Thompson
2,599,222 A 6/1952 Bergqvist
2,643,143 A 6/1953 Bergqvist
2,658,777 A 11/1953 Rauglas
2,787,485 A 4/1957 Frisell
2,842,387 A 7/1958 Della-Porta
2,884,270 A 4/1959 Carlberg
2,980,456 A 4/1961 McMullin
3,161,395 A 12/1964 Carter
3,245,703 A 4/1966 Manly
3,265,401 A 8/1966 Spier
3,326,580 A 6/1967 Munier et al.
3,335,735 A 8/1967 Colegrove et al.
3,379,460 A 4/1968 Allyn
3,461,593 A 8/1969 Martuch
3,603,623 A 9/1971 Widman
3,826,523 A 7/1974 Eschbaugh
3,829,092 A 8/1974 Arkin
3,848,737 A 11/1974 Kenon
3,953,138 A 4/1976 Hine et al.
4,036,515 A 7/1977 Karcher et al.
4,085,763 A 4/1978 Thomas
4,123,055 A 10/1978 Brill
D250,356 S 11/1978 Kaugars
4,127,764 A 11/1978 Minden
4,253,666 A 3/1981 Murphy
4,294,560 A 10/1981 Larkin
4,304,426 A 12/1981 Francis
D263,330 S 3/1982 Kaugars et al.
4,374,315 A 2/1983 Timbrook
4,376,525 A 3/1983 Fremy
4,401,326 A 8/1983 Blair
4,419,026 A 12/1983 Leto
4,462,622 A 7/1984 Barzuza
4,596,484 A 6/1986 Nakatani
4,597,577 A 7/1986 Fixler
4,601,497 A 7/1986 Bartholomew
4,681,351 A 7/1987 Bartholomew
4,691,943 A 9/1987 DeLand et al.
4,733,681 A 3/1988 Lee
4,750,765 A 6/1988 Cassidy et al.
4,761,092 A 8/1988 Nakatani
4,775,172 A 10/1988 Sauer
4,778,203 A 10/1988 Bartholomew
4,793,637 A 12/1988 Laipply et al.
4,836,545 A 6/1989 Pompa
4,850,622 A 7/1989 Suzuki
4,852,782 A 8/1989 Chi
4,872,710 A 10/1989 Konecny et al.
4,895,368 A 1/1990 Geiger
4,895,396 A 1/1990 Washizu
5,018,735 A 5/1991 Meredith et al.
5,080,519 A 1/1992 Chi
5,083,779 A 1/1992 Ungermann
5,083,780 A 1/1992 Walton et al.
5,112,084 A 5/1992 Washizu
5,138,911 A 8/1992 Lan
5,226,652 A 7/1993 Sato
5,253,867 A 10/1993 Gafner
5,286,129 A 2/1994 French et al.
5,297,823 A 3/1994 Dubost
5,328,174 A 7/1994 Reeder
5,356,235 A 10/1994 Brown
5,394,770 A 3/1995 Boike et al.
5,433,442 A 7/1995 Walker
5,439,219 A 8/1995 Vincent
5,447,306 A 9/1995 Selden
5,496,074 A 3/1996 Viratelle et al.
5,513,844 A 5/1996 Ashcraft
5,547,189 A 8/1996 Billings
5,575,473 A 11/1996 Turner
5,588,766 A 12/1996 Lai
5,607,173 A 3/1997 Lai
D378,771 S 4/1997 Antonious
D380,802 S 7/1997 Franks
D385,608 S 10/1997 Hoffmeyer
D385,934 S 11/1997 You
5,692,971 A 12/1997 Williams
5,718,463 A 2/1998 Hollnagel
5,722,697 A 3/1998 Waterson
5,722,901 A 3/1998 Barron
5,749,606 A 5/1998 Lu et al.
5,758,909 A 6/1998 Dole et al.
5,759,113 A 6/1998 Lai et al.
5,765,877 A 6/1998 Sakane et al.
5,775,352 A 7/1998 Obitts
5,779,277 A 7/1998 Street
5,788,586 A 8/1998 Macioce
5,792,006 A 8/1998 Hesser
5,803,512 A 9/1998 Hollnagel
5,806,898 A 9/1998 Hollnagle
5,868,438 A 2/1999 Svetlik
5,887,911 A 3/1999 Kargula
5,904,627 A 5/1999 Miyaji et al.
5,913,733 A 6/1999 Bamber
5,930,872 A 8/1999 McBride et al.
5,935,017 A 8/1999 Weaver et al.
5,947,839 A 9/1999 Kusumoto
5,988,706 A 11/1999 Hollnagle
5,997,412 A 12/1999 Benson
6,022,053 A 2/2000 Hukuda
D430,248 S 8/2000 Adams et al.
D430,249 S 8/2000 Burger
6,113,508 A 9/2000 Locarno et al.
6,117,021 A 9/2000 Crow et al.
6,139,444 A 10/2000 Renard et al.
6,203,447 B1 3/2001 Dillard
6,231,457 B1 * 5/2001 Chen ..... A63B 60/54
473/319
D444,526 S 7/2001 Adams et al.
6,257,993 B1 7/2001 Morell et al.
6,257,997 B1 7/2001 Doble et al.
6,273,830 B1 8/2001 Takemura et al.
6,302,806 B1 10/2001 Hsu
6,343,999 B1 2/2002 Murtland et al.
6,361,451 B1 3/2002 Masters et al.
6,485,376 B1 11/2002 Hisamatsu
D466,575 S 12/2002 Hedrick et al.
6,532,818 B2 3/2003 Blankenship
6,547,673 B2 4/2003 Roark
6,561,922 B2 5/2003 Bamber
6,582,320 B2 6/2003 Fendel
6,705,954 B2 3/2004 Takiguchi et al.
6,729,970 B2 5/2004 Horwood et al.
6,743,116 B2 6/2004 Wilbur
6,764,414 B2 7/2004 Kumamoto
6,793,590 B1 9/2004 Ho
D499,459 S 12/2004 Chiasson
D501,904 S 2/2005 Ferris
6,860,821 B2 3/2005 Unosawa et al.
D504,166 S 4/2005 Bellefleur et al.
6,890,269 B2 5/2005 Burrows
6,902,495 B2 6/2005 Pergande et al.
D507,815 S 7/2005 Hedrick et al.
RE38,983 E 2/2006 Antonious
D517,145 S 3/2006 Bonar et al.
7,070,512 B2 7/2006 Nishio
D529,973 S 10/2006 Brookshire-Herr
7,115,045 B2 10/2006 Horwood et al.
7,128,659 B1 10/2006 Lee
7,140,398 B2 11/2006 Dodge et al.
D537,498 S 2/2007 Brookshire-Herron
7,226,365 B2 6/2007 Qualizza
7,252,598 B2 8/2007 Lindner
7,297,070 B2 11/2007 Ashida et al.
7,300,360 B2 11/2007 Oyama
7,318,780 B2 1/2008 Oyama

(56) References Cited

U.S. PATENT DOCUMENTS

| | | | | |
|---|---|---|---|---|
| 7,347,791 | B1 | 3/2008 | Watkins et al. | |
| 7,427,240 | B2 | 9/2008 | Takeuchi | |
| 7,435,187 | B2 | 10/2008 | Stites et al. | |
| 7,524,248 | B2 | 4/2009 | Kumamoto | |
| 7,789,770 | B1 | 9/2010 | Li | |
| D641,820 | S | 7/2011 | Swist | |
| 8,096,894 | B2 | 1/2012 | Sander | |
| 8,117,942 | B2 | 2/2012 | Kuwata et al. | |
| 8,157,669 | B2 | 4/2012 | Hulock et al. | |
| 8,182,360 | B2 | 5/2012 | Cameron | |
| 8,192,298 | B2 | 6/2012 | Droppleman | |
| D676,911 | S | 2/2013 | Brown, Jr. et al. | |
| D686,289 | S | 7/2013 | Brown, Jr. et al. | |
| 8,491,411 | B2 | 7/2013 | DeShiell et al. | |
| 8,517,857 | B2 | 8/2013 | Wakabayashi et al. | |
| D699,801 | S | 2/2014 | Ito et al. | |
| 8,641,551 | B2 | 2/2014 | Johnson | |
| 8,777,772 | B2 | 7/2014 | Hasegawa et al. | |
| 8,827,828 | B2 | 9/2014 | Brekke et al. | |
| 8,845,452 | B2 | 9/2014 | Sato | |
| 8,852,022 | B2 | 10/2014 | DeShiell et al. | |
| D717,895 | S | 11/2014 | Cynn | |
| 8,936,516 | B2 | 1/2015 | Yashiki | |
| D732,619 | S | 6/2015 | Henrikson et al. | |
| 9,050,511 | B2 | 6/2015 | Hicks | |
| 9,295,888 | B2 | 3/2016 | Fujiwara et al. | |
| D772,362 | S | 11/2016 | Ito et al. | |
| D790,014 | S | 6/2017 | Ito et al. | |
| 10,486,036 | B1 * | 11/2019 | Rollinson | A63B 1/00 |
| 2001/0001772 | A1 * | 5/2001 | Fendel | A63B 60/54 473/316 |
| 2002/0082111 | A1 | 6/2002 | Hedrick et al. | |
| 2002/0115500 | A1 * | 8/2002 | Hisamatsu | D04C 1/06 473/319 |
| 2002/0123392 | A1 | 9/2002 | Yamada | |
| 2003/0083143 | A1 * | 5/2003 | Kumamoto | A63B 60/02 473/316 |
| 2003/0125124 | A1 | 7/2003 | Matsumoto et al. | |
| 2004/0043825 | A1 | 3/2004 | Horwood et al. | |
| 2004/0142760 | A1 | 7/2004 | Haas et al. | |
| 2005/0085314 | A1 | 4/2005 | Hsu | |
| 2005/0107182 | A1 | 5/2005 | Meyer et al. | |
| 2005/0272521 | A1 | 12/2005 | Tsai | |
| 2006/0046867 | A1 | 3/2006 | Murphy | |
| 2006/0194643 | A1 | 8/2006 | Chen | |
| 2006/0211511 | A1 | 9/2006 | Cheng | |
| 2007/0026960 | A1 | 2/2007 | Butler, Jr. et al. | |
| 2007/0049398 | A1 | 3/2007 | Oyama | |
| 2007/0270237 | A1 | 11/2007 | Tavares et al. | |
| 2007/0275790 | A1 * | 11/2007 | Droppleman | A63B 53/00 473/307 |
| 2009/0118031 | A1 | 5/2009 | Qualizza | |
| 2009/0143161 | A1 | 6/2009 | Qualizza | |
| 2009/0305809 | A1 * | 12/2009 | Sato | A63B 53/10 473/282 |
| 2010/0317457 | A1 * | 12/2010 | Hulock | A63B 53/12 473/319 |
| 2012/0100927 | A1 | 4/2012 | Lenzini | |
| 2012/0322572 | A1 | 12/2012 | Noble et al. | |
| 2013/0017902 | A1 | 1/2013 | Cheng | |
| 2013/0095949 | A1 * | 4/2013 | Hasegawa | A63B 53/10 473/318 |
| 2013/0123039 | A1 * | 5/2013 | Sato | A63B 60/42 473/316 |
| 2013/0143688 | A1 * | 6/2013 | Sato | A63B 53/10 473/316 |
| 2015/0159783 | A1 | 6/2015 | Ma et al. | |
| 2015/0306478 | A1 | 10/2015 | Hicks | |
| 2015/0375073 | A1 | 12/2015 | Kodama et al. | |
| 2016/0074719 | A1 | 3/2016 | Rice et al. | |
| 2017/0065860 | A1 | 3/2017 | Kultala et al. | |
| 2017/0340936 | A1 | 11/2017 | Hanamitsu et al. | |
| 2019/0232130 | A1 | 8/2019 | Adams et al. | |
| 2020/0122006 | A1 * | 4/2020 | Adams | A63B 60/02 |

OTHER PUBLICATIONS

UST Frequency Filtered Putter Shaft; http://www.golfwrx.com/forums/topic/12419-ust-frequency-filtered-putter-shaft/ ; Dec. 4, 2005.

Aldila One graphite shaft review; http://www.equip2golf.com/reviews/shafts/aldila_one.html; at least as early as Oct. 27, 2006.

International Search Report and Written Opinion of the International Searching Authority for International Application No. PCT/US2019/012042, dated Mar. 14, 2019, nineteen pages.

International Search Report and Written Opinion of the International Searching Authority for International Application No. PCT/US20/61904, dated Mar. 11, 2021.

* cited by examiner

| Region | Start (in.) | End (in.) | Avg EI (N•m²) | Avg GJ (N•m²) |
|---|---|---|---|---|
| 1ST PLATEAU | 0 (0%) | 6.3 (18%) | 34 | 26 |
| 2ND PLATEAU | 6.3 (18%) | 9.1 (26%) | 160 | 136 |
| 3RD PLATEAU | 9.1 (26%) | 13.4 (38%) | 76 | 77 |
| 4TH PLATEAU | 13.4 (38%) | 20.0 (57%) | 108 | 100 |
| 5TH PLATEAU | 20.0 (57%) | 35.0 (100%) | 76 | 77 |

| Figure | Section | Start (in.) | End (in.) | Avg EI (N•m-2) | Avg GJ (N•m-2) |
|---|---|---|---|---|---|
| A | Tip 1/2 | 0 (0%) | 17.5 (50%) | 82 | 74 |
| A | Butt 1/2 | 17.5 (50%) | 35.0 (100%) | 81 | 80 |
| | | | | | |
| B | Coupler to Insert End Reinforced Region | 6.3 (18%) | 20.0 (57%) | 109 | 100 |
| B | Combined Non Reinforced Regions | 0 (0%), 20.0 (57%) | 6.3 (18%), 35.0 (100%) | 64 | 62 |

| Figure | Section | Start (in.) | End (in.) | Avg EI (N•m²) | Avg GJ (N•m²) |
|---|---|---|---|---|---|
| C | Tip 1/3 | 0 (0%) | 11.7 (33%) | 74 | 64 |
| C | Butt 2/3 | 11.7 (33%) | 35.0 (100%) | 85 | 83 |
| | | | | | |
| D | Tip 2/3 | 0 (0%) | 23.3 (67%) | 84 | 76.9 |
| D | Butt 1/3 | 23.3 (67%) | 35.0 (100%) | 76 | 76.9 |

| Section | Start (in.) | End (in.) | Avg EI (N•m²) | Avg GJ (N•m²) |
|---|---|---|---|---|
| Tip 1/2 | 0 (0%) | 17.5 (50%) | 42 | 32 |
| Butt 1/2 | 17.5 (50%) | 35.0 (100%) | 112 | 84 |
| Tip 1/3 | 0 (26%) | 11.7 (33%) | 35 | 26 |
| Butt 2/3 | 13.4 (33%) | 35.0 (100%) | 98 | 74 |
| Tip 2/3 | 0 (0%) | 23.3 (67%) | 52 | 39 |
| Butt 1/3 | 23.3 (67%) | 35.0 (100%) | 127 | 95 |

| Shaft | Overall | | 0 - 33% | | 33 - 66% | | 66 - 100% | | 0 - 66% | | 33 - 100% | | 0 - 50% | | 50 - 100% | |
|---|---|---|---|---|---|---|---|---|---|---|---|---|---|---|---|---|
| | EI | GJ | EI | GJ | EI | GJ | EI | GJ | EI | GJ | EI | GJ | EI | GJ | EI | GJ |
| BGT Driver Proto Green Tip | 51 | 23 | 14 | 7 | 68 | 32 | 70 | 30 | 41 | 20 | 69 | 31 | 31 | 16 | 70 | 30 |
| BGT Driver Proto Blue Tip | 57 | 23 | 28 | 7 | 72 | 32 | 70 | 30 | 50 | 30 | 71 | 31 | 44 | 16 | 70 | 30 |
| BGT Driver Proto Red Tip | 51 | 30 | 14 | 23 | 68 | 37 | 70 | 30 | 41 | 30 | 69 | 34 | 31 | 30 | 70 | 30 |
| BGT Driver Proto White Tip | 57 | 30 | 28 | 23 | 72 | 37 | 70 | 30 | 50 | 30 | 71 | 34 | 44 | 30 | 70 | 30 |

*Fig. 20*

GOLF SHAFT SYSTEM AND GOLF SHAFT

CROSS-REFERENCE TO RELATED APPLICATIONS

This application is a continuation of U.S. nonprovisional application Ser. No. 17/101,136, filed on Nov. 23, 2020, which is a continuation of U.S. nonprovisional application Ser. No. 16/721,025, filed on Dec. 19, 2019, which is a continuation-in-part of U.S. nonprovisional application Ser. No. 16/237,894, filed on Jan. 2, 2019, which is a continuation of U.S. nonprovisional application Ser. No. 15/884,683, filed on Jan. 31, 2018, now U.S. Pat. No. 10,213,666, all of which is incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present invention relates to sports equipment; particularly, to a golf club shaft.

BACKGROUND OF THE INVENTION

During the course of a golf swing, the club shaft is under a load and is subject to often significant deflection and torsional rotation. Few have recognized that this deflection and rotation, albeit on a much smaller scale, also happens during the course of a putting stroke, particularly as the head weight of putter heads increases. As used herein, "stability" of a shaft refers to how the toe and heel of the club face track one another through the stroke. The relative volatility of the velocity and acceleration of the toe and heel of the club face pre-impact, at impact, and post-impact can be significantly improved. Controlling the face angle and face twist results in a tighter departure angle range for the ball leaving the face and significantly improves the likelihood of the ball leaving the face at an angle closer to the target line, which in the case of putters improves the likelihood of making a putt.

While driver, fairway metal, and hybrid shafts have evolved over the past 30 plus years, from steel tubes to a variety of often complex composite shafts, putter shafts have not evolved at pace. No serious golfer trusts their driver to perform optimally with an inexpensive steel shaft. Why would any serious golfer, if they had a better option, trust their putter to work best with a cheap steel shaft? After all, a putter is used almost twice as much as any other club in the bag. Most conventional putter shafts are simply steel pipes (wrapped and welded construction) containing little to no engineered aspects tailored to the unique situation of putting. They are narrow in the tip and taper to a larger diameter at the butt-end for gripping purposes, and consequently exhibit inherent weakness in the lower portion of the shaft. Ultimately, the impetus for steel shafts continued preeminence is cost: steel shafts are used by putter manufacturers primarily because they are so cheap.

The present invention provides significant advances tailored to putter shafts, but are also applicable to all golf shafts. In fact, embodiments of the present invention provide a golfer, or fitting professional, with the ability to easily adjust the properties of a shaft to suit an individual's golf swing whether it be a putter shaft or any other club.

SUMMARY OF THE INVENTION

A golf shaft having a butt portion joined to a tip portion by a coupler and possessing unique relationships, including rigidity relationships, which provide beneficial performance characteristics including improved stability and adjustability.

BRIEF DESCRIPTION OF THE DRAWINGS

Without limiting the scope of the present invention as claimed below and referring now to the drawings and figures:

FIG. 20 shows a table of the shaft stiffness profile of an embodiment of the tip portions, not to scale;

Figure 1:
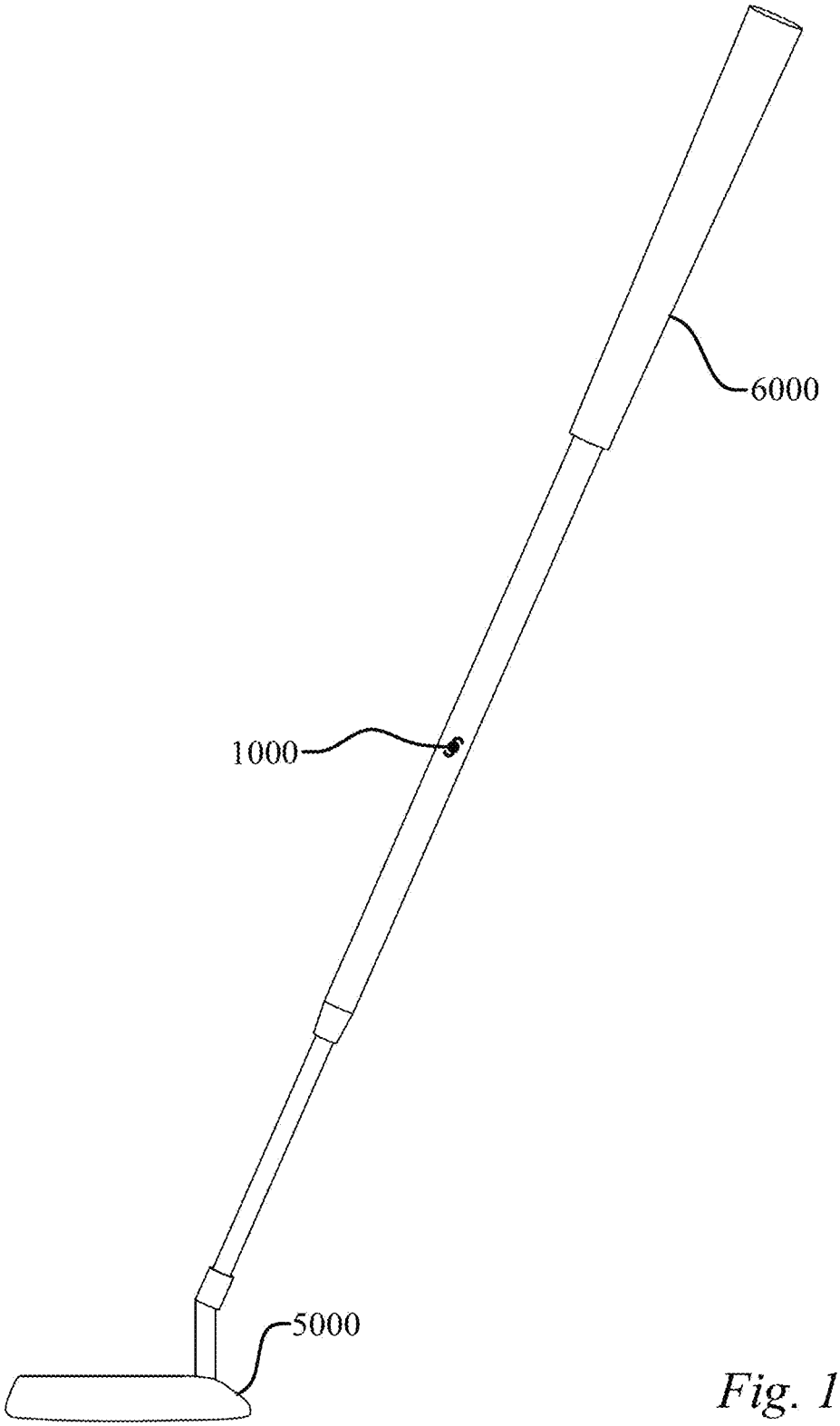
FIG. 1 shows a front elevation view of a golf club, not to scale.

These drawings are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

As seen in FIGS. 1-8, an embodiment of the shaft (100) of the present invention includes a shaft distal end (110), a shaft proximal end (120), a shaft outer diameter, and a shaft mass, wherein each point along the shaft length (130) has a shaft flexural rigidity, often abbreviated EI, and a shaft torsional rigidity, often abbreviated GJ. The shaft (100) may include a butt portion (1000) joined to a tip portion (2000) by a coupler (3000), wherein the coupler (3000) may permanently, or releasably, attach the butt portion (1000) to the tip portion (2000). It is important to appreciate that the shaft flexural rigidity and the shaft torsional rigidity may be taken at points along the shaft length (100) that take into account areas of the shaft (100) composed of multiple elements within a cross-section taken perpendicular to a shaft axis, while later disclosed flexural rigidity and torsional rigidity of a specific element are rigidities associated solely with that particular element rather than the combination of elements that may compose the shaft (100).

Figure 6A:
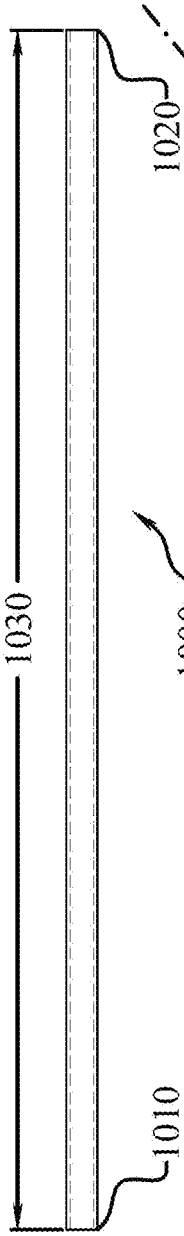
FIG. 6(A) shows a side elevation view of an embodiment of a butt portion, not to scale.
Figure 6B:
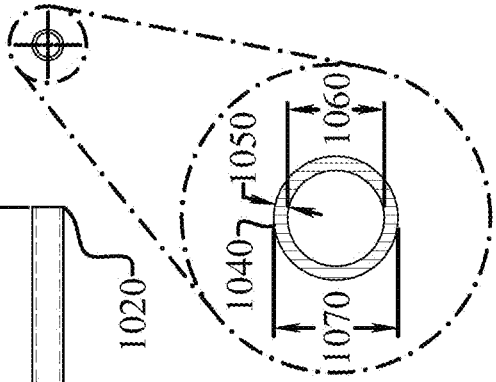
FIG. 6(B) shows an end elevation view of an embodiment of a butt portion, not to scale.

The butt portion (1000), specifically seen in FIGS. 6(A) and 6(B), has a butt portion distal end (1010), a butt portion proximal end (1020), a butt portion length (1030), a butt portion sidewall (1040) having a butt portion sidewall thickness (1050), a butt portion inner diameter (1060), and a butt portion outer diameter (1070). Similarly, the tip portion (2000), specifically seen in FIGS. 5(A) and 5(B), has a tip portion distal end (2010), a tip portion proximal end (2020), a tip portion length (2030), a tip portion sidewall (2040) having a tip portion sidewall thickness (2050), a tip portion inner diameter (2060), and a tip portion outer diameter (2070). In some embodiments the tip portion length (2030) is no more than 65% of the butt portion length (1030), and in some additional embodiments at least a portion of the tip portion (200) has a tip portion outer diameter (2070) that is at least 25% less than the butt portion outer diameter (1070) of a portion of the butt portion (1000). Further, the coupler (3000), specifically seen in FIGS. 8(A) and 8(B), has a coupler distal end (3010), a coupler proximal end (3020), a coupler length (3030), a coupler sidewall (3040) having a coupler sidewall thickness (3050), a coupler inner diameter (3060), and a coupler outer diameter (3070). In one particular embodiment at least a portion of the butt portion (1000) has a butt portion sidewall thickness (1050) that is greater than the tip portion sidewall thickness (2050) of a portion of the tip portion (2000), while in a further embodiment the butt portion sidewall thickness (1050) is at least 15% greater than the tip portion sidewall thickness (2050), and in yet another embodiment the butt portion sidewall thickness (1050) is at least 25% greater than the tip portion sidewall thickness (2050). In an embodiment the butt portion sidewall thickness (1050) is no greater than 0.125", and no greater than 0.100" in another embodiment, and no greater than 0.085" in still a further embodiment. Another series of embodiments introduces a minimum butt portion sidewall thickness (1050) of at least 0.020", and at least 0.025" in another embodiment, and at least 0.030" in still a further embodiment. In a particularly effective embodiment the maximum tip portion sidewall thickness (2050) is greater than the maximum butt portion sidewall thickness (1050), and in one embodiment it is at least 0.005" greater, and at least 0.015" greater in another embodiment, and at least 0.020" greater in yet another embodiment. The maximum tip portion sidewall thickness (2050) is preferably no greater than 0.125", and no greater than 0.100" in another embodiment, and no greater than 0.080" in yet a further embodiment. The butt portion sidewall thickness (1050)

and/or the tip portion sidewall thickness (2050) may vary throughout the length. In one embodiment the butt portion sidewall thickness (1050) increases to a maximum thickness that is located within a distance from the butt portion proximal end (1020) equal to twice the coupler length (3030), and within a distance of 6" from the butt portion proximal end (1020) in another embodiment. In another embodiment the butt portion sidewall thickness (1050) varies from a minimum thickness to a maximum thickness that is at least 5% greater than the minimum thickness, and at least 10% greater in another embodiment, and at least 15% greater in yet a further embodiment. Similarly, in an analogous series of embodiments the tip portion sidewall thickness (2050) varies from a minimum thickness to a maximum thickness that is at least 5% greater than the minimum thickness, and at least 10% greater in another embodiment, and at least 15% greater in yet a further embodiment.

In another embodiment an average coupler sidewall thickness (3050) throughout the coupler length (3030) is greater than an average butt portion sidewall thickness (1050), and in yet a further embodiment the average coupler sidewall thickness (3050) is greater than an average tip portion sidewall thickness (2050). In still a further embodiment the average coupler sidewall thickness (3050) is at least 15% greater than the average butt portion sidewall thickness (1050), and in yet a further embodiment the average coupler sidewall thickness (3050) is at least 15% greater than the average tip portion sidewall thickness (2050).

In some embodiments the butt portion (1000) is formed of a non-metallic butt portion material having a butt material density, a butt portion mass that is 35-75% of the shaft mass, a butt portion elastic modulus, a butt portion shear modulus, and each point along the butt portion length (1030) has a butt portion area moment of inertia, a butt portion polar moment of inertia, a butt portion flexural rigidity, and a butt portion torsional rigidity. The density of the butt portion (1000) may be constant or it may vary throughout the butt portion length (1030). Likewise, in some additional embodiments the tip portion (2000) is formed of a metallic tip portion material having a tip material density that is at least 15% greater than the butt material density, a tip portion elastic modulus, and a tip portion shear modulus, and each point along the tip portion length (2030) has a tip portion area moment of inertia, a tip portion polar moment of inertia, a tip portion flexural rigidity that in some embodiments is less than the butt portion flexural rigidity, and a tip portion torsional rigidity that in some embodiments is less than the butt portion torsional rigidity.

Figure 13A:
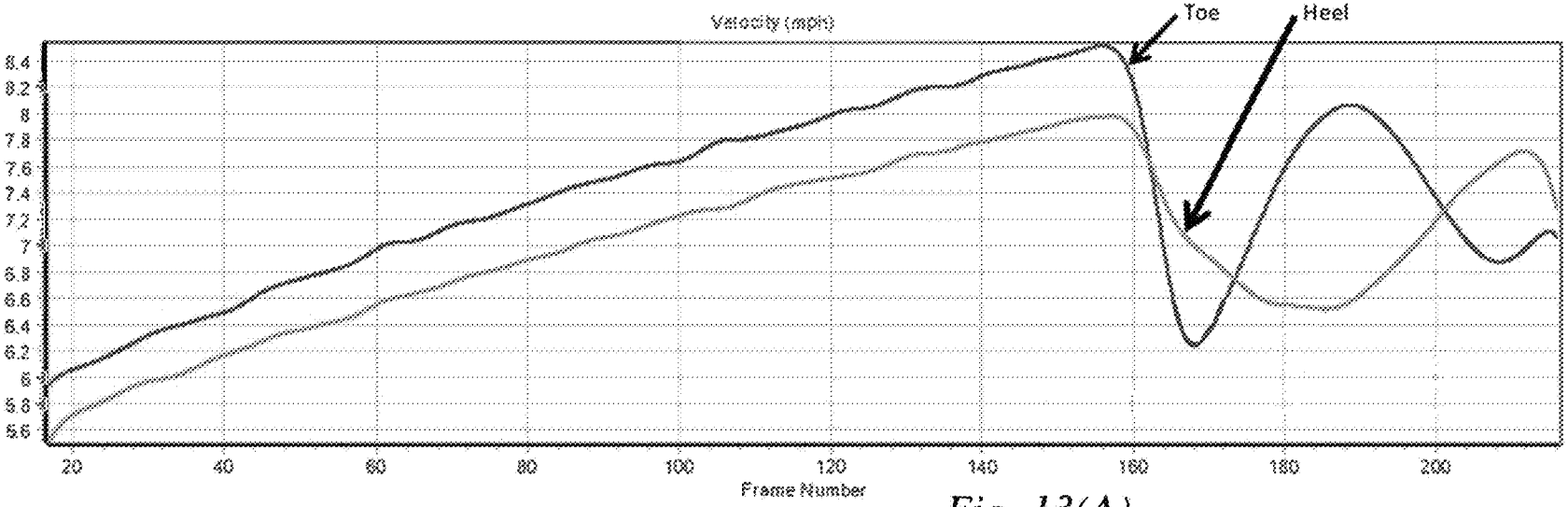
FIG. 13(A) shows a graph of the heel and toe velocity of a putter head through a putting stroke, not to scale.

The material, density, weight, rigidity, kickpoint distance, shaft CG distance, and shaft length relationships disclosed herein each, and in combination, are critical to the feel, flex, and stability of the shaft (100) to produce unexpected benefits when striking a golf ball with a golf club head (5000) attached to the shaft (100). These relationships provide less twisting of the face, as well as improved consistency of the face velocity and acceleration of the heel and toe portions, both prior to, at, and after impact, as will be explained in more detail later with respect to FIGS. 14(A) and 14(B) compared to FIGS. 13(A) and 13(B). One skilled in the art will understand that that during the course of a swing, the golf shaft is under a load and is subject to significant deflection and torsional rotation, however, few have recognized that deflection and rotation, albeit on a much smaller scale, also happen during the course of a putting stroke, particularly as the head weight of putter heads increases. As used herein, "stability" of the shaft refers to how the toe and heel of the club face track one another through the stroke. The relative volatility of the velocity and acceleration of the toe and heel of the club face pre-impact, at impact, and post-impact is significantly improved by these relationships. For instance, controlling the face twist results in a tighter departure angle of the ball leaving the face and significantly improves the likelihood of the ball leaving the face at an angle closer to the target line, which in the case of putters improves the likelihood of making a putt. Experiments have shown that the putter departure angle range is reduced 20%-33% depending on the type of putter and type of stroke employed, without a reduction in feel at and after impact. Additionally, these relationships, particularly during low speed impacts associated with putting, produce lower launch of the ball off the face, which for putters has been linked to achieving true roll sooner, leading to a ball that slows down more predictably, thus affording better distance control for the golfer.

Figure 2:
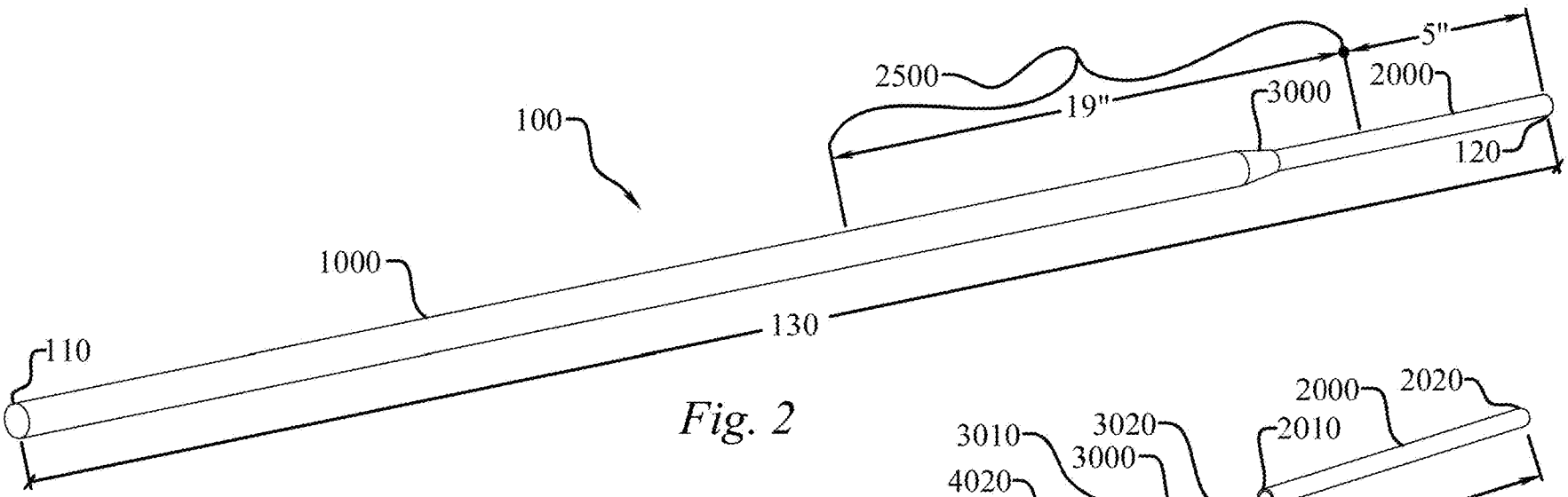
FIG. 2 shows a perspective view of an embodiment of a golf shaft, not to scale.
Figure 3:
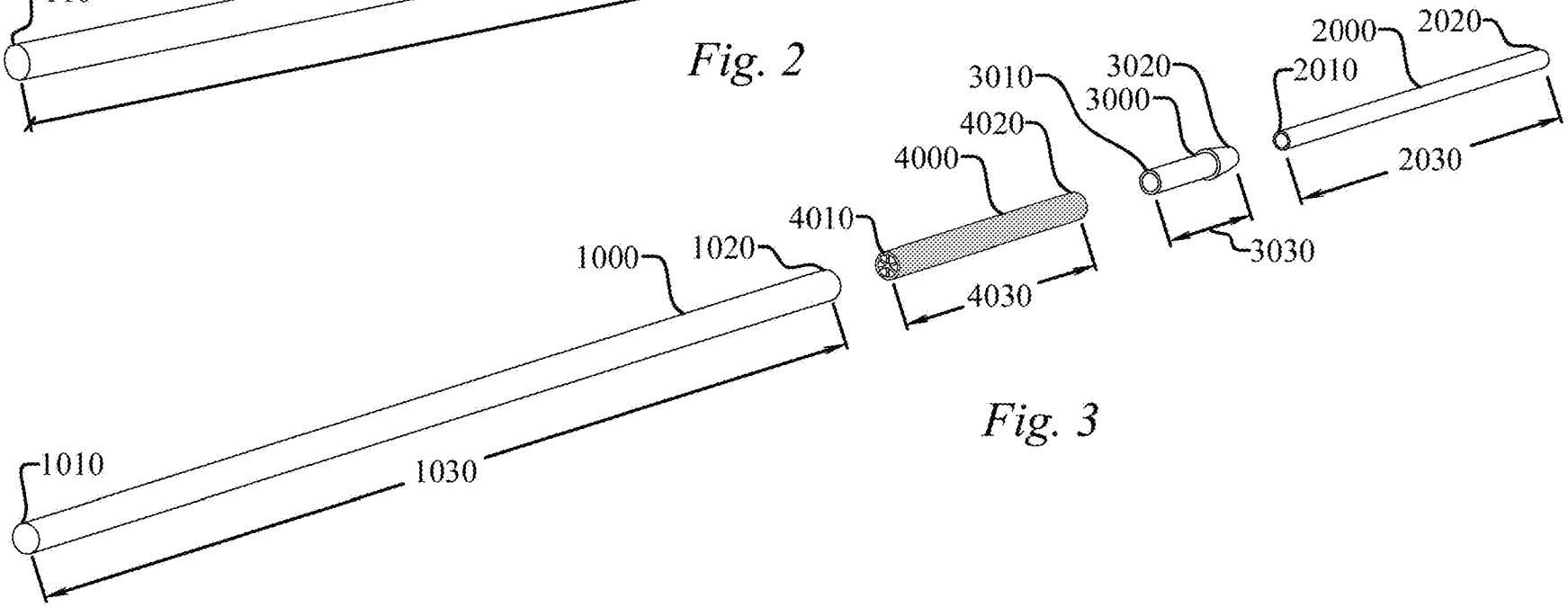
FIG. 3 shows an exploded perspective view of an embodiment of a golf shaft, not to scale.
Figure 10:
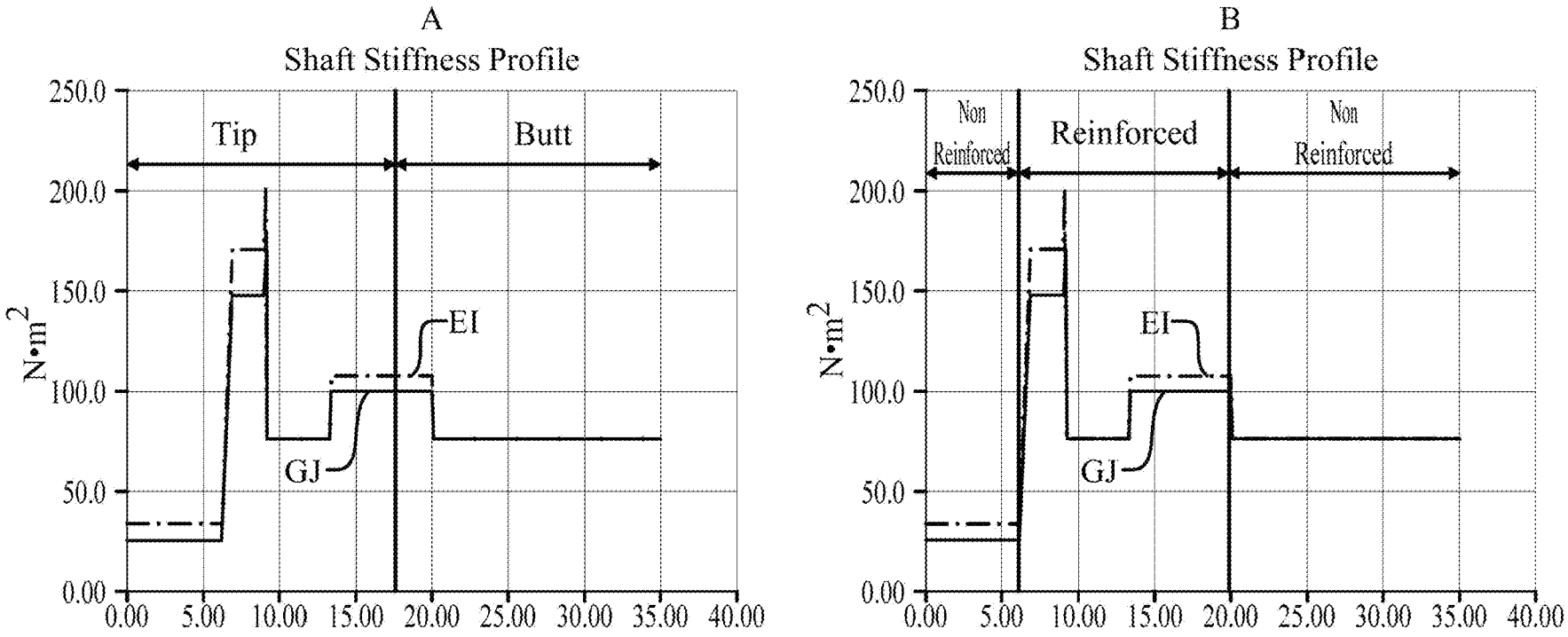
FIG. 10 shows graphs of the shaft stiffness profile of an embodiment of the golf shaft, not to scale.

Similarly, the benefits are further enhanced via unique relationships provided when the shaft (100) includes a reinforced region (2500), seen in FIG. 2, is located between a first point located 5" from the shaft proximal end (120) and a second point located 24", 30", or 36" from the shaft proximal end (120). As best seen in FIG. 10, in a first portion of the reinforced region (2500) the shaft flexural rigidity is at least 50% greater than a minimum tip portion flexural rigidity and less than 100 $N*m^2$, and the shaft torsional rigidity is at least 50% greater than a minimum tip portion torsional rigidity and less than 100 $N*m^2$, while in a second portion of the reinforced region (2500) the shaft flexural rigidity is at least 50% greater than a minimum butt portion flexural rigidity and is greater than 120 $N*m^2$, and the shaft torsional rigidity is at least 50% greater than a minimum butt portion torsional rigidity and is greater than 120 $N*m^2$. In another embodiment the "a minimum" language of the prior sentence is replaced with "an average," and in an even further embodiment the "a minimum" language of the prior sentence is replaced with "a maximum." One skilled in the art will appreciate that these rigidities of the tip portion and the butt portion may be constant, and thus the minimum, maximum, and average will be equal, or the rigidities may vary throughout the cited component and therefore possess a distinct minimum, maximum, and average; and these minimum, maximum, and average substitutions embodiments apply equally to all embodiments disclosed herein.

Thus, the reinforced region (2500) has a first portion with both flexural and torsional rigidity significantly higher than that of the tip portion (2000), but also a second portion that is even higher that than of the first portion and significantly higher than that of the butt portion (1000), in addition to the rigidity of the butt portion (1000) being higher than that of the tip portion (2000). In another related embodiment the first portion of the reinforced region (2500) has the shaft flexural rigidity at least 75% greater than the minimum tip portion flexural rigidity while also being less than 90 $N*m^2$, and the shaft torsional rigidity is at least 75% greater than the minimum tip portion torsional rigidity while also being less than 90 $N*m^2$. In still a further related embodiment the second portion of the reinforced region (2500) has the shaft flexural rigidity at least 75% greater than the minimum butt portion flexural rigidity and also greater than 135 $N*m^2$, and the shaft torsional rigidity is at least 75% greater than the minimum butt portion torsional rigidity and also greater than 135 $N*m^2$.

Figure 11:
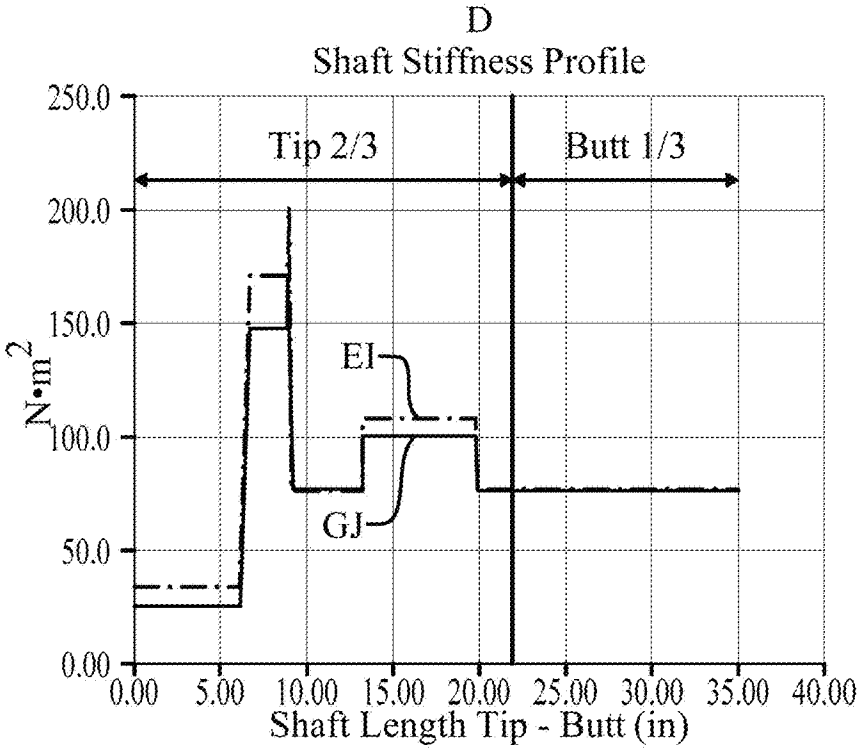
FIG. 11 shows graphs of the shaft stiffness profile of an embodiment of the golf shaft, not to scale.
Figure 11:
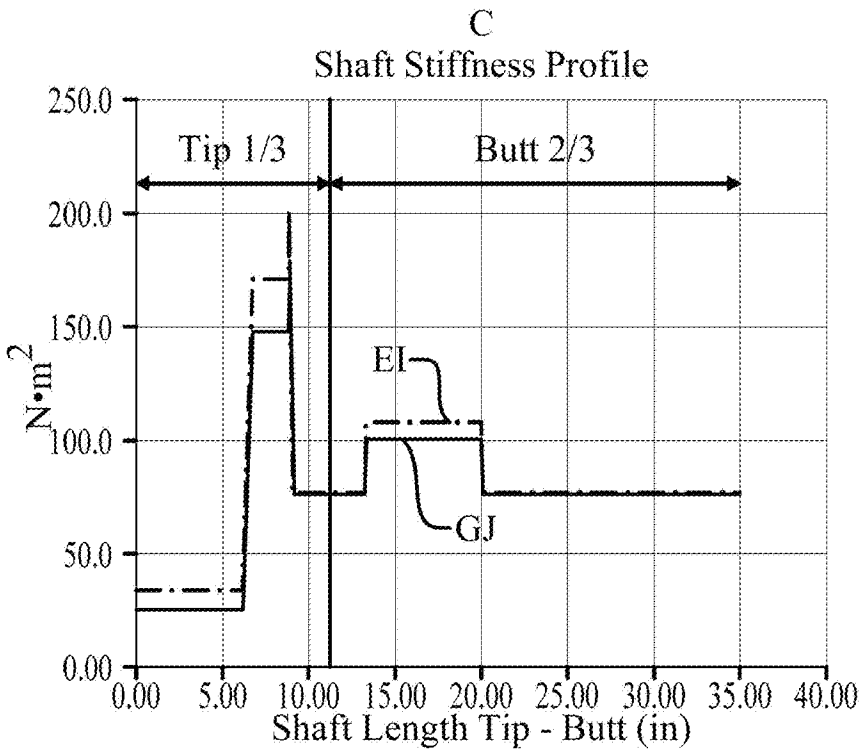

In addition, the benefits are enhanced further via unique relationships provided when a first portion of the shaft (100) extending ⅔ of the shaft length (130) from the shaft proximal end (120) has a first average flexural rigidity, a second portion of the shaft (100) extending ⅓ of the shaft length (130) from the shaft distal end (110) has a second average flexural rigidity, and the first average flexural rigidity is at least 50% of the second average flexural rigidity, as illustrated in FIG. 11. For comparison, a typical steel shaft is more than twice as stiff in the upper ⅓ portion compared to the lower ⅔ portion. In another embodiment the first average flexural rigidity is at least 75% of the second average flexural rigidity. In a further related embodiment the first average flexural rigidity is at least 100% of the second average flexural rigidity, while in still another related embodiment the first average flexural rigidity is 75-200% of the second average flexural rigidity, and in yet another related embodiment the first average flexural rigidity is 100-150% of the second average flexural rigidity.

As one skilled in the art will appreciate, the flexural rigidities discussed herein, which are often also referred to as bending stiffness, are based upon the material stiffness, or elastic modulus (E), and the cross-section geometry properties associated with the area moment of inertia (I), which is why the flexural rigidity is often referred to as EI. For a simple tube the area moment of inertia (I) is:

$$I = \frac{\pi}{4}\left(r_o^4 - r_i^4\right)$$

Where $r_o$ is the outside radius of the tube and $r_i$ is the inner radius of the tube.

Additionally, the torsional rigidities discussed herein, which are often referred to as torsional stiffness, are based upon the material torsional stiffness, or shear modulus (G), and the cross-section geometry properties associated with the polar moment of inertia (J), which is why the torsional rigidity is often referred to as GJ. For a simple tube the polar moment of inertia (J) is:

$$J = \frac{\pi}{2}\left(r_o^4 - r_i^4\right)$$

Where $r_o$ is the outside radius of the tube and $r_i$ is the inner radius of the tube.

Figure 4:
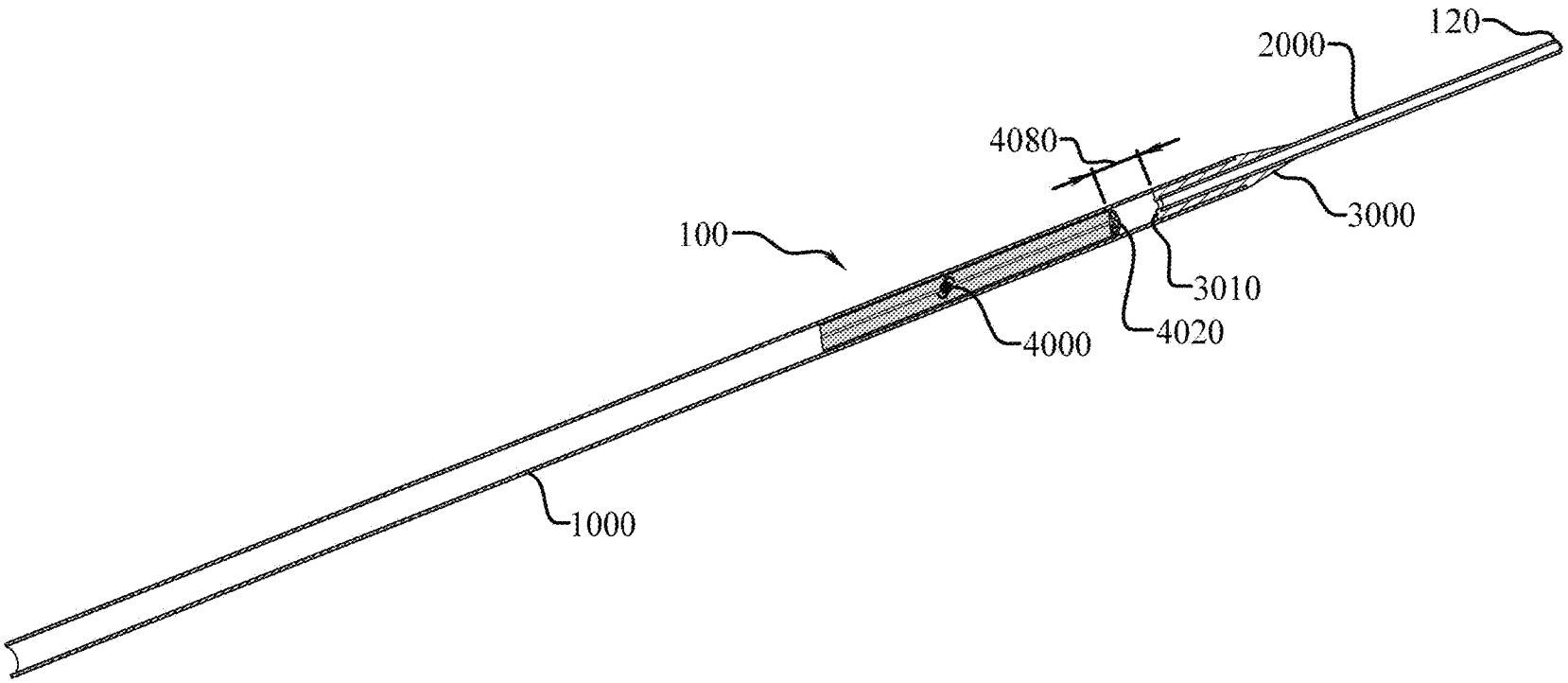
FIG. 4 shows a perspective cross-sectional view of an embodiment of a golf shaft, not to scale.
Figure 5A:
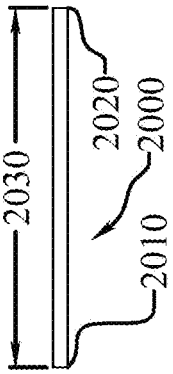
FIG. 5(A) shows a side elevation view of an embodiment of a tip portion, not to scale.
Figure 5B:
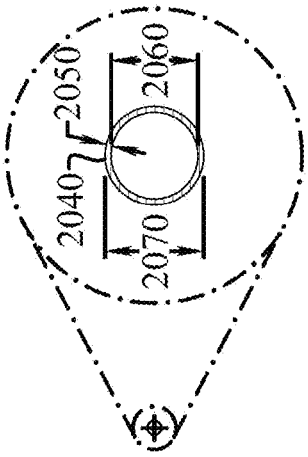
FIG. 5(B) shows an end elevation view of an embodiment of a tip portion, not to scale.

One skilled in the art will appreciate these simple equations work well for the individual elements, however when determining the rigidities for the overall shaft flexural rigidity and the shaft torsional rigidity there will be points that need to factor in the various layers of elements. For example, as seen in FIG. 4, starting at the tip portion (2000) the calculations will be easy until the tip portion (2000) enters into the coupler (3000), at which point the shaft rigidity calculations must account for the overlap of the coupler (3000) and the tip portion (2000); then a little further into the coupler (3000) the shaft rigidity calculations must account for the overlap of the coupler (3000), the tip portion (2000), and the butt portion (1000); then past the coupler (3000) and within a separation distance (4080) the shaft rigidity calculations are simplified again until reaching the area of a butt portion insert (4000) whereby the shaft rigidity calculations must account for the butt portion (1000) and the butt portion inert (4000). This is just one illustrative example, but highlights the fact that the overall shaft flexural rigidity and the shaft torsional rigidity at various points through the length of the shaft length (130) has to account for multiple elements, whereas references to flexural rigidity and the torsional rigidity of individual components are solely for the referenced individual components, which is an important distinction.

In another embodiment the previously discussed benefits are further achieved in an embodiment having a minimum tip portion flexural rigidity that is at least 25% less than a maximum butt portion flexural rigidity, and the minimum tip portion torsional rigidity is at least 25% less than a maximum butt portion torsional rigidity. Still further, in another embodiment the minimum tip portion flexural rigidity is 25-75% less than the maximum butt portion flexural rigidity, and the minimum tip portion torsional rigidity is 25-75% less than the maximum butt portion torsional rigidity. In another embodiment the previously discussed benefits are further achieved in an embodiment having a minimum tip portion flexural rigidity that is at least 25% less than the minimum butt portion flexural rigidity, and the minimum tip portion torsional rigidity is at least 25% less than the minimum butt portion torsional rigidity. Still further, in another embodiment the minimum tip portion flexural rigidity is 25-75% less than the minimum butt portion flexural rigidity, and the minimum tip portion torsional rigidity is 25-75% less than the minimum butt portion torsional rigidity. The minimum butt portion flexural rigidity is at least 40 $N*m^2$, and the minimum butt portion torsional rigidity is at least 20 $N*m^2$; while in another embodiment minimum butt portion flexural rigidity is at least 50 $N*m^2$, and the minimum butt portion torsional rigidity is at least 30 $N*m^2$; and one particular unusual embodiment has a minimum butt portion torsional rigidity that is greater than a minimum butt portion flexural rigidity (analogous to the red tip in FIG. 18).

In one embodiment such relationships are achieved by having a shaft outer diameter that is constant throughout at least 50% of the shaft length (130), thereby ensuring such beneficial relationships are maintained. In yet another embodiment the shaft outer diameter is constant throughout at least 75% of the shaft length (130), while in a further embodiment the butt portion outer diameter (1070) is constant throughout the entire butt portion length (1030), and in still another embodiment the tip portion outer diameter (2070) is constant throughout at least 50% of the tip portion length (2030), and at least 75% in still another embodiment.

The beneficial relationships may further be achieved and maintained by controlling the lengths of the individual components. In one such embodiment the tip portion length (2030) is no more than 55% of the butt portion length (1030), while in another embodiment the tip portion length (2030) is at least 15% of the butt portion length (1030), and in yet another embodiment the tip portion length (2030) is at least 4", and 4-16" in another embodiment, and 6-12" in still a further embodiment. In another such embodiment the butt portion length (1030) is at least twice the tip portion length (2030), while in another embodiment the butt portion length (1030) is at least three times the tip portion length (2030), and in still a further embodiment the butt portion length (1030) is at least 2-5 times the tip portion length (2030), and in still a further embodiment the butt portion length (1030) is at least 2.5-4 times the tip portion length (2030). In yet another embodiment the butt portion length (1030) is at least 16", and at least 20" in another embodiment, and at least 24" in still a further embodiment. Further embodiments cap the butt portion length (1030) to no more than 48", and no more than 42" in another embodiment, and no more than 36" in a further embodiment, and no more than 30" in still another embodiment, and no more than 28" in still a further embodiment.

In an even further embodiment the shaft flexural rigidity is constant throughout at least 10% of the shaft length (130), and the shaft torsional rigidity is constant throughout at least 10% of the shaft length (130). While in still a further embodiment the shaft flexural rigidity is constant throughout at least 25% of the shaft length (130), and the shaft torsional rigidity is constant throughout at least 25% of the shaft length (130). While in yet still another embodiment the shaft flexural rigidity is constant throughout at least 40% of the shaft length (130), and the shaft torsional rigidity is constant throughout at least 40% of the shaft length (130). In a further embodiment the shaft flexural rigidity is constant throughout at least 50% of the shaft length (130), and the shaft torsional rigidity is constant throughout at least 50% of the shaft length (130). Similarly, adding a cap to the range, in a further embodiment the shaft flexural rigidity is constant throughout no more than 90% of the shaft length (130), and the shaft torsional rigidity is constant throughout no more than 90% of the shaft length (130). In yet another embodiment the shaft flexural rigidity is constant throughout no more than 75% of the shaft length (130), and the shaft torsional rigidity is constant throughout no more than 75% of the shaft length (130). In still a further embodiment the shaft flexural rigidity is constant throughout no more than 60% of the shaft length (130), and the shaft torsional rigidity is constant throughout no more than 60% of the shaft length (130).

Such relationships may also be achieved by maintaining a tip portion outer diameter (2070) no more than 60% less than the maximum butt portion outer diameter (1070), and in another embodiment by having a coupler (3000) with a coupler mass that is no more than 15% of the shaft mass. Further mass relationships achieve the benefits by also controlling the mass of specific components. For example, in one embodiment the coupler mass is at least 5% of the shaft mass, while in another embodiment the butt portion mass is 40-70% of the shaft mass, and in yet a further embodiment the butt portion mass is 45-65% of the shaft mass. Likewise, in another embodiment the tip portion (2000) has a tip portion mass that is no more than 85% of the butt portion mass, while in another embodiment the tip portion mass is no more than 75% of the butt portion mass, and in yet a further embodiment the tip portion mass is 35-75% of the butt portion mass. The butt portion mass is preferably no more than 85 grams, and no more than 75 grams in another embodiment, and no more than 65 grams in still a further embodiment. Yet a further series of embodiments cap the lower range of the butt portion mass with one embodiment having a butt portion mass of at least 40 grams, and a butt portion mass of at least 50 grams in another embodiment, and a butt portion mass of at least 60 grams in still a further embodiment. The coupler mass is preferably no more than 25 grams, and no more than 20 grams in another embodiment, and no more than 15 grams in still a further embodiment. Yet a further series of embodiments cap the lower range of the coupler mass with one embodiment having a coupler mass of at least 5 grams, and at least 7.5 grams in another embodiment, and at least 10 grams in still a further embodiment. In one embodiment a kit contains at least 2 butt portions (1000) where the difference in the butt portion mass is at least 10 grams, and at least 15 grams in a further embodiment, and at least 20 grams in still another embodiment; while a further series of embodiments limits the difference to no more than 50 grams, and no more than 40 grams in another embodiment, and no more than 35 grams in still a further embodiment. Still other kit embodiments provide a user with significant adjustability and changes in feel when the difference in the butt portion mass is at least 50% of the heaviest tip portion mass, at least 75% in another embodiment, and at least 95% in still a further embodiment. Lighter butt portion options may benefit seniors and juniors, while heavier butt portion options favor fast swing speed players.

The coupler (3000) is formed of a coupler material having a coupler material density, a coupler mass, a coupler elastic modulus, a coupler shear modulus, and each point along the coupler length (3030) has (i) a coupler flexural rigidity, and (ii) a coupler torsional rigidity. In an embodiment at least a portion of coupler (3000) has a coupler flexural rigidity that is greater than the tip portion flexural rigidity of a portion of the tip portion (2000), and at least a portion of the coupler (3000) has a coupler torsional rigidity that is greater than the tip portion torsional rigidity of a portion of the tip portion (2000). Another embodiment has at least a portion of the coupler (3000) with a coupler flexural rigidity that is greater than the butt portion flexural rigidity of a portion of the butt portion (1000), and at least a portion of the coupler (3000) with a coupler torsional rigidity is greater than the butt portion torsional rigidity of a portion of the butt portion (1000). A further embodiment has at least a portion of coupler (3000) with a coupler flexural rigidity that is 75% greater than the tip portion flexural rigidity of a portion of the tip portion (2000), and at least a portion of the coupler (3000) with a coupler torsional rigidity that is 75% greater than the tip portion torsional rigidity of a portion of the tip portion (2000). A still further embodiment has a portion of coupler (3000) with a coupler flexural rigidity that is 100-500% greater than the tip portion flexural rigidity of a portion of the tip portion (2000), and at least a portion of the coupler (3000) with a coupler torsional rigidity that is 100-500% greater than the tip portion torsional rigidity of a portion of the tip portion (2000). Yet a still further embodiment has a portion of coupler (3000) with a coupler flexural rigidity that is 200-500% greater than the tip portion flexural rigidity of a portion of the tip portion (2000), and at least a portion of the coupler (3000) with a coupler torsional rigidity that is 200-500% greater than the tip portion torsional rigidity of a portion of the tip portion (2000). Even further, another embodiment has a portion of coupler (3000) with a coupler flexural rigidity that is 300-500% greater than the tip portion flexural rigidity of a portion of the tip portion (2000), and at least a portion of the coupler (3000) with a coupler torsional rigidity that is 300-500% greater than the tip portion torsional rigidity of a portion of the tip portion (2000).

The disclosed rigidity relationships may be obtained in a number of manners, one of which consists of varying the butt portion inner diameter (1060) throughout the butt portion length (1030) to achieve the disclosed reinforced region (2500) rigidity relationships, and/or the rigidity relationships associated with the first portion of the shaft (100) extending ⅔ of the shaft length (130) from the shaft proximal end (120) and the second portion of the shaft (100) extending ⅓ of the shaft length (130) from the shaft distal end (110). In another embodiment any of these relationships may be obtained by embedding a reinforcement material within the butt portion sidewall (1040) without the need for a varying butt portion inner diameter (1060). In such embodiments the reinforcement material may consist of a tube of higher rigidity material extending around all 360 degrees of a cross-section of the butt portion (1000), or may consists of inserts that are localized and do not extend around all 360 degrees of a cross-section of the butt portion (1000).

In another embodiment any of these relationships may be obtained by further including a butt portion insert (4000), seen in FIGS. 3, 4, 7(A), and 7(B), attached in the butt portion (1000) and having a butt portion insert distal end (4010), a butt portion insert proximal end (4020), a butt portion insert length (4030) that is at least 25% of the tip portion length (2030), a butt portion insert sidewall (4040) having a butt portion insert sidewall thickness (4050), a butt portion insert inner diameter (4060), and a butt portion insert outer diameter (4070) that is less than the butt portion inner diameter (1060), wherein majority of the butt portion insert length (4030) is within the reinforced region (2500). In another embodiment the butt portion insert length (4030) is at least 50% of the tip portion length (2030) and no more than 50% of the butt portion length (1030), while in yet a further embodiment the butt portion insert length (4030) is at least 10% of the butt portion length (1030) and no more than 150% of the tip portion length (2030), and in yet another embodiment the butt portion insert inner diameter (4060) is greater than the tip portion inner diameter (2060). In still a further embodiment at least 75% of the butt portion insert length (4030) is within the reinforced region (2500), while in another embodiment the entire butt portion insert (4000) is within the reinforced region (2500). As seen in FIG. 4, in another embodiment the butt portion insert proximal end (4020) is separated from the coupler distal end (3010) by a separation distance (4080) that is at least 50% of the butt portion outer diameter (1070), thereby achieving the disclosed drop in rigidity between the butt portion insert (4000) and the coupler (3000). In one such embodiment the separation distance (4080) is no more than five times the butt portion outer diameter (1070), while in another embodiment the separation distance (4080) is no more than 50% of the butt portion insert length (4030).

In one embodiment the butt portion insert length (4030) is at least 2", while in another embodiment it is at least 4", while in yet a further embodiment it is at least 6". However, additional embodiments restrict the butt portion insert length (4030) so as not to diminish the benefits associated with the butt portion insert (4000). Specifically, in one embodiment the butt portion insert length (4030) is no more than 12", while in another embodiment the butt portion insert length (4030) is no more than 10", and in yet a further embodiment the butt portion insert length (4030) is no more than 8". Additionally, the placement of the butt portion insert (4000) is essential to providing the described benefits. In one particular embodiment a distance from the butt portion insert proximal end (4020) to the shaft proximal end (120) is at least 7", and is at least 9" in another embodiment, and is at least 11" in yet a further embodiment. Additional embodiments reduce the likelihood of diminishing the benefits associated with the butt portion insert (4000) by controlling this distance. For example, in one embodiment the distance from the butt portion insert proximal end (4020) to the shaft proximal end (120) is no more than 18", and is no more than 16" in another embodiment, and no more than 14" in yet a further embodiment.

One skilled in the art will appreciate that the butt portion insert (4000) has a center of gravity, or CG, and the location of the butt portion insert CG significantly influences the benefits associated with the golf shaft (100). In one such embodiment the butt portion insert CG is located a distance from the shaft proximal end (120) that is at least 9", and at least 11" in another embodiment, and at least 13" in yet a further embodiment. In some embodiments reduction in the benefits associated with the butt portion insert (4000) have been observed when this distance from the shaft proximal end (120) becomes too large. Therefore, in another embodiment butt portion insert CG is located a distance from the shaft proximal end (120) that is no more than 19", and no more than 17" in another embodiment, and no more than 15" in still a further embodiment. In another embodiment a separation distance from the shaft CG to the butt portion insert CG is less than the butt portion insert length (4030), and no more than 75% of the butt portion insert length (4030) in another embodiment, and no more than 50% of the butt portion insert length (4030) in still a further embodiment. Another variation has a second separation distance defined as the distance from a kickpoint distance, defined later, to the location of the butt portion insert CG when installed in the shaft, and the second separation distance is less than the butt portion insert length (4030), and no more than 75% of the butt portion insert length (4030) in another embodiment, and no more than 50% of the butt portion insert length (4030) in still a further embodiment. Thus, in an embodiment the locations of the shaft CG and the kickpoint fall between the butt portion insert distal end (4010) and the butt portion insert proximal end (4020), when the insert is installed in the shaft.

The butt portion insert (4000) is formed of a butt portion insert material having a butt portion insert material density, a butt portion insert mass, a butt portion insert elastic modulus, a butt portion insert shear modulus, and each point along the butt portion insert length (4030) has (i) a butt portion insert flexural rigidity, and (ii) a butt portion insert torsional rigidity. In an embodiment at least a portion of butt portion insert (4000) has a butt portion insert flexural rigidity that is greater than the tip portion flexural rigidity of a portion of the tip portion (2000), and at least a portion of the butt portion insert (4000) has a butt portion insert torsional rigidity that is greater than the tip portion torsional rigidity of a portion of the tip portion (2000). Another embodiment has at least a portion of the butt portion insert (4000) with a butt portion insert flexural rigidity that is greater than the butt portion flexural rigidity of a portion of the butt portion (1000), and at least a portion of the butt portion insert (4000) with a butt portion insert torsional rigidity is greater than the butt portion torsional rigidity of a portion of the butt portion (1000). A further embodiment has at least a portion of butt portion insert (4000) with a butt portion insert flexural rigidity that is 75% greater than the tip portion flexural rigidity of a portion of the tip portion (2000), and at least a portion of the butt portion insert (4000) with a butt portion insert torsional rigidity that is 75% greater than the tip portion torsional rigidity of a portion of the tip portion (2000). A still further embodiment has a portion of butt portion insert (4000) with a butt portion insert flexural rigidity that is 100-300% greater than the tip portion flexural rigidity of a portion of the tip portion (2000), and at least a portion of the butt portion insert (4000) with a butt portion insert torsional rigidity that is 100-300% greater than the tip portion torsional rigidity of a portion of the tip portion (2000).

Figure 7A:
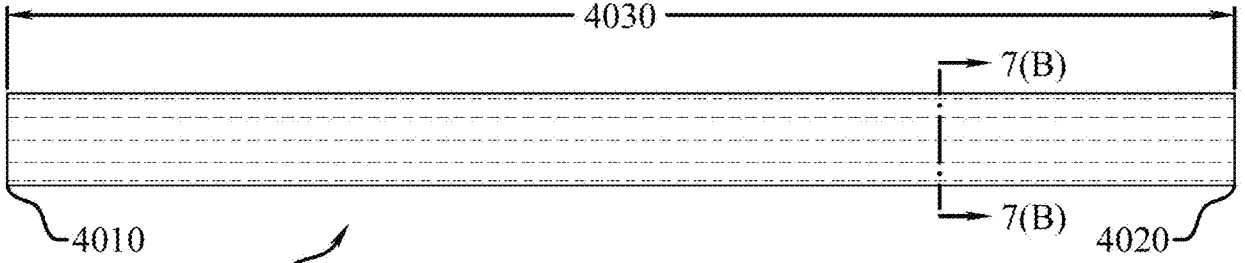
FIG. 7(A) shows a side elevation view of an embodiment of a butt portion insert, not to scale.
Figure 7B:
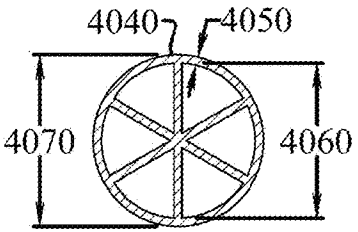
FIG. 7(B) shows an end elevation view of an embodiment of a butt portion insert, not to scale.

As seen in FIG. 7(B), the butt portion insert (4000) may be a hollow tubular structure, which may include at least one structural support spanning across the interior and passing through the center of the butt portion insert (4000). In a further embodiment, a structural support length, that extending into and out of the page in FIG. 7(B) is at least 1/16", and at least 1/8" in another embodiment, and at least 1/4" in still a further embodiment. In the embodiment of FIG. 7(A) the structural support length is at least 50% of the butt portion insert length (4030), while in another embodiment it is at least 75% of the butt portion insert length (4030), and in still a further embodiment it is at least 90% of the butt portion insert length (4030).

A further embodiment includes at least 2 structural supports spanning across the interior and passing through, and intersecting at, the center of the butt portion insert (4000), while another embodiment includes at least 3. The butt portion insert sidewall thickness (4050) is preferably no more than the butt portion sidewall thickness (1050), while in another embodiment the butt portion insert sidewall thickness (4050) is preferably no more than 75% of the butt portion sidewall thickness (1050), and in yet a further embodiment the butt portion insert sidewall thickness (4050) is preferably no more than 50% of the butt portion sidewall thickness (1050). In another series of embodiments the butt portion insert sidewall thickness (4050) is at least 50% of the tip portion sidewall thickness (2050), while in another embodiment the butt portion insert sidewall thickness (4050) is preferably at least 75% of the tip portion sidewall thickness (2050), and in yet a further embodiment the butt portion insert sidewall thickness (4050) is preferably at least 100% of the tip portion sidewall thickness (2050). In one embodiment the butt portion insert (4000) is formed of metallic material, while in another embodiment it is a metallic material different than that of the tip portion (2000), and in an even further embodiment it is formed of a metallic material having a density that is at least 35% less than the density of the tip portion (2000).

These relationships provide less twisting of the face, as well as improved consistency of the face velocity and acceleration of the heel and toe portions, both prior to, at, and after impact. FIG. 13(A) illustrates the velocity of the toe and heel of an Anser-style putter head attached to a traditional steel putter shaft attached to a robot, throughout a putting stroke with an off-center impact, while FIG. 14(A) illustrates the same putter head attached to an embodiment of the golf shaft (100). The crossing of the heel line and toe line of FIG. 13(A) shows the instability of the putter head, while FIG. 14(A) illustrates the improved performance exhibited by the golf shaft (100) whereby the heel line and toe line do not intersect.

Figure 13B:
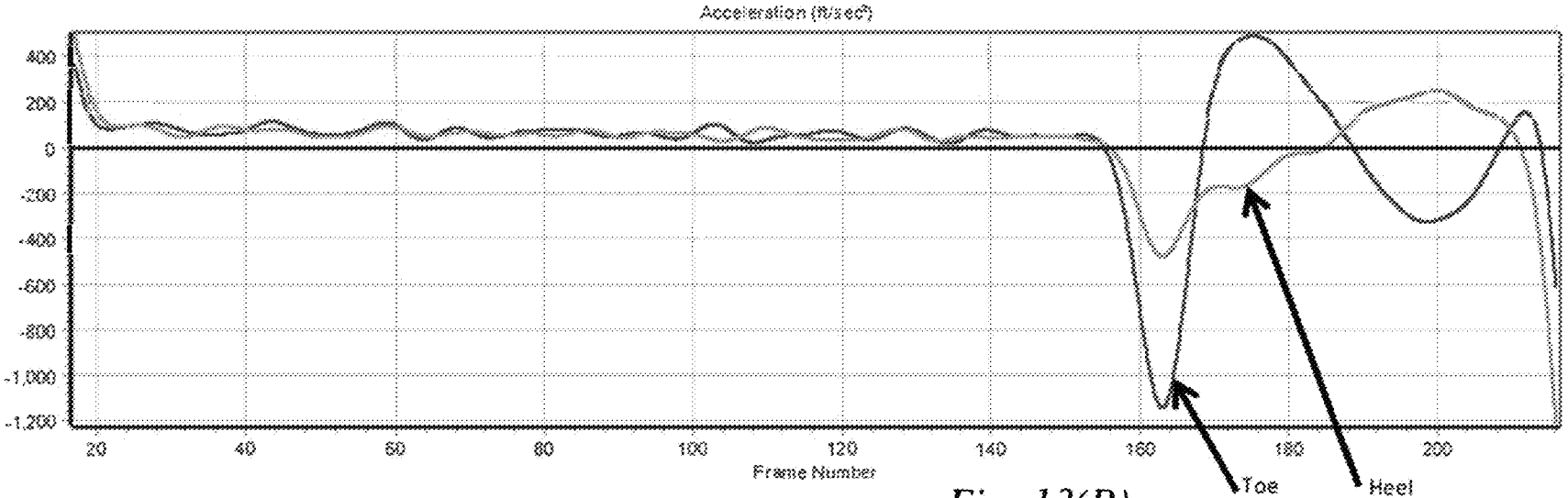
FIG. 13(B) shows a graph of the heel and toe acceleration of a putter head through a putting stroke, not to scale.
Figure 14A:
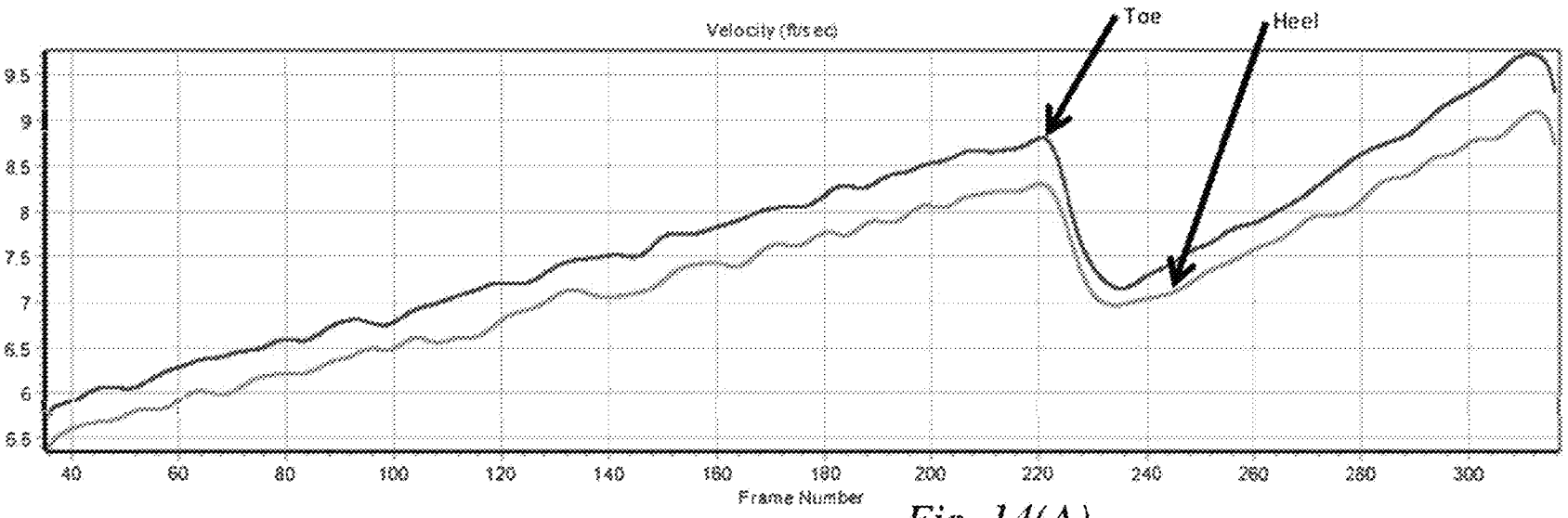
FIG. 14(A) shows a graph of the heel and toe velocity of a putter head through a putting stroke, not to scale.
Figure 14B:
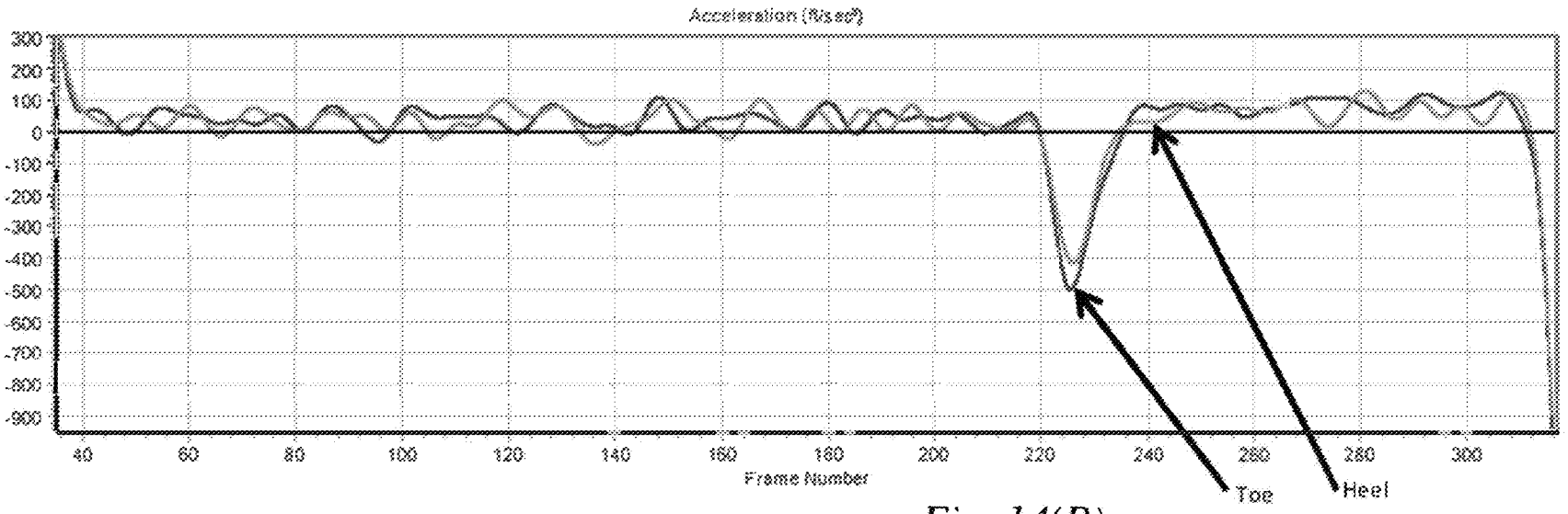
FIG. 14(B) shows a graph of the heel and toe acceleration of a putter head through a putting stroke, not to scale.

Likewise, FIG. 13(B) illustrates the acceleration of the toe and heel of the same Anser-style putter head attached to a traditional steel putter shaft attached to a robot, throughout a putting stroke with an off-center impact, while FIG. 14(B) illustrates the same putter head attached to an embodiment of the golf shaft (100). The differential between the heel line and toe line of FIG. 13(B) shows the instability of the putter head, while the differential of FIG. 14(B) illustrates the improved performance exhibited by the golf shaft (100) whereby the difference between heel line and toe line is significantly less. These improvements illustrate improved stability, which produces improved ball rolling characteristics, lower launch angles, and less dispersion. The relative volatility of the velocity and acceleration of the toe and heel of the club face pre-impact, at impact, and post-impact is significantly improved by these relationships, without a reduction in feel at and after impact.

Any of these embodiments may further enable the creation of a third portion of the reinforced region (2500) where the shaft flexural rigidity is greater than the shaft flexural rigidity in the first portion and less than the shaft flexural rigidity in the second portion, and shaft torsional rigidity is greater than the shaft torsional rigidity in the first portion and less than the shaft torsional rigidity in the second portion. In a further embodiment the third portion of the reinforced region (2500) has a shaft flexural rigidity that is at least 25% greater than the shaft flexural rigidity in the first portion and at least 25% less than the shaft flexural rigidity in the second portion, and a shaft torsional rigidity that is at least 25% greater than the shaft torsional rigidity in the first portion and at least 25% less than the shaft torsional rigidity in the second portion. In one embodiment the butt portion insert (4000) has a butt portion insert mass that is at least 10% of the shaft mass, while in another embodiment the butt portion insert mass is no more than 25% of the shaft mass.

In one embodiment the coupler (3000) is formed of a metallic coupler material having a coupler material density that is less than the tip portion material density, yet is at least 15% greater than the butt material density. In another embodiment the tip material density is at least 50% greater than the butt material density, while in a another embodiment the tip material density is at least twice the coupler material density, and in yet a further embodiment the tip material density is no more than six times the butt material density. In one particular embodiment the tip portion material density is at least 7 g/cc, the coupler material density is 2.5-5.0 g/cc, and the butt material density is no more than 2.4 g/cc. In a further embodiment the butt material density and/or the tip material is no more than 2.0 g/cc, and no more than 1.8 g/cc in another embodiment, and no more than 1.6 g/cc in yet a further embodiment. The elastic modulus of the tip portion material is preferably at least 110 GPa and the shear modulus is preferably at least 40 GPa, while in another embodiment the elastic modulus of the tip portion material is at least 190 GPa and the shear modulus is at least 70 GPa. The elastic modulus of the coupler material is preferably at least 60 GPa and the shear modulus is preferably at least 20 GPa, while in another embodiment the elastic modulus of the coupler material is at least 110 GPa and the shear modulus is at least 40 GPa. The elastic modulus of the butt material is preferably at least 40 GPa and the shear modulus is preferably at least 15 GPa, while in another embodiment the elastic modulus of the butt material is at least 50 GPa and the shear modulus is at least 22.5 GPa, which are also true for non-metallic tip portion embodiments. The materials of the butt portion (1000), the tip portion (2000), and/or the coupler (3000) may include a metal alloy (e.g., an alloy of titanium, an alloy of steel, an alloy of aluminum, and/or an alloy of magnesium), a composite material, such as a graphite composite, a ceramic material, fiber-reinforced composite, molding composites used to form compression molded bodies that may comprise a plurality of randomly oriented carbon fiber bundles and a thermoset or thermoplastic matrix material, plastic, or any combination thereof. In one embodiment the carbon fibers may compose 10-70% of the volume of the composite. In another embodiment the method of forming the composite component(s) comprises providing a plurality of bundles of carbon fibers, mixing the plurality of bundles with a matrix material so that the bundles are assorted randomly to form a composite molding compound, providing a male and female metal tooling mold, placing the composite molding compound in the female metal tooling mold, compressing the composite molding compound within the female metal tooling mold with the male metal tooling mold to create a composite piece, and allowing the composite piece to cure, wherein each bundle of carbon fibers is unidirectional, and wherein each bundle includes no more than 12,000 carbon fibers. In a further embodiment each bundle includes no more than 3,000 carbon fibers. The matrix material used may be a thermosetting material, and more preferably a vinyl ester or epoxy. Furthermore, the carbon fibers used in such an embodiment may each be between ¼ inch and 2 inches long.

Figure 8A:
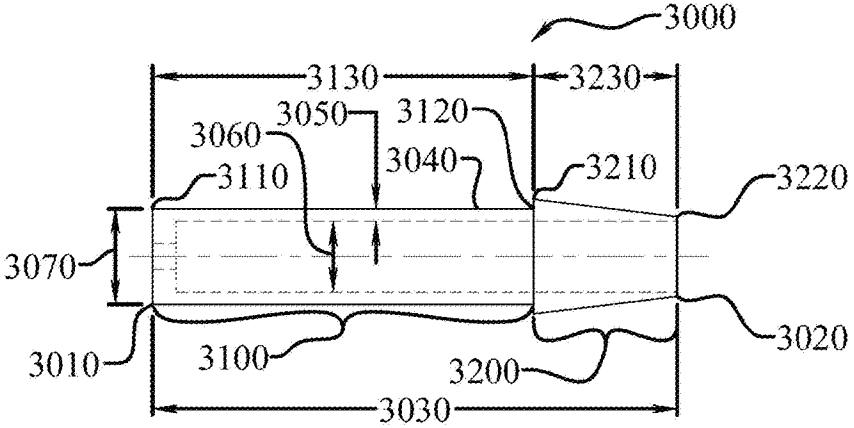
FIG. 8(A) shows a side elevation view of an embodiment of a coupler, not to scale.
Figure 8B:
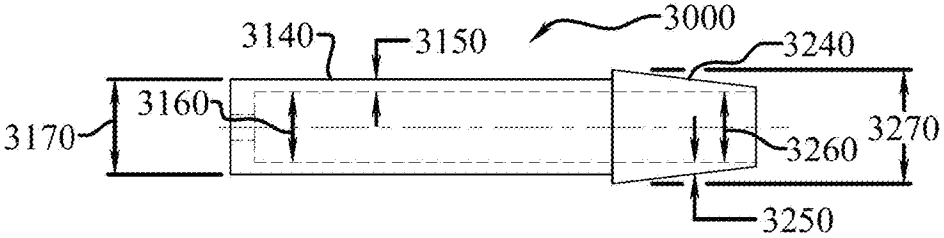
FIG. 8(B) shows a side elevation view of an embodiment of a coupler, not to scale.

As seen in FIG. 8(A) and 8(B), the coupler (3000) may include a coupler-butt insert portion (3100) and coupler-tip receiving portion (3200), and in some embodiments they are separated by a change in the coupler outer diameter (3070) that forms a ledge having a ledge height that is no greater than the butt portion sidewall thickness (1050). The coupler-butt insert portion (3100) has a coupler-butt insert distal end (3110), a coupler-butt insert proximal end (3120), a coupler-butt insert length (3130) between the coupler-butt insert distal end (3110) and the coupler-butt insert proximal end (3120), a coupler-butt insert sidewall (3140), a coupler-butt insert sidewall thickness (3150), a coupler-butt insert inner diameter (3160), and a coupler-butt insert outer diameter (3170). Similarly, the coupler-tip receiver portion (3200) has a coupler-tip receiver distal end (3210), a coupler-tip receiver proximal end (3220), a coupler-tip receiver length (3230) between the coupler-tip receiver distal end (3210) and the coupler-tip receiver proximal end (3220), a coupler-tip receiver sidewall (3240), a coupler-tip receiver sidewall thickness (3250), and a coupler-tip receiver inner diameter (3260). In one embodiment the coupler-butt insert outer diameter (3170) no more than the butt portion inner diameter (1060), while in a further embodiment the coupler-tip receiver inner diameter (3260) is at least as great as the tip portion outer diameter (2070). The coupler- tip receiver length (3230) is preferably greater than the tip portion outer diameter (2070), and the coupler-butt insert length (3130) is preferably greater than the butt portion inner diameter (1060). In another embodiment the coupler-butt insert length (3130) is at least 50% greater than the coupler-tip receiver length (3230), and at least 75% greater in another embodiment, and at least 100% greater in yet a further embodiment. Alternatively, one skilled in the art will appreciate that the coupler (3000) may be configured in a reverse configuration where a portion of the butt portion (1000) is received within a portion the coupler (3000), and a portion of the coupler (3000) is received within a portion of the tip portion (2000); or in another embodiment a portion of the coupler (3000) is received within a portion of the butt portion (1000) and the tip portion (2000); or in yet a further embodiment both a portion of the butt portion (1000) and the tip portion (2000) are received within a portion of the coupler (3000).

The coupler sidewall thickness (3050) is preferably no more than the butt portion sidewall thickness (1050), and in one embodiment the coupler sidewall thickness (3050) is at least 10% less than the butt portion sidewall thickness (1050). In another embodiment a portion of the coupler sidewall (3040) has a coupler sidewall thickness (3050) that varies, and in a further embodiment it is the coupler-tip receiver sidewall thickness (3250) that varies, and in yet another embodiment the coupler-tip receiver sidewall thickness (3250) varies between a minimum and a maximum, wherein the maximum is at least 50% greater than the minimum. In another embodiment the maximum coupler-tip receiver sidewall thickness (3250) is at least 50% greater than the coupler-butt insert sidewall thickness (3150).

In the illustrated embodiment the tip portion (2000) extends all the way through the coupler-tip receiver portion (3200) and into the coupler-butt insert portion (3100) so that a cross-section through a portion of the overall shaft (100) includes an outer layer of the butt portion (1000), an intermediate layer of the coupler (3000), and an inner layer of the tip portion (2000), thereby achieving the relationships described herein. In another embodiment the tip portion distal end (2010) extends into the coupler-butt insert portion (3100) a first distance that is at least 50% of the butt portion outer diameter (1070), and at least 75% in another embodiment, and at least 100% in yet a further embodiment. A further series of embodiments limit the first distance to being no more than 50% of the tip portion length (2030) and no more than ten times the butt portion outer diameter (1070), while in another embodiment the first distance is no more than 35% of the tip portion length (2030) and no more than six times the butt portion outer diameter (1070), and in yet a further embodiment the first distance is no more than 25% of the tip portion length (2030) and no more than four times the butt portion outer diameter (1070). The embodiment of FIG. 8(A) includes an opening in the coupler distal end (3010) that permits the passage of air, which in one embodiment has an open area that is at least 10% of the area associated with the coupler outer diameter (3070), and at least 20% in another embodiment, and at least 30% in still a further embodiment.

Any of the disclosed embodiments of the shaft (100) may further be attached to a golf club head (5000), and include a grip (6000) attached to the shaft distal end (110) to create a fit-for-play golf club. As one skilled in the art will appreciate, the golf club may be a putter, a driver, a fairway wood, a hybrid or rescue, an iron, and/or a wedge. In one particular embodiment the golf club is a putter having a loft of less than 10 degrees, while in a further embodiment it is one having a club head weight of at least 310 grams, and yet another embodiment has a shaft length (130) of no more than 36". In another embodiment the club head weight is at least 320 grams, and at least 330 grams in a further embodiment, and at least 340 grams in still another embodiment.

The shaft (100) may be a putter shaft, wedge shaft, iron shaft, rescue shaft, fairway wood shaft, and/or driver shaft. In one particular putter shaft embodiment the shaft length (130) is no more than 38" and the shaft mass is at least 100 grams, while in another embodiment the shaft length (130) is no more than 36" and the shaft mass is 100-150 grams, and in yet a further embodiment the shaft length (130) is no more than 35" and the shaft mass is 110-140 grams. In one embodiment the tip portion (2000) is straight, while in a further embodiment directed to some putters the tip portion (2000) includes a double bend, which will be understood to one skilled in the art. One skilled in the art will appreciate that the overall shaft (100) will have a shaft center of gravity, or CG, the position of which may be referenced as a shaft CG distance from the shaft proximal end (120). In a putter embodiment having a shaft length (130) less than 35.5", the benefits described herein have been found to be heightened when the shaft CG distance is no more than 18", and no more than 17" in another embodiment, and no more than 16" in yet a further embodiment. Further, the benefits described herein have been found to be heightened when the shaft CG distance at least 9", and at least 11" in another embodiment, and at least 13" in yet a further embodiment. One particular embodiment has a shaft CG distance of 13-15.5". In further embodiments these shaft CG distances are further obtained with a shaft length (130) of no more than 35", and no more than 34" in another embodiment, and no more than 33" in yet a further embodiment. In even more embodiments the shaft CG distance is no more than 45% of the shaft length (130), and no more than 40% in another embodiment, and no more than 35% in yet a further embodiment. However, in another series of embodiments the shaft CG distance is at least 20% of the shaft length (130), and at least 25% in another embodiment, and at least 30% in still a further embodiment.

A typical tapered steel putter shaft having a length of 35" has a shaft CG distance that is approximately 20" and a kickpoint distance of approximately 14". The kickpoint distance of a golf shaft is determined by fixing the butt of the shaft, or the shaft distal end (110), and applying an axial compressive load on the tip of the shaft, or the shaft proximal end (120), until the distance between the two ends has changed by 0.5". Then a maximum deflection point is identified as the location of the maximum deflection from an initial shaft axis. The kickpoint distance is the distance measured along the initial shaft axis from the shaft proximal end (120) to the maximum deflection point.

Surprising performance benefits have been identified as the shaft CG distance is reduced, the kickpoint distance is increased, a combination thereof, or the difference between the shaft CG distance the kickpoint distance is reduced. In one embodiment of the present invention the kickpoint distance is at least 75% of the shaft CG distance, at least 85% in another embodiment, at least 95% in still a further embodiment, and at least 105% in yet another embodiment. In another series of embodiments the kickpoint distance is no more than 145% of the shaft CG distance, no more than 135% in another embodiment, no more than 125% in still a further embodiment, and no more than 115% in yet another embodiment. In one particularly effective embodiment the kickpoint distance is 85-135% of the shaft CG distance, 95-125% in another embodiment, and 100-115% in still a further embodiment. In another embodiment of the present invention the shaft CG distance is no more than 50% of the shaft length (130), no more than 47.5% in another embodiment, no more than 45% in a further embodiment, and no more than 42.5% in still another embodiment. In another series of embodiments the shaft CG distance is at least 30% of the shaft length (130), at least 35% in another embodiment, at least 37.5% in a further embodiment, and at least 40% in yet another embodiment.

A difference between the shaft CG distance and the kickpoint distance is preferably no more than 12.5% of the shaft length (130), no more than 10% in another embodiment, no more than 7.5% in still a further embodiment, and not more than 5% in yet another embodiment. In one particularly effective embodiment the difference between the shaft CG distance and the kickpoint distance is preferably no more than 4.5", no more than 3.5" in another embodiment, no more than 2.5" in a further embodiment, and no more than 1.5" in still another embodiment. In one embodiment the shaft CG distance is no more than 18.0", no more than 16.0" in another embodiment, no more than 15.5" in a further embodiment, and no more than 15.0" in yet another embodiment; all of which have a shaft length of 35.0".

In an embodiment the butt portion outer diameter (1070) is 0.500-0.700", while in another embodiment the butt portion outer diameter (1070) is 0.550-0.650", and in yet a further embodiment the butt portion outer diameter (1070) is 0.580-0.620". In another embodiment the tip portion outer diameter (2070) is 0.300-0.450", while in another embodiment the tip portion outer diameter (2070) is 0.330-0.420", and in yet a further embodiment the tip portion outer diameter (2070) is 0.350-0.390".

Any of the embodiments disclosed herein as having "a portion of" a first component with a first rigidity relative to "a portion of" a second component with a different second rigidity, include a further embodiment in which the relationship is true over at least 25% of the length of the first component and/or at least 25% of the length of the second component, or in another embodiment the relationship is true over at least 50% of the length of the first component and/or at least 50% of the length of the second component, and in yet a further embodiment the relationship is true over at least 75% of the length of the first component and/or at least 75% of the length of the second component.

Figure 9:
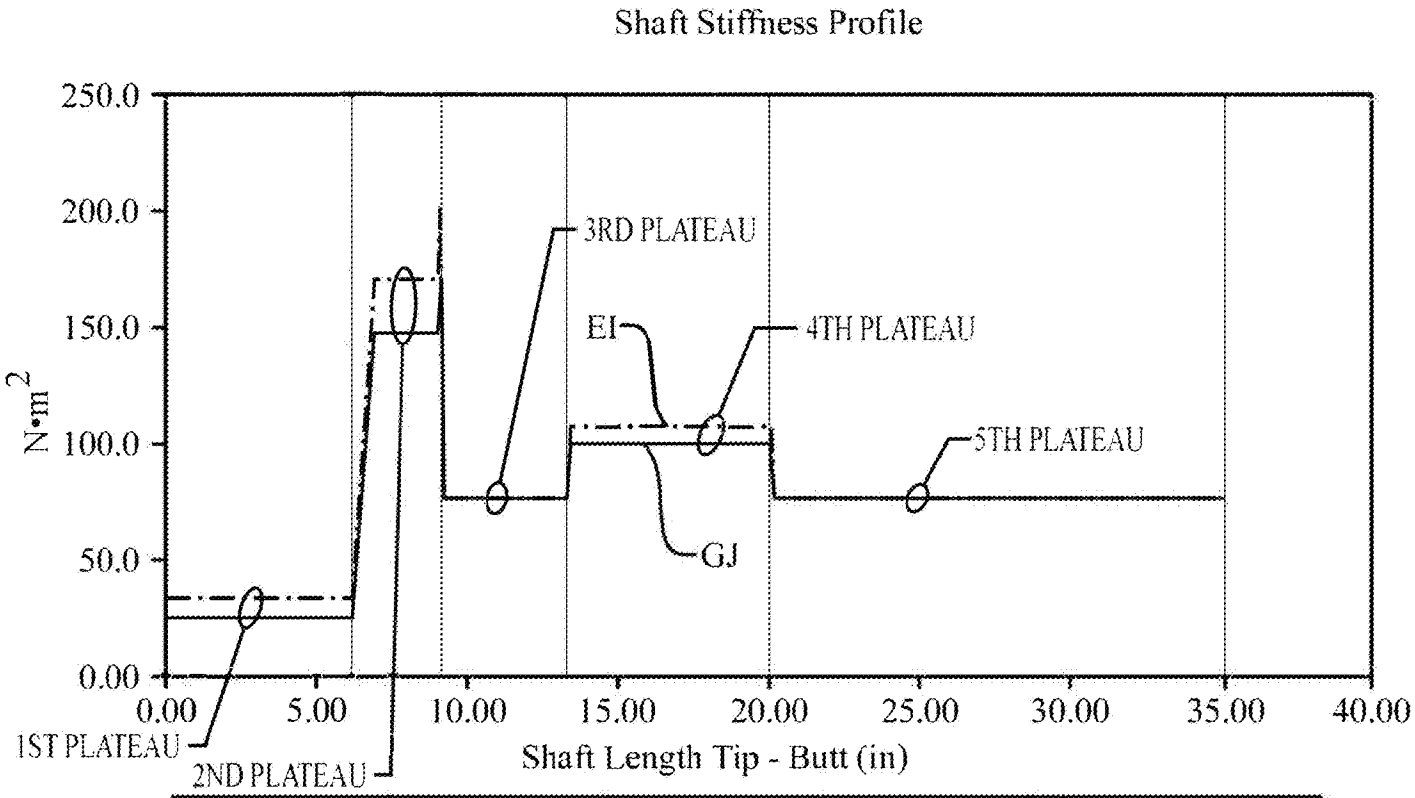
FIG. 9 shows a graph of the shaft stiffness profile of an embodiment of the golf shaft, not to scale.

Now returning to the shaft flexural rigidity, abbreviated EI, and the shaft torsional rigidity, abbreviated GJ, in the diagrams of FIGS. 9-12. As previously noted, the shaft flexural rigidity and the shaft torsional rigidity are that of cross-sections, perpendicular to the shaft axis, at points along the shaft length (100) and take into account areas of the shaft (100) composed of multiple elements within a particular cross-section, while in other areas the shaft (100) where there is no overlap of individual components the shaft rigidities are equal to the rigidities of the only component present in the cross-section at that particular location. With reference now specifically to FIG. 9, beginning at the left boundary of the diagram the shaft flexural rigidity, EI, and the shaft torsional rigidity, GJ, are constant, i.e. horizontal, along a first flexural rigidity plateau and a first torsional rigidity plateau through the portion of the shaft (100) that consists solely of the tip portion (2000), which has a constant cross-sectional profile in this embodiment. Then the shaft flexural rigidity increases along a first flexural rigidity ramp to a second flexural rigidity plateau, and the shaft torsional rigidity increases along a first torsional rigidity ramp to a second torsional rigidity plateau. In this embodiment the ramps begin where the tip portion (2000) enters the coupler-tip receiver portion (3200) of the coupler (3000), seen in FIG. 8(A), accounting for the overlap and the increasing coupler-tip receiver sidewall thickness (3250). In this embodiment the second flexural rigidity plateau and the second torsional rigidity plateau represent areas of constant rigidity because they are areas along the shaft length (130) including the butt portion (1000) overlapping the coupler-butt insert portion (3100) of the coupler (3000), which have constant cross-sectional profiles in this embodiment. In this embodiment the rigidities then drop to a third flexural rigidity plateau and a third torsional rigidity plateau in the area of the shaft (100) composed of only the butt portion (1000) within the separation distance (4080), seen in FIG. 4, which in this embodiment has a constant cross-sectional profile. In this embodiment the rigidities then increase to a fourth flexural rigidity plateau and a fourth torsional rigidity plateau in the area of the shaft (100) composed the butt portion (1000) and the butt portion insert (4000), seen in FIG. 4, both of which have constant cross-sectional profiles in this embodiment. In this embodiment the rigidities then decrease to a fifth flexural rigidity plateau and a fifth torsional rigidity plateau in the area of the shaft (100) composed solely of the butt portion (1000), which has a constant cross-sectional profile in this embodiment. In one embodiment the plateaus disclosed herein are not constant but have a slope, positive or negative, that is no more than 10 degrees, which is significantly less than the variations found in a conventional tapered or stepped shaft, such as the one illustrated in FIG. 12, while in another embodiment the slope is no more than 7.5 degrees, positive or negative, and is no more than 5.0 degrees, positive or negative, in still another embodiment, and is no more than 2.5 degrees, positive or negative, in yet a further embodiment.

As illustrated in the table of FIG. 9, an average second plateau flexural rigidity throughout the second plateau is at least twice an average first plateau flexural rigidity throughout the first plateau; and in a further embodiment the average second plateau flexural rigidity throughout the second plateau is at least 50% greater than an average third plateau flexural rigidity throughout the third plateau; and in a further embodiment the average second plateau flexural rigidity throughout the second plateau is at least 25% greater than an average fourth plateau flexural rigidity throughout the fourth plateau; and in yet still another embodiment the average second plateau flexural rigidity throughout the second plateau is at least 50% greater than an average fifth plateau flexural rigidity throughout the third plateau. Similarly, an average second plateau torsional rigidity throughout the second plateau is at least twice an average first plateau torsional rigidity throughout the first plateau; and in a further embodiment the average second plateau torsional rigidity throughout the second plateau is at least 50% greater than an average third plateau torsional rigidity throughout the third plateau; and in a further embodiment the average second plateau torsional rigidity throughout the second plateau is at least 25% greater than an average fourth plateau torsional rigidity throughout the fourth plateau; and in yet still another embodiment the average second plateau torsional rigidity throughout the second plateau is at least 50% greater than an average fifth plateau torsional rigidity throughout the third plateau.

In another embodiment an average fourth plateau flexural rigidity throughout the fourth plateau is at least 10% greater than at least one average plateau flexural rigidity of an adjacent plateau, while in one embodiment the adjacent plateau is located toward the shaft distal end (120), and in another embodiment the adjacent plateau is located toward the shaft proximal end (110). Similarly, in another embodiment an average fourth plateau torsional rigidity throughout the fourth plateau is at least 10% greater than at least one average plateau torsional rigidity of an adjacent plateau, while in one embodiment the adjacent plateau is located toward the shaft distal end (120), and in another embodiment the adjacent plateau is located toward the shaft proximal end (110).

In another embodiment an average third plateau flexural rigidity throughout the third plateau is at least 10% less than at least one average plateau flexural rigidity of an adjacent plateau, while in one embodiment the adjacent plateau is located toward the shaft distal end (120), and in another embodiment the adjacent plateau is located toward the shaft proximal end (110). Similarly, in another embodiment an average third plateau torsional rigidity throughout the third plateau is at least 10% less than at least one average plateau torsional rigidity of an adjacent plateau, while in one embodiment the adjacent plateau is located toward the shaft distal end (120), and in another embodiment the adjacent plateau is located toward the shaft proximal end (110).

In another embodiment an average second plateau flexural rigidity throughout the second plateau is at least 50% greater than at least one average plateau flexural rigidity of an adjacent plateau, while in one embodiment the adjacent plateau is located toward the shaft distal end (120), and in another embodiment the adjacent plateau is located toward the shaft proximal end (110). Similarly, in another embodiment an average second plateau torsional rigidity throughout the second plateau is at least 50% greater than at least one average plateau torsional rigidity of an adjacent plateau, while in one embodiment the adjacent plateau is located toward the shaft distal end (120), and in another embodiment the adjacent plateau is located toward the shaft proximal end (110).

In one embodiment the third plateau has a shaft flexural rigidity that is (a) at least 50% greater than the tip portion flexural rigidity, i.e. that of the first plateau, and (b) less than 100 $N*m^2$. Similarly, the third plateau has a shaft torsional rigidity that is (a) at least 50% greater than the tip portion torsional rigidity, i.e. that of the first plateau, and (b) less than 100 $N*m^2$. In another embodiment the second plateau has a shaft flexural rigidity is (a) at least 50% greater than the butt portion flexural rigidity, i.e. that of the third or fifth plateau, and (b) is greater than 120 $N*m^2$. Similarly, the second plateau has a shaft torsional rigidity that is (a) at least 50% greater than the butt portion torsional rigidity, i.e. that of the third or fifth plateau, and (b) is greater than 120 $N*m^2$.

In another embodiment a portion of the fourth plateau is within the reinforcement region (2500) and has a shaft flexural rigidity that is (a) greater than the shaft flexural rigidity of the third plateau, and (b) less than the shaft flexural rigidity of the second plateau. Likewise, in a further embodiment a portion of the fourth plateau is within the reinforcement region (2500) and has a shaft torsional rigidity that is (a) greater than the shaft torsional rigidity of the third plateau, and (b) less than the shaft torsional rigidity of the second plateau.

In another embodiment the shaft flexural rigidity profile and the shaft torsional rigidity profile each contain at least four distinct plateaus with each plateau having a length of at least 2", and at least one of the plateaus having a length of at least 6". In a further embodiment the shaft flexural rigidity profile and the shaft torsional rigidity profile each contain at least five distinct plateaus with each plateau having a length of at least 2", and at least two of the plateaus having a length of at least 6", and at least one of the plateaus having a length of at least 10".

Figure 12:
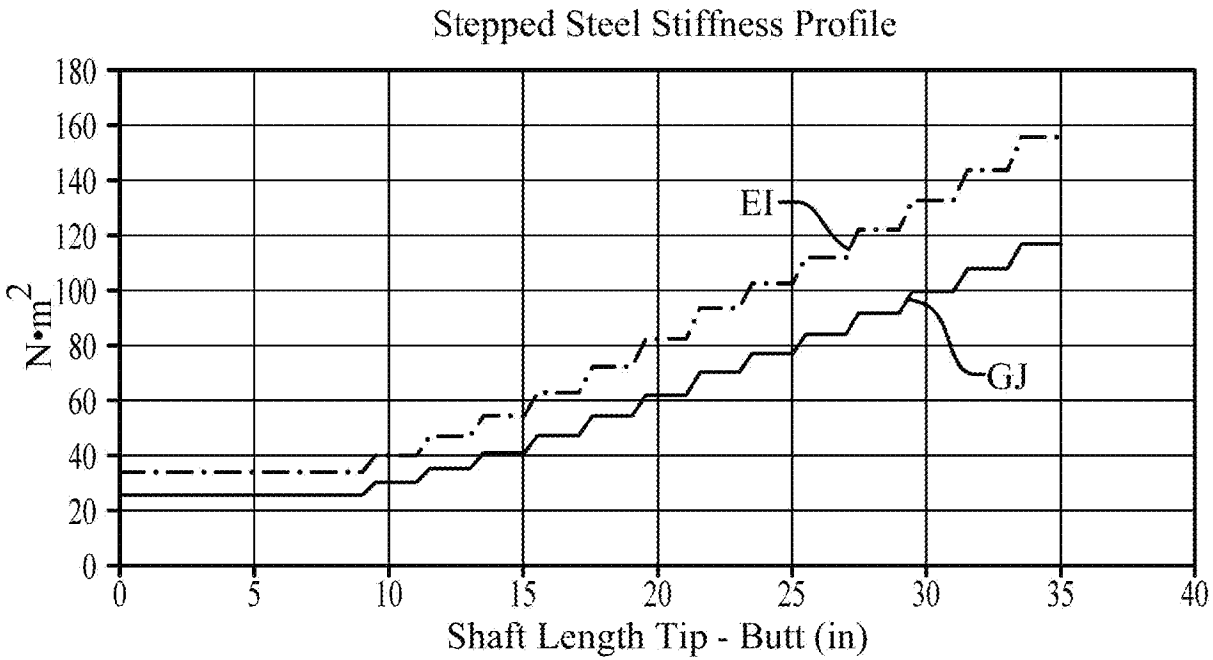
FIG. 12 shows a graph of the shaft stiffness profile of a conventional stepped steel golf shaft, not to scale.

In diagram (A) of FIG. 10 the shaft (100) is divided into a tip region and a butt region separated at the midpoint of the shaft length (130). Thus, the region from the midpoint to the shaft proximal end (120) is the tip region and the region from the midpoint to the shaft distal end (110) is the butt region. In one embodiment an average tip region flexural rigidity is within 25% of an average butt region flexural rigidity, while a conventional tapered or stepped shaft has an average tip region flexural rigidity that is less than 40% of an average butt region flexural rigidity, as seen in FIG. 12. In another embodiment the average tip region flexural rigidity is within 15% of an average butt region flexural rigidity, and within 10% in a further embodiment, and within 5% in yet another embodiment. In one particular embodiment the average tip region flexural rigidity is at least as great as the average butt region flexural rigidity. Similarly, in one embodiment an average tip region torsional rigidity is within 25% of an average butt region torsional rigidity, while a conventional tapered or stepped shaft has an average tip region torsional rigidity that is less than 40% of an average butt region torsional rigidity, as seen in FIG. 12. In another embodiment the average tip region torsional rigidity is within 15% of an average butt region torsional rigidity, and within 10% in a further embodiment, and within 5% in yet another embodiment.

In diagram (B) of FIG. 10 the shaft (100) is divided into a tip non-reinforced region, a reinforced region, and a butt non-reinforced region. All of the prior disclosure and embodiments of reinforced region (2500) are applicable to the reinforced region of FIG. 10. In a further embodiment the reinforced region (2500) has an average reinforced region flexural rigidity and an average reinforced region torsional rigidity, the tip non-reinforced region has an average tip non-reinforced region flexural rigidity and an average tip non-reinforced region torsional rigidity, and the butt non-reinforced region has an average butt non-reinforced region flexural rigidity and an average butt non-reinforced region torsional rigidity. An average of the average tip non-reinforced region flexural rigidity and the average butt non-reinforced region flexural rigidity is an average non-reinforced region flexural rigidity, and likewise an average of the average tip non-reinforced region torsional rigidity and the average butt non-reinforced region torsional rigidity is an average non-reinforced region torsional rigidity. In one embodiment the average reinforced region flexural rigidity is at least 50% greater than the average non-reinforced region flexural rigidity, and at least 60% greater in another embodiment, and at least 70% greater in a further embodiment. Similarly, in a further embodiment the average reinforced region torsional rigidity is at least 40% greater than the average non-reinforced region torsional rigidity, and at least 50% greater in another embodiment, and at least 60% greater in a further embodiment. In still another embodiment the average reinforced region flexural rigidity is 50-150% greater than the average non-reinforced region flexural rigidity, and 60-125% greater in another embodiment, and 65-100% greater in a further embodiment. Likewise, in a further embodiment the average reinforced region torsional rigidity is 40-120% greater than the average non-reinforced region torsional rigidity, and 50-110% greater in another embodiment, and 55-100% greater in a further embodiment.

In diagram (D) of FIG. 11 the shaft (100) is divided into a tip two-third region and a butt one-third based upon the shaft length (130). A first portion of the shaft (100) extending ⅔ of the shaft length (130) from the shaft proximal end (120), namely the tip two-third region, has a first average flexural rigidity, a second portion of the shaft (100) extending ⅓ of the shaft length (130) from the shaft distal end (110), namely the butt one-third region, has a second average flexural rigidity, and the first average flexural rigidity is at least 50% of the second average flexural rigidity. These relationships are significantly different that that found in a conventional tapered or stepped shaft where the tip two-third region has an average flexural rigidity that is less than 42% of the average flexural rigidity of the butt one-third region, as seen in FIG. 12. Similarly, the tip two-third region has a first average torsional rigidity, the butt one-third region has a second average torsional rigidity, and the first average torsional rigidity is at least 50% of the second average torsional rigidity. These relationships are significantly different that that found in a conventional tapered or stepped shaft where the tip two-third region has an average torsional rigidity that is less than 42% of the average torsional rigidity of the butt one-third region, as seen in FIG. 12. In another embodiment the first average flexural rigidity is at least 75% of the second average flexural rigidity. In a further related embodiment the first average flexural rigidity is at least 100% of the second average flexural rigidity, while in still another related embodiment the first average flexural rigidity is 75-200% of the second average flexural rigidity, and in yet another related embodiment the first average flexural rigidity is 100-150% of the second average flexural rigidity. In another embodiment the first average torsional rigidity is at least 75% of the second average torsional rigidity. In a further related embodiment the first average torsional rigidity is at least 100% of the second average torsional rigidity, while in still another related embodiment the first average torsional rigidity is 75-200% of the second average torsional rigidity, and in yet another related embodiment the first average torsional rigidity is 100-150% of the second average torsional rigidity.

In diagram (C) of FIG. 11 the shaft (100) is divided into a tip one-third region and a butt two-third based upon the shaft length (130). A first portion of the shaft (100) extending ⅓ of the shaft length (130) from the shaft proximal end (120), namely the tip one-third region, has a tip ⅓ average flexural rigidity, a second portion of the shaft (100) extending ⅔ of the shaft length (130) from the shaft distal end (110), namely the butt two-third region, has a butt ⅔ average flexural rigidity, and the tip ⅓ average flexural rigidity is at least 50% of the butt ⅔ average flexural rigidity. These relationships are significantly different that that found in a conventional tapered or stepped shaft where the tip one-third region has an average flexural rigidity that is less than 36% of the average flexural rigidity of the butt two-third region, as seen in FIG. 12. Similarly, the tip one-third region has a tip ⅓ average torsional rigidity, the butt two-third region has a butt ⅔ average torsional rigidity, and the tip ⅓ average torsional rigidity is at least 50% of the butt ⅔ average torsional rigidity. These relationships are significantly different that that found in a conventional tapered or stepped shaft where the tip one-third region has an average torsional rigidity that is less than 36% of the average torsional rigidity of the butt two-third region, as seen in FIG. 12. In another embodiment the tip ⅓ average flexural rigidity is at least 60% of the butt ⅔ average flexural rigidity. In a further related embodiment the tip ⅓ average flexural rigidity is at least 70% of the butt ⅔ average flexural rigidity, while in still another related embodiment the tip ⅓ average flexural rigidity is 60-120% of the butt ⅔ average flexural rigidity, and in yet another related embodiment the tip ⅓ average flexural rigidity is 70-110% of the butt ⅔ average flexural rigidity. In another embodiment the tip ⅓ average torsional rigidity is at least 60% of the butt ⅔ average torsional rigidity. In a further related embodiment the tip ⅓ average torsional rigidity is at least 70% of the butt ⅔ average torsional rigidity, while in still another related embodiment the tip ⅓ average torsional rigidity is 60-120% of the butt ⅔ average torsional rigidity, and in yet another related embodiment the tip ⅓ average torsional rigidity is 70-110% of the butt ⅔ average torsional rigidity.

Figure 15:
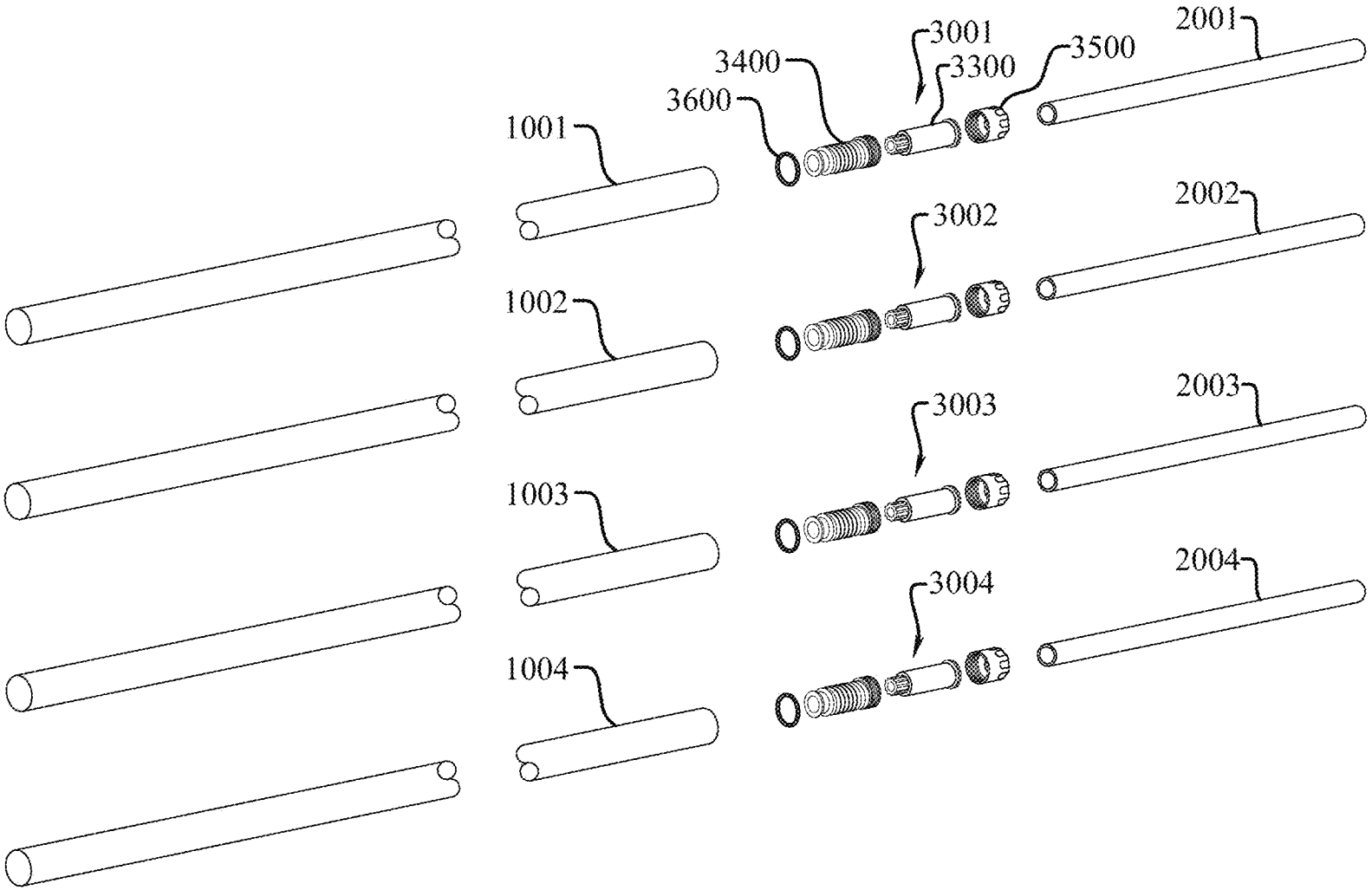
FIG. 15 shows an exploded perspective view of an embodiment of a golf shaft system, not to scale.
Figure 16:
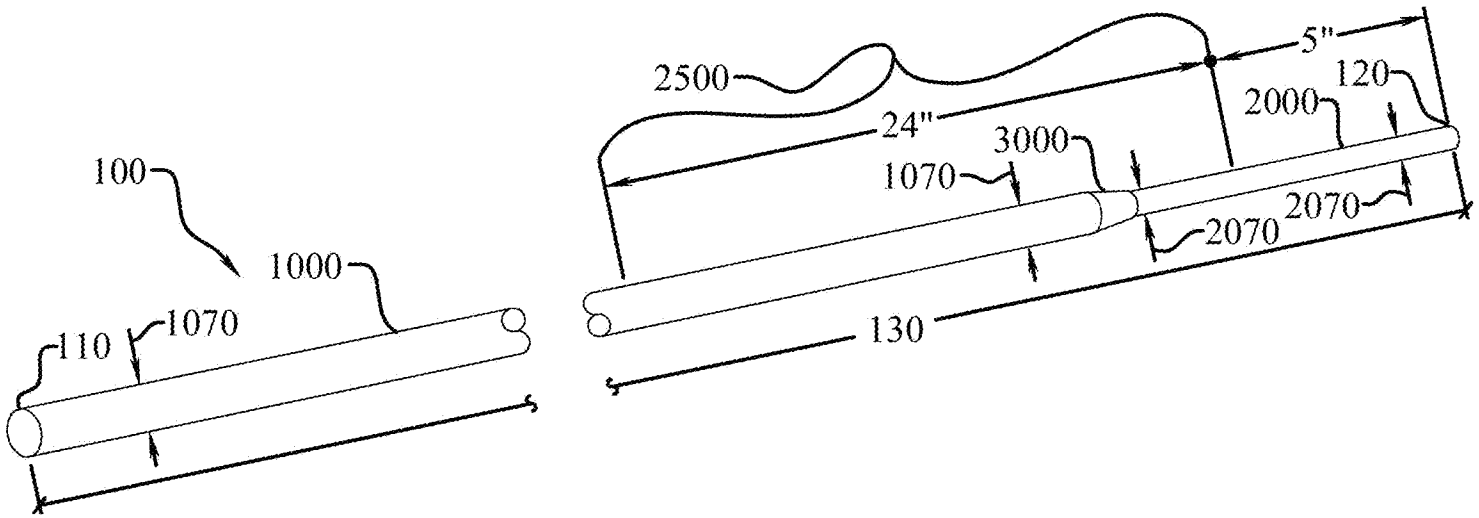
FIG. 16 shows a perspective view of an embodiment of a golf shaft, not to scale.

As seen in FIG. 15, the coupler (3000) may be configured to releasably join the butt portion (1000) and the tip portion (2000). The releasability of the coupler (3000) allows (a) a single tip portion (2001) to be joined to a number of butt portions (1001, 1002, 1003, 1004) having different properties to identify the best combination for a particular golfer; (b) a single butt portion (1001) may be joined to a number tip portions (2001, 2002, 2003, 2004) having different properties to identify the best combination for a particular golfer; and/or (c) any other such combination. Generally, for the ease of explanation, the disclosure will focus on kit, or system, including a single butt portion (1001) being paired with at least 2 different tip portions (2001, 2002), however one skilled in the art will appreciate the kit may include any number of butt portions (1001, 1002, 1003, 1004) and tip portions (2001, 2002, 2003, 2004), joined via a common universal coupler (3001), however it may also include a number of couplers (3001, 3002, 3003, 3004) to provide even further options and stiffness characteristics as described herein. Further, the unique stiffness characteristics and relationships disclosed herein are not limited to kits, or releasably couplers, but may be incorporated into a unitary shaft or one made of multiple portions, whether joined directly together or through the incorporation of a coupler, whether it be a permanent coupler configuration or a releasable coupler configuration. As such, the shaft (100), regardless of the number of components creating the shaft (100), has a shaft distal end (110), a shaft proximal end (120), a shaft outer diameter, a shaft length (130), and a shaft mass, as previously disclosed in detail but also illustrated in FIG. 16. Each point along the shaft length (130) has a shaft flexural rigidity and a shaft torsional rigidity. The terms portion and section are used interchangeably throughout this disclosure when referring to the butt portion, or section, (1000) and the tip portion, or section, (2000).

In some embodiments the shaft (100) has a butt portion (1000, 1001, 1002, 1003, 1004) releasably joined by a coupler (3000, 3001, 3002, 3003) to a tip portion (2000) selected from one of at least a first tip portion (2001) and a second tip portion (2002), but may further include a third tip portion (2003) or even a fourth tip portion (2004). As previously described in detail, the butt portion (1000) has a butt portion distal end (1010), a butt portion proximal end (1020), a butt portion length (1030), a butt portion sidewall (1040) having a butt portion sidewall thickness (1050), a butt portion inner diameter (1060), and a butt portion outer diameter (1070). Similarly, each tip portion has the following attributes, which, in the interest of brevity, will not be repeated for each potion, but would be understood by one skilled in the art, namely a tip portion distal end (2010), a tip portion proximal end (2020), a tip portion length (2030), a tip portion sidewall (2040) having a tip portion sidewall thickness (2050), a tip portion inner diameter (2060) if the tip portion (2000) is hollow (although in some embodiments the tip portion (2000) may be partially, or entirely, solid), a tip portion outer diameter (2060), and a tip portion mass.

When multiple tip portions (2000), and/or multiple butt portions (1000), are provided as part of a kit, the attributes just described need not be identical for each tip or butt portion, in fact it may be desirable to have one or more of the attributes vary, although as described later, certain relationships are particularly beneficial in providing a wide variety of options for the user to arrive at the best stiffness profile, mass, mass distribution, kickpoint location, and balance for a particular swing.

While many of the previously disclosed embodiments focused on a metallic tip portion (2000) and a non-metallic butt portion (1000), one skilled in the art will appreciated that the prior disclosure and material properties of the non-metallic butt portion (1000) embodiments may apply equally to non-metallic tip portion (2000) embodiments, and the prior disclosure and material properties of the metallic tip portion (2000) embodiments may apply equally to metallic butt portion (1000) embodiments. In fact, non-metallic tip portions (2000) are preferred in some swinging club embodiments (shafts for clubs other than putters). However, some kit embodiments may also include one or more metallic tip portions (2000), and/or one or more metallic butt portions (1000).

In one embodiment the butt portion (1000) is formed of a non-metallic butt portion material having a butt material density, a butt portion mass that is 35-75% of the shaft mass, a butt portion elastic modulus, a butt portion shear modulus, and each point along the butt portion length (1030) having (i) a butt portion area moment of inertia, (ii) a butt portion polar moment of inertia, (iii) a butt portion flexural rigidity, and (iv) a butt portion torsional rigidity. A simplistic kit embodiment includes at least a first tip portion (2001) and a second tip portion (2002), which may be joined to one, or more, butt portion(s) (1000) via a coupler (3000). In one embodiment the first tip portion (2001) is formed of a non-metallic tip portion material having a first tip material density that is within 15% of the butt material density, a first tip portion elastic modulus, and a first tip portion shear modulus, and each point along the first tip portion length having (i) a first tip portion area moment of inertia, (ii) a first tip portion polar moment of inertia, (iii) a first tip portion flexural rigidity, and (iv) a first tip portion torsional rigidity. Similarly, the second tip portion (2002) is formed of a non-metallic tip portion material having a second tip material density that is within 15% of the butt material density, a second tip portion elastic modulus, and a second tip portion shear modulus, and each point along the second tip portion length having (i) a second tip portion area moment of inertia, (ii) a second tip portion polar moment of inertia, (iii) a second tip portion flexural rigidity, and (iv) a second tip portion torsional rigidity. One skilled in the art will appreciate that these basic attributes are also true for embodiments also having include a third tip portion (2003) or even a fourth tip portion (2004). While these embodiments disclose non-metallic tip portions with densities similar to the butt portion, as disclosed later, further embodiments incorporate a tip portion (2000) having a density that is significantly greater than the butt material density, and some embodiments include metallic tip portions.

Figure 18:
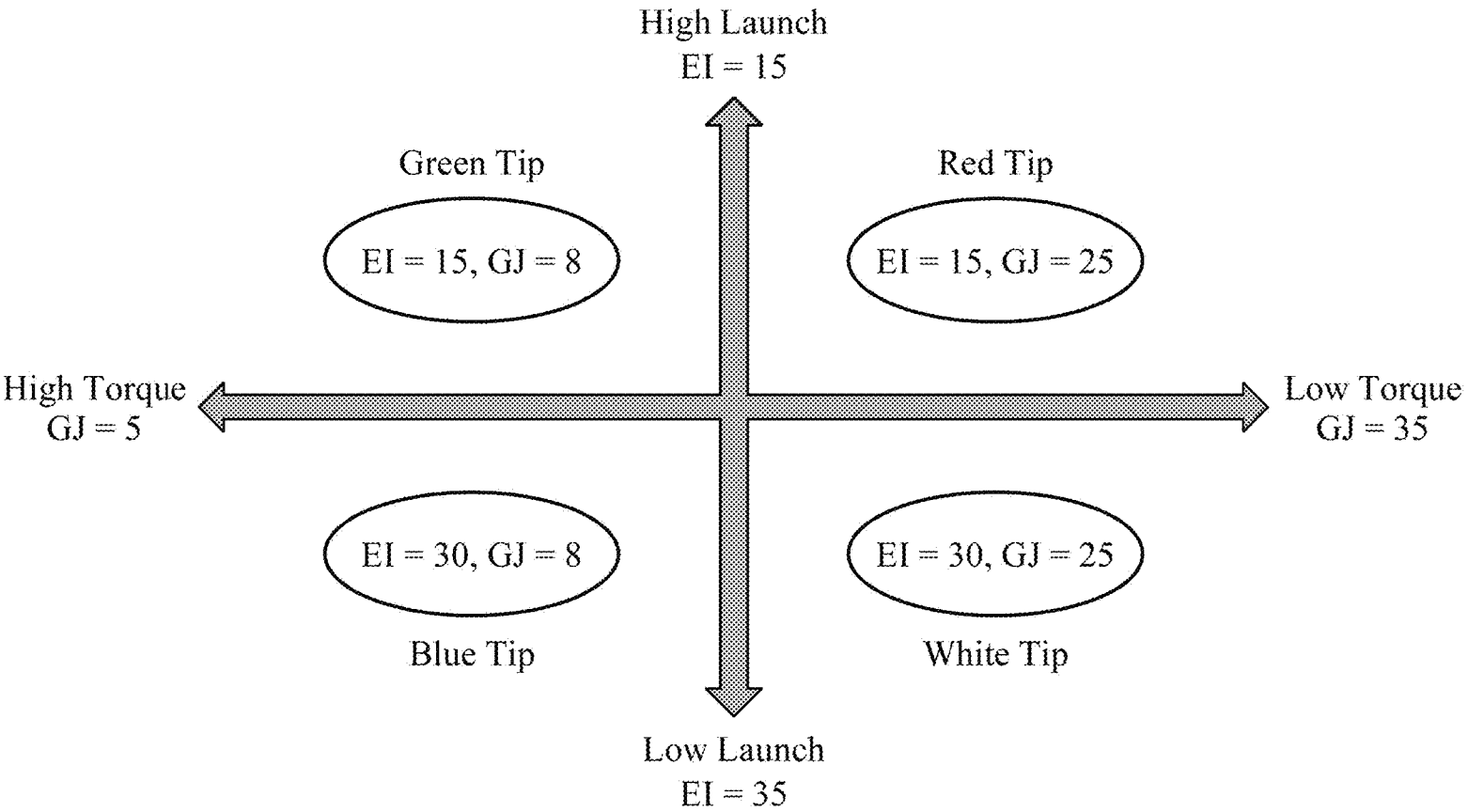
FIG. 18 shows a diagram illustrating properties different tip portions in one embodiment, not to scale.
Figure 19A:
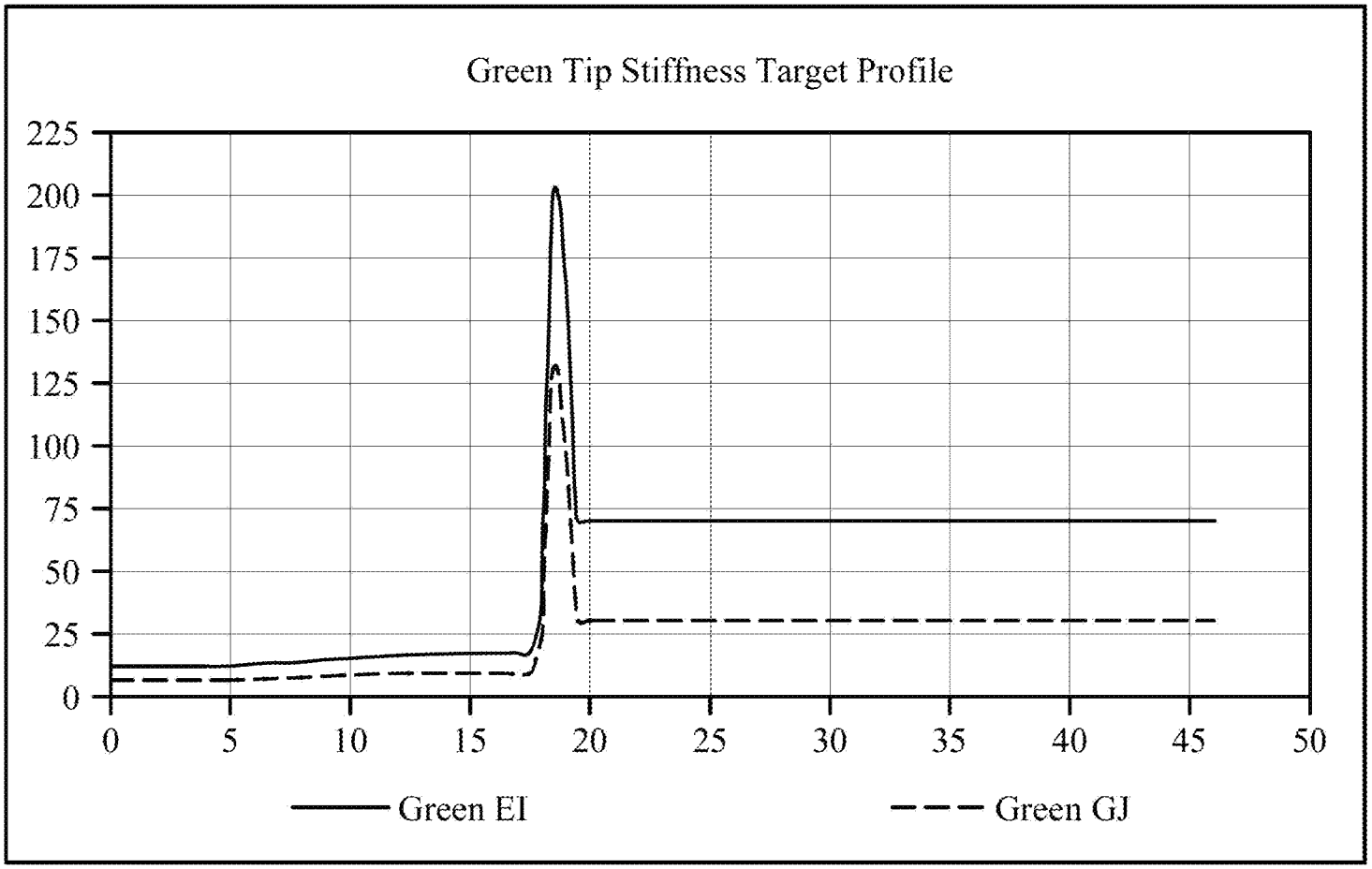
FIG. 19(A) shows a graph of the shaft stiffness profile of an embodiment of a tip portion with the vertical axis having units of $N*m^2$ and the horizontal axis having units of inches, not to scale.
Figure 19B:
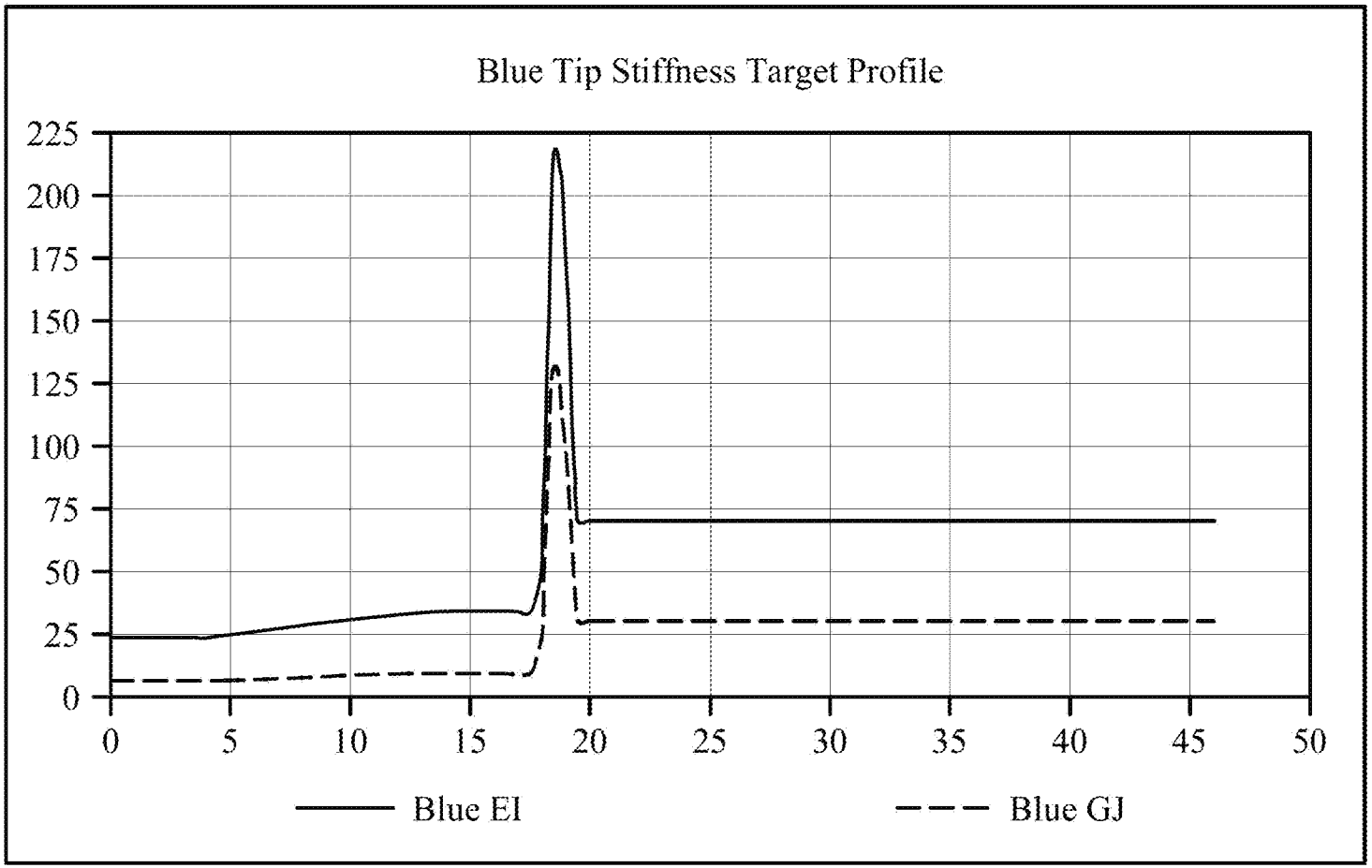
FIG. 19(B) shows a graph of the shaft stiffness profile of an embodiment of a tip portion with the vertical axis having units of $N*m^2$ and the horizontal axis having units of inches, not to scale.
Figure 19C:
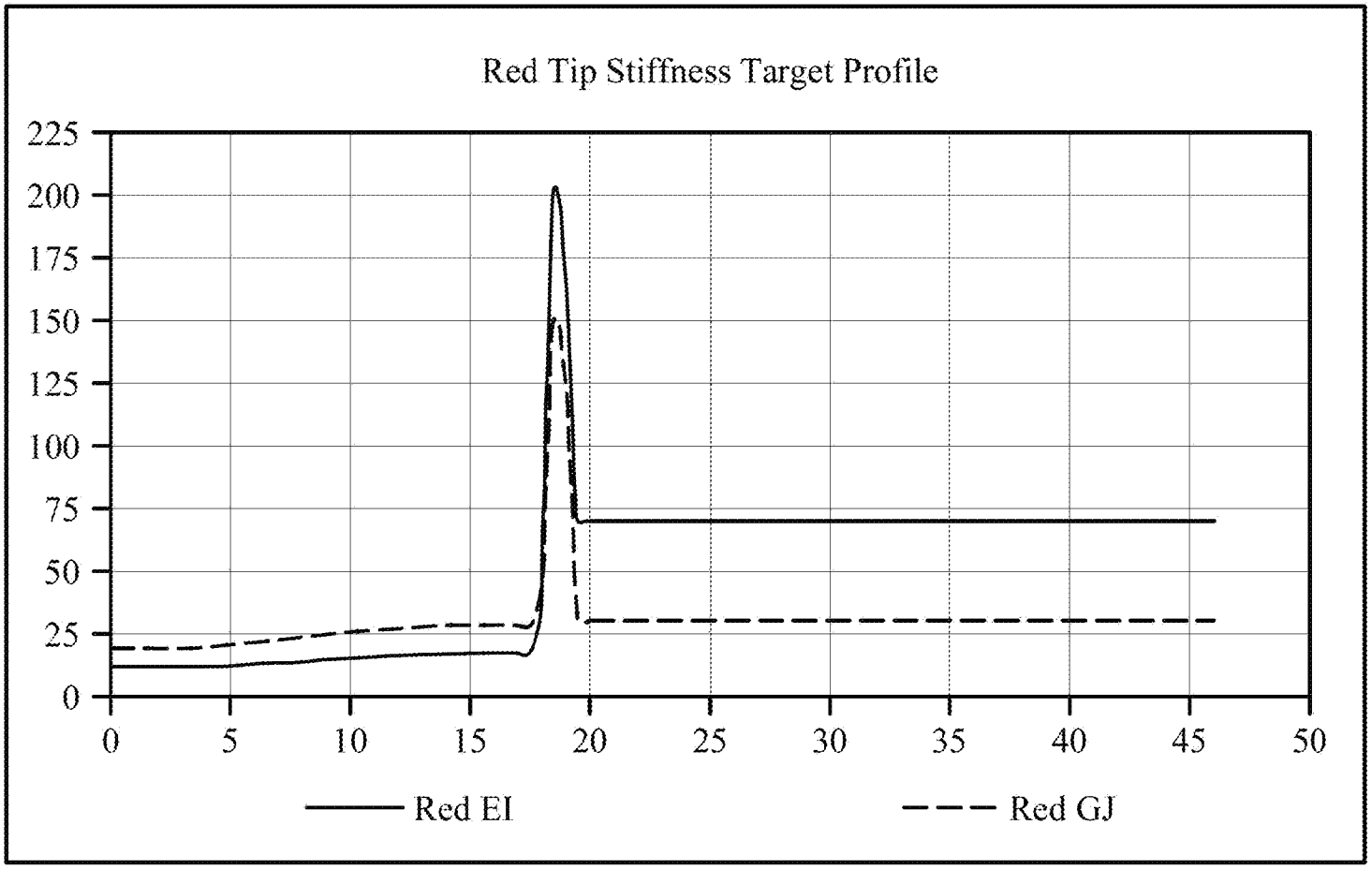
FIG. 19(C) shows a graph of the shaft stiffness profile of an embodiment of a tip portion with the vertical axis having units of $N*m^2$ and the horizontal axis having units of inches, not to scale.
Figure 19D:
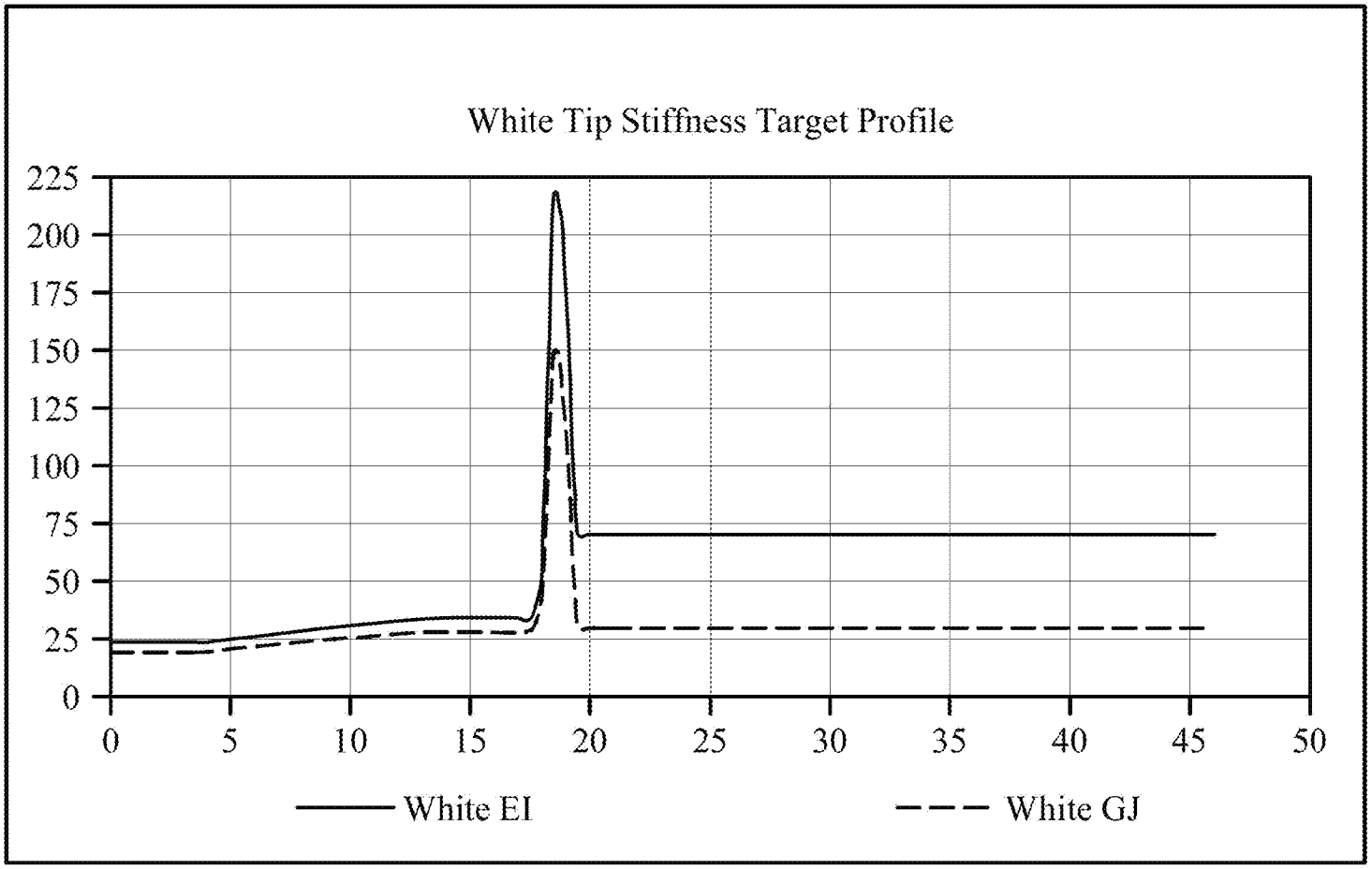
FIG. 19(D) shows a graph of the shaft stiffness profile of an embodiment of a tip portion with the vertical axis having units of $N*m^2$ and the horizontal axis having units of inches, not to scale.

One embodiment includes at least two tip portions meeting one or more of the following criteria: (a) a maximum second tip portion flexural rigidity is at least 25% greater than a maximum first tip portion flexural rigidity, and (b) a maximum second tip portion torsional rigidity is at least 35% greater than a maximum first tip portion torsional rigidity. For instance, in FIG. 18 the blue tip portion and the white tip portion both have flexural rigidities that are at least 25% greater than the flexural rigidity of the green tip portion and the red tip portion. Similarly, the red tip portion and the white tip portion both have torsional rigidities that are at least 50% greater than the torsional rigidity of the green tip portion and the blue tip portion. Both criteria (a) and (b) are met by at least two tip portions in another embodiment. A slow swing speed player will most likely experience improved performance when utilizing tip portions having the characteristics exhibited by green or red tips in FIG. 18, namely those having relatively low flexural rigidity. Tip portions having torsional rigidity higher than flexural rigidity, such as the red tip of FIG. 18, are found to be beneficial to the player that has average, or above average, swing speed, but has trouble launching the ball high due to swing mechanics, such as not impacting the ball on the upswing, and often experiences strong left tendencies in ball flight due in part to lack of torsional rigidity in the tip portion. Conversely, the golfer that has trouble turning the club over and therefore tends to be on the right side of the golf course would benefit from tip portions having low torsional rigidity. Further, golfers having swings resulting in impacts on the upward portion of the swing benefit the most from tip sections having characteristics similar to those found in the blue and white tip portions, namely those having relatively high flexural rigidity tip portions. While FIG. 18 illustrates an embodiment having torsional rigidity higher than flexural rigidity based upon a low flexural rigidity embodiment, namely the red tip of FIG. 18, a further embodiment may be implemented in a medium or high flexural rigidity embodiment such as a tip portion with EI=22.5 and GJ=25, or even an embodiment with EI=30 and GJ=35.

The specific flexural and torsional rigidity values illustrated in FIGS. 18 & 20 are associated with exemplary embodiments and are helpful in discussing the relationships between multiple tip portions and the overall rigidity profile of the associated shaft. The rigidities shown in FIGS. 18 & 20 are expressed in units of $N*m^2$. In one embodiment a kit includes at least two of the tip portions of FIG. 18 or 20 and the rigidities are plus or minus 50% of the values indicated, while in a further embodiment the rigidities are plus or minus 35% of the values indicated, and in yet another embodiment the rigidities are plus or minus 20% of the values indicated. Further embodiments have a kit with at least three of the tip portions of FIG. 18 or 20 and identical plus or minus variation embodiments, and even further a kit with at least four of the tip portions of FIG. 18 or 20 and identical plus or minus variation embodiments. In one embodiment the flexural and torsional rigidities illustrated in FIG. 18 are the maximum rigidities associated with the particular tip portion, while in an alternative embodiment they are the average rigidities associated with the particular tip portion, and in still another alternative embodiment they are the minimum rigidities associated with the particular tip portion.

The leftmost EI and GJ columns of FIG. 20 show the average flexural and torsional rigidity of the overall shaft composed of the same butt portion (1000) attached to four different tip portions (2000). The next two EI and GJ columns are labeled as 0-33% and indicate the average flexural and torsional rigidities associated with the ⅓ of the shaft length beginning at the shaft proximal end (120); while the next two EI and GJ columns are labeled as 33-66% and indicate the average flexural and torsional rigidities associated with the middle ⅓ of the shaft length; and the next two EI and GJ columns are labeled as 66-100% and indicate the average flexural and torsional rigidities associated with the ⅓ of the shaft length terminating at the shaft distal end (110). Then two EI and GJ columns are labeled as 0-66% and indicate the average flexural and torsional rigidities associated with the ⅔ of the shaft length beginning at the shaft proximal end (120); followed by two EI and GJ columns are labeled as 33-100% and indicate the average flexural and torsional rigidities associated with the ⅔ of the shaft length terminating at the shaft distal end (110). Finally, the final four columns include two EI and GJ columns are labeled as 0-66% and indicate the average flexural and torsional rigidities associated with the ½ of the shaft length beginning at the shaft proximal end (120); followed by two EI and GJ columns are labeled as 50-100% and indicate the average flexural and torsional rigidities associated with the ½ of the shaft length terminating at the shaft distal end (110).

Referring still to FIG. 20, in one embodiment the middle ⅓ and the ⅓ terminating at the shaft distal end (110) both have average flexural and torsional rigidities that are greater than or equal to the average overall shaft flexural and torsional rigidities, while the ⅓ beginning at the shaft proximal end (120) has average flexural and torsional rigidities that are less than 65% of the average overall shaft flexural and torsional rigidities, and less than 50% in another embodiment, and less than 35% in another embodiment. In fact, in further embodiments not only are the average flexural and torsional rigidities greater than or equal to the average overall shaft flexural and torsional rigidities for the 33-66% and 66-100% length columns, they are at least 15% greater than the average overall shaft flexural and torsional rigidities, and at least 20% greater in another embodiment, and at least 25% greater in still a further embodiment; however, a further series of embodiments recognizes negative performance returns associates to great disparities and therefore introduces caps, which in one embodiment has the average overall shaft flexural and torsional rigidities for the 33-66% and 66-100% length columns no more than 50% greater than the average overall shaft flexural and torsional rigidities, and no more than 42.5% greater in another embodiment, and no more than 35% greater in still a further embodiment.

Sticking with the properties of the shaft divided up into one-thirds, in one embodiment the ⅓ of the shaft terminating at the shaft distal end (110) does not have the highest average flexural rigidity, while in another embodiment the ⅓ of the shaft terminating at the shaft distal end (110) does not have the highest average torsional rigidity. Thus, one kit embodiment includes two tip portions having differing flexural and torsional rigidities such that (a) with the first tip portion installed the ⅓ of the shaft terminating at the shaft distal end (110) does not have the highest average flexural rigidity, and (b) with the second tip portion installed the ⅓ of the shaft terminating at the shaft distal end (110) does have the highest average flexural rigidity.

Referring still to FIG. 20 but now focusing on the columns associated with the tip ⅔ of length and the butt ⅔ of length, in one embodiment the average flexural rigidity of the 0-66% portion of the shaft is at least 55% of the average flexural rigidity of the 33-100% portion of the shaft, and at least 60% in another embodiment, and 65-80% in still a further embodiment. Now focusing on the average torsional rigidities, in one embodiment the average torsional rigidity of the 0-66% portion of the shaft is at least 80% of the average torsional rigidity of the 33-100% portion of the shaft, and at least 85% in another embodiment, and 85-110% in still a further embodiment.

With continued reference to FIG. 20 but now focusing on the far right columns associated with the tip half of length and the butt half of length, in one embodiment the average flexural rigidity of the 0-50% portion of the shaft is at least 50% of the average flexural rigidity of the 50-100% portion of the shaft, and at least 60% in another embodiment, and 60-70% in still a further embodiment. Now focusing on the average torsional rigidities, in one embodiment the average torsional rigidity of the 0-50% portion of the shaft is at least 90% of the average torsional rigidity of the 50-100% portion of the shaft, and at least 95% in another embodiment, and 95-115% in still a further embodiment.

Referring generally back to FIG. 18, in one embodiment an average first tip portion flexural rigidity is 10-50 $N*m^2$ and an average second tip portion flexural rigidity is 10-50 $N*m^2$; while in yet another embodiment an average first tip portion torsional rigidity is 5-40 $N*m^2$ and an average second tip portion torsional rigidity is 5-40 $N*m^2$. In further embodiments the tip portion flexural rigidities are narrowed to ranges including 10-40 $N*m^2$, and 12.5-37.5 $N*m^2$ in an even further embodiment. In further embodiments the tip portion torsional rigidities are narrowed to ranges including 5-35 $N*m^2$, and 7.5-30 $N*m^2$ in an even further embodiment.

In one particular embodiment the kit includes at least two tip sections where the tip portion flexural rigidities differ by at least 5 $N*m^2$, and at least 10 $N*m^2$ in another embodiment, and at least 15 $N*m^2$ in still a further embodiment. Other embodiments have the flexural rigidity difference being no more than 30 $N*m^2$, and no more than 25 $N*m^2$ in another embodiment, and no more than 20 $N*m^2$ in still another embodiment. In a further embodiment the kit includes at least two tip sections where the tip portion torsional rigidities differ by at least 5 $N*m^2$, and at least 10 $N*m^2$ in another embodiment, and at least 15 $N*m^2$ in still a further embodiment. In additional embodiments the torsional rigidity difference is no more than 35 $N*m^2$, and no more than 30 $N*m^2$ in another embodiment, and no more than 25 $N*m^2$ in still another embodiment.

The kit may further include at least three tip sections or even at least four tip sections and the rigidity relationships just disclosed may apply to any pair of tip sections or even to all tip sections. In such embodiments at least half of the tip sections have different average flexural rigidities and different average torsional rigidities, as is true for the embodiment of FIG. 18, while in another embodiment each tip section may have a unique and different flexural and/or torsional rigidity from every other tip section. In another such embodiment none of the tip sections have an average flexural rigidity that is more than three times that of an average flexural rigidity of another tip portion, and none of the tip sections have an average torsional rigidity that is more than five times that of an average torsional rigidity of another tip portion.

Further, the relationship of the tip portion rigidities to the butt portion rigidities is critical in producing a product that does not feel like the user is swinging a rigid board or a board with a noodle at the tip. As such, in one embodiment an average butt portion flexural rigidity is at least 40 $N*m^2$ and an average butt portion torsional rigidity is at least 20 $N*m^2$; while in a further embodiment the average butt portion flexural rigidity is at least 50 $N*m^2$ and an average butt portion torsional rigidity is at least 25 $N*m^2$. In a further embodiment an average butt portion flexural rigidity is 50-110 $N*m^2$ and an average butt portion torsional rigidity is 20-70 $N*m^2$; while in a further embodiment the average butt portion flexural rigidity is 60-100 $N*m^2$ and an average butt portion torsional rigidity is 25-60 $N*m^2$. Preferred fitting flexibility, and the provision of distinct differences in feel and performance, is found when the average butt portion flexural rigidity is at least three times the tip portion flexural rigidity of one of the tip portion options, and at least two times the tip portion flexural rigidity of a second of the tip portion options. In a further embodiment the average butt portion flexural rigidity is 3-6 times the tip portion flexural rigidity of one of the tip portions, and 2-4 times the tip portion flexural rigidity of a second of the tip portions. In such embodiments the rigidities of the butt portion provide a slow swing speed golfer with tighter shot dispersion and consistency, while the rigidities of the tip portion provide a slow swing speed golfer with the help they need in obtaining a preferred launch angle.

Sticking with the disclosure of the butt portion (1000), in one embodiment the average butt portion flexural rigidity is at least twice the average butt portion torsional rigidity; while in a further embodiment the average butt portion flexural rigidity is no more than four times the average butt portion torsional rigidity. In another embodiment the average butt portion flexural rigidity is greater than the tip portion flexural rigidity of at least 50% of the tip portions in the kit; while in another embodiment the average butt portion flexural rigidity is greater than the tip portion flexural rigidity of all of the tip portions in the kit.

In another embodiment at least one of the tip portions in a kit, which has at least 2 tip portions, has an average tip portion flexural rigidity that is within 70% of the average butt portion flexural rigidity, and at least one of the tip portions has an average tip portion flexural rigidity that is at least 70% less than the average butt portion flexural rigidity; while another embodiment contains at least 3 tip portions in the kit, at least 2 of which have an average tip portion flexural rigidity that is within 70% of the average butt portion flexural rigidity; and still a further embodiment contains at least 4 tip portions in the kit, at least 2 of which have an average tip portion flexural rigidity that is within 70% of the average butt portion flexural rigidity and at least 2 of which have an average tip portion flexural rigidity that is at least 70% less than the average butt portion flexural rigidity.

Likewise, in another embodiment at least one of the tip portions a kit, which has at least 2 tip portions, has an average tip portion torsional rigidity that is within 30% of the average butt portion torsional rigidity, and at least one of the tip portions has an average tip portion torsional rigidity that is at least 60% less than the average butt portion torsional rigidity; while another embodiment contains at least 3 tip portions in the kit, at least 2 of which have an average tip portion torsional rigidity that is within 30% of the average butt portion torsional rigidity; and still a further embodiment contains at least 4 tip portions in the kit, at least 2 of which have an average tip portion torsional rigidity that is within 30% of the average butt portion torsional rigidity and at least 2 of which have an average tip portion torsional rigidity that is at least 60% less than the average butt portion torsional rigidity In still a further embodiment at least one of the tip portions in a kit, which has at least 2 tip portions, has an average tip portion flexural rigidity that is 50-60% of the average butt portion flexural rigidity, and at least one of the tip portions in the kit has an average tip portion torsional rigidity of 75-90% of the average butt portion torsional rigidity; while another embodiment contains at least 3 tip portions in the kit, at least 2 of which have an average tip portion flexural rigidity that is 50-60% of the average butt portion flexural rigidity; and still a further embodiment contains at least 4 tip portions in the kit, at least 2 of which have an average tip portion flexural rigidity that is 50-60% of the average butt portion flexural rigidity and at least 2 of which have average tip portion torsional rigidity of 75-90% of the average butt portion torsional rigidity.

Likewise, in another embodiment at least one of the tip portions in a kit, which has at least 2 tip portions, has an average tip portion torsional rigidity that is 75-90% of the average butt portion torsional rigidity, and at least one of the tip portions in the kit has an average tip portion torsional rigidity that is 20-35% of the average butt portion torsional rigidity; while another embodiment contains at least 3 tip portions in the kit, at least 2 of which have an average tip portion torsional rigidity that is 75-90% of the average butt portion torsional rigidity; and still a further embodiment contains at least 4 tip portions in the kit, at least 2 of which have an average tip portion torsional rigidity that is 75-90% of the average butt portion torsional rigidity and at least 2 of which have an average tip portion torsional rigidity that is 20-35% of the average butt portion torsional rigidity. While the disclosure often refers to properties of "least one of the tip portions in the kit", the disclosure is not limited to "kit" embodiments and enables standalone shafts, whether they be a single piece or multiple pieces (permanently joined together or releasably joined together), to possess the disclosed attributes and relationships.

In a preferred embodiment the second tip portion mass is no more than 50% greater than the first tip portion mass, while no more than 30% in another embodiment, no more than 20% in still a further embodiment, no more than 10% in yet another embodiment, and no more than 5% in still a further embodiment. Further, the first tip portion mass is 25-99% of the butt portion mass and the second tip portion mass is 25-99% of the butt portion mass, while in a further embodiment the tip portion masses are 30-70% of the butt portion mass, and in still another embodiment the tip portion masses are 35-60% of the butt portion mass. In one embodiment the tip portion mass is no more than 40 grams, while in other embodiments it is no more than 35 grams, or 30 grams, or 25 grams, or 20 grams. In another embodiment the butt portion mass is no more than 70 grams, and no more than 60 grams, 50 grams, and 45 grams in further embodiments. In embodiments directed to hybrid irons and irons, the mass of the individual components may be slightly higher. For instance in one embodiment the tip portion mass is no more than 50 grams, while in other embodiments it is no more than 40 grams, or 35 grams, or 30 grams, or 25 grams, while in another embodiment the butt portion mass is no more than 90 grams, and no more than 80 grams, 70 grams, and 60 grams in further embodiments. In further embodiments this paragraph's disclosed relationships of the second tip portion mass to the first tip portion mass may also apply to third and fourth tip portion masses with respect to the first tip portion mass; and likewise with respect to the tip portion masses to the butt portion mass, as well as the masses in general.

In some kit embodiments a wider variety of options are presented to ensure the user can truly feel the differences in the various options by having at least two tip portions where the mass varies by at least 15%, and at least 25% in a further embodiment, and at least 40% in still another embodiment. Likewise, in some kit embodiments a wider variety of options are presented by having at least two butt portions where the mass varies by at least 15%, and at least 25% in a further embodiment, and at least 40% in still another embodiment. Similarly, in some kit embodiments a wider variety of options are presented by having at least coupler portions where the mass varies by at least 15%, and at least 25% in a further embodiment, and at least 40% in still another embodiment.

One particular kit embodiment includes at least 3 tip portions (referred to as a tip family) and/or at least 3 butt portions (referred to as a butt family), and at least 2 of these components within the same family have a mass within 5% of one another (measured relative to the lightest family component) and the other component within the family has a mass that is at least 15% greater than the lightest family component. In further kit embodiment at least 2 of these components within the same family have a mass within 2.5% of one another (measured relative to the lightest family component) and the other component within the family has a mass that is at least 25% greater than the lightest family component. Another kit embodiment includes at least 2 tip portions and/or at least 2 butt portions, and at least one of the components within the same family has a mass that is at least 15% greater than the lightest family component, while in another embodiment at least one of the components within the same family has a mass that is 15-45% greater than the lightest family component, or 15-30% in an even more focused embodiment.

The flexural and torsional rigidities of the tip and butt portions can be changed greatly, while maintaining nearly identical mass (if desired), via the incorporation of fibers of different tensile strength and/or modifying the lay-up orientation or density of the fibers. In one embodiment the number of unidirectional prepreg plies is different in the butt portion than it is in the tip portion. In a further embodiment the fiber orientation angles between the adjacent unidirectional plies of the butt portion are not identical to the fiber orientation angles between the adjacent unidirectional plies of the tip portion. In still another embodiment the resin content in the butt portion is different than the resin content in the tip portion, while in a further embodiment the resin content of the butt portion is greater than the resin content of the tip portion. The "resin content" mentioned above is a weight ratio of the resin with respect to a total weight of the fiber reinforced resin. The weight of the resin is obtained by picking up only the fiber by chemically decomposing or removing only the resin from the fiber reinforced resin to be measured, and subtracting the total weight of the fiber from the previously measured weight of the fiber reinforced resin. In order to chemically remove the resin from the fiber reinforced resin, a heated nitric acid solution is, for example, used. Further, in order to chemically remove the resin, for example, from a prepreg, a methyl ethyl ketone is, for example, used.

In an embodiment, preferred balance and performance has been found when the tip portion mass is 20-30 grams, the butt portion mass is 40-50 grams, and the coupler mass is 5-17.5 grams. In fact, the coupler mass is preferably no more than the tip portion mass and no more than 50% of the butt portion mass, while in a further embodiment the coupler mass is no more than 75% of the tip portion mass and no more than 35% of the butt portion mass, and in still another embodiment the coupler mass is 35-60% of the tip portion mass and 20-35% of the butt portion mass. Another embodiment further recognizes that simply minimizing the weight of the coupler mass is not the goal, in this embodiment the coupler mass is at least 25% of the (a) the first tip portion mass, and (b) the second tip portion mass. Likewise, in another embodiment the first tip portion mass is 35-85% of the butt portion mass and the second tip portion mass is 35-85% of the butt portion mass, while in further embodiments these ranges are narrowed to 40-80%, 45-75%, and 50-70%.

Now referring back to the rigidity relationships and FIG. 18, in another embodiment the maximum second tip portion flexural rigidity is at least 50% greater than the maximum first tip portion flexural rigidity, and the maximum second tip portion torsional rigidity is at least 75% greater than the maximum first tip portion torsional rigidity. In still a further embodiment, the maximum second tip portion flexural rigidity is 35-150% greater than the maximum first tip portion flexural rigidity, and the maximum second tip portion torsional rigidity is 75-350% greater than the maximum first tip portion torsional rigidity. The kit of another embodiment includes a first tip portion having the maximum first tip portion torsional rigidity greater than the maximum first tip portion flexural rigidity, like the red tip of FIG. 18, along with a second tip portion having the maximum second tip portion torsional rigidity is less than the maximum second tip portion flexural rigidity, like the green, blue, or white tips of FIG. 18. In an even further such embodiment the maximum first tip portion torsional rigidity is at least 30% greater than the maximum first tip portion flexural rigidity, and the maximum second tip portion torsional rigidity is at least 50% less than the maximum second tip portion flexural rigidity.

Similar to the embodiments just discussed with respect to the tip portions (2000) and FIG.

18, in embodiments having multiple butt portions (1000) the flexural and torsional rigidities may also vary to provide the benefits and attributes described in association with the variations of the tip portions (2000). For instance, in embodiment a maximum second butt portion flexural rigidity is at least 25% greater than a maximum first butt portion flexural rigidity, and a maximum second butt portion torsional rigidity is at least 50% greater than a maximum first butt portion torsional rigidity. In still a further embodiment, the maximum second butt portion flexural rigidity is 25-150% greater than the maximum first butt portion flexural rigidity, and the maximum second butt portion torsional rigidity is 50-350% greater than the maximum first butt portion torsional rigidity. The kit of another embodiment includes a first butt portion having the maximum first butt portion torsional rigidity greater than the maximum first butt portion flexural rigidity, along with a second tip portion having the maximum second butt portion torsional rigidity less than the maximum second butt portion flexural rigidity. In an even further such embodiment the maximum first butt portion torsional rigidity is at least 30% greater than the maximum first butt portion flexural rigidity, and the maximum second butt portion torsional rigidity is at least 50% less than the maximum second butt portion flexural rigidity.

Length and center of gravity relationships also play an important role in providing an adjustable shaft providing unique relationships that provide improvements in fitting, performance, and feel, while distributing stress within the shaft and avoiding stress risers that negatively impact durability. Each tip portion (2001, 2002, 2003, 2004) has a tip portion length (2030), each butt portion (1000, 1001, 1002, 1003, 1004) has a butt portion length (1030), and each coupler (3000, 3001, 3002, 3003, 3004) has a coupler length (3030), measured from end to end in FIG. 21. In one embodiment having a single butt portion (1000), at least one coupler (3000), and at least two tip portions (1000), the first tip portion length is at least 25% less than the butt portion length (1030), the second tip portion length is at least 25% less than the butt portion length (1030), and the coupler length (3030) is no more than 50% of the length of either tip portion. In a further embodiment both tip portion lengths are at least 25% of the butt portion length (1030), and the coupler length (3030) is at least 10% of the length of either tip portion. In another embodiment the first tip portion length is 25-80% less than the butt portion length (1030), and the second tip portion length is 25-80% less than the butt portion length (1030); and in a further embodiment at least two of the tip portions (2000) have the same length and at least one tip portion (2000) has a different length. For swinging clubs the tip portion lengths are preferably 8-26", the butt portion lengths are preferably 22-40", and the coupler lengths are preferably 0.5-8.0"; while in a further embodiment the tip portion lengths are 10-22", the butt portion lengths are 26-36", and the coupler lengths are 1.0-4.0". In one embodiment each tip portion length is at least 20% of the shaft length (130), while in another embodiment each tip portion length is no more than 40% of the shaft length (130), and 25-37.5% in a further embodiment.

In another embodiment the shaft (100) has a shaft center of gravity located a shaft CG distance from the shaft proximal end (120) that is no more than 65% of the shaft length (130) regardless of which tip portion is installed, no more than 60% in a further embodiment, and no more than 55% in yet another embodiment. In a still further embodiment the shaft CG distance is greater than the distance from the shaft proximal end (120) to any portion of the coupler (3000), therefore the shaft center of gravity is located between the coupler (3000) and the shaft distal end (110). A family of embodiments achieves any of the relationships disclosed herein while controlling the shaft CG distance so that it changes by 5 mm or less, while achieving the associated relationship, whether it be rigidity related and associated with differing tip portions, butt portions, and/or couplers, or otherwise. Further, this may be true for just two of the portions in a particular kit, all the way up to being true for every portion in the kit. Another embodiment of this family achieves a shaft CG distance change of 3 mm or less, and a change of 2 mm or less in still a further embodiment. Controlling the change in shaft CG distance requires unique configuration of the weight distribution of the component, or components, being interchanged to achieve the objective relationship while also achieving the change in shaft CG distance.

Variations in rigidities over the shaft length (130) significantly influence the playability and feel of a particular combination of butt portion (1000), tip portion (2000), and coupler (3000). Further, selectively engineering in a large jump in rigidity over a relatively short length within a particular region can induce a desirable kickpoint. This is contrary to conventional shaft designs that strive to achieve smooth transitions in rigidity throughout the length and would characterize large jumps in rigidity as undesirable. Further, the large jump in rigidity over a relatively short length within a particular region results in more efficient transfer of energy for some swing types.

In one such embodiment the shaft flexural rigidity exceeds 125 $N*m^2$ for a distance of no more than 15% of the shaft length (130), and the shaft torsional rigidity exceeds 100 $N*m^2$ for a distance of no more than 15% of the shaft length (130), as seen in FIGS. 19(A)-(D) and 23(A)-(D). In a further embodiment the shaft flexural rigidity exceeds 150 $N*m^2$ for a distance of no more than 15% of the shaft length (130), and the shaft torsional rigidity exceeds 115 $N*m^2$ for a distance of no more than 15% of the shaft length (130).

Further embodiments recognize a minimum distance over which the aforementioned jumps in rigidity should occur. For instance in such embodiments the disclosed rigidity levels are not only limited to occurring for a distance of no more than 15% of the shaft length (130), but in these embodiments must also occur for a distance of at least 3.5% of the shaft length (130), and at least 5% in even further embodiments. The shaft (100) may further include a reinforced region located between a first point located 5" from the shaft proximal end (120) and a second point located 36" from the shaft proximal end (120), and the shaft flexural rigidity at a location within the reinforced region is (A) at least 100% greater than both a minimum first tip portion flexural rigidity and a minimum second tip portion flexural rigidity, and (B) at least 50% greater than a minimum butt portion flexural rigidity. In a further embodiment the shaft flexural rigidity at a location within the reinforced region is (A) at least 125 $N*m^2$, (B) at least 200% greater than both a minimum first tip portion flexural rigidity and a minimum second tip portion flexural rigidity, and (C) at least 75% greater than a minimum butt portion flexural rigidity.

Figure 25:
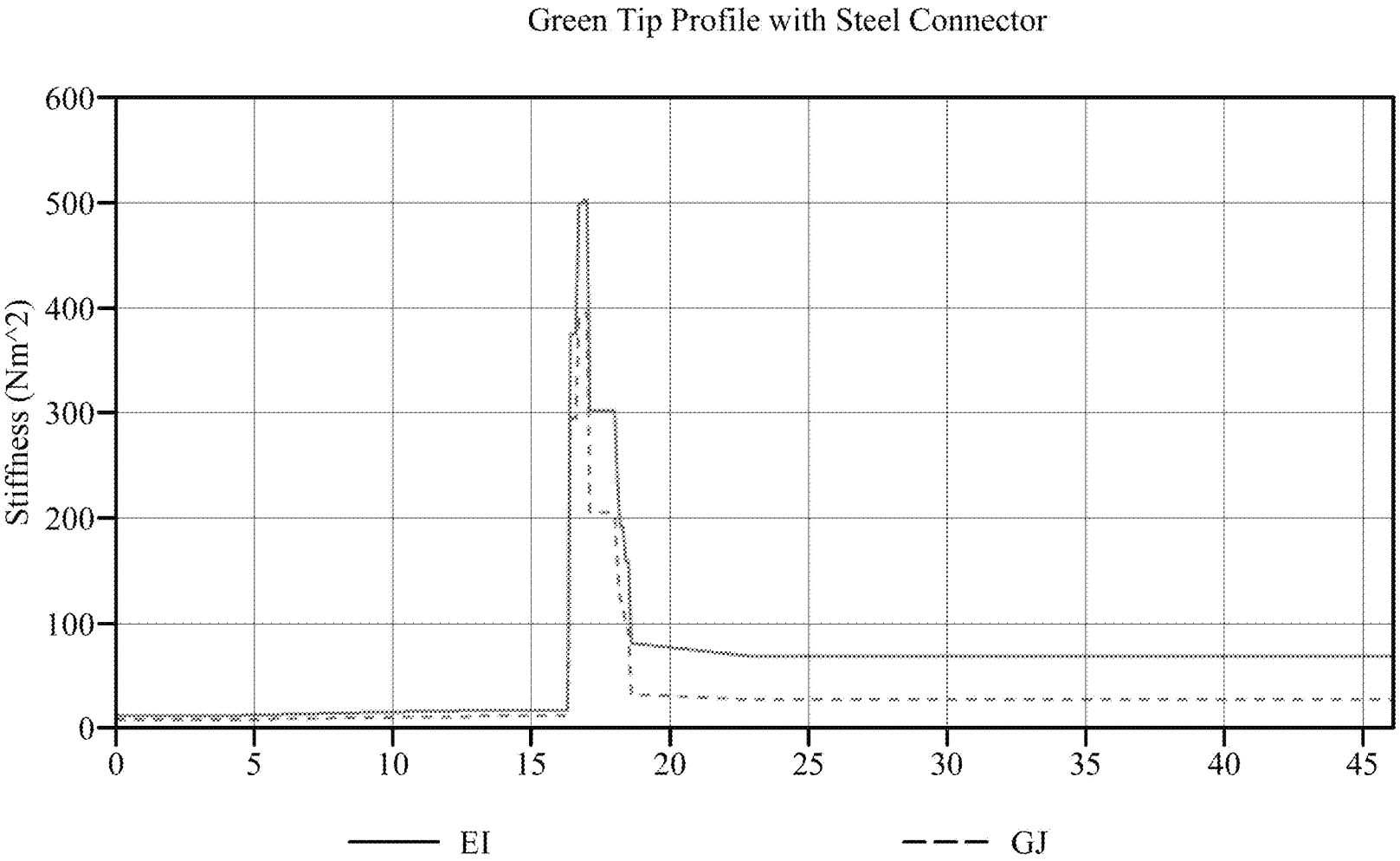
FIG. 25 shows a graph of the shaft stiffness profile of an embodiment of a tip portion with the vertical axis having units of $N*m^2$ and the horizontal axis having units of inches, not to scale.

However, another embodiment recognizes the diminishing returns, and negative attributes, associated with increasing the rigidity too much, thereby capping the increase such that the shaft flexural rigidity does not exceed 600 $N*m^2$, and the shaft torsional rigidity does not exceed 450 $N*m^2$, such as the embodiment illustrated in FIG. 25 when the connector includes steel alloy components. In still a further embodiment the shaft flexural rigidity does not exceed 300 $N*m^2$, and the shaft torsional rigidity does not exceed 250 $N*m^2$, such as the embodiment illustrated in FIG. 26 when the connector includes titanium alloy components. Further, in yet another embodiment the shaft flexural rigidity does not exceed 250 $N*m^2$, and the shaft torsional rigidity does not exceed 200 $N*m^2$, such as the embodiment illustrated in FIG. 23(A) when the connector includes aluminum alloy components. One skilled in the art will appreciate that these rigidities are not solely attributed to material properties but rather unique ranges that have been targeted and connectors (3000) designed to specifically achieve these ranges, while balancing the trade-offs associated with weight and durability issues common with large jumps in stress over short lengths.

Figure 21:
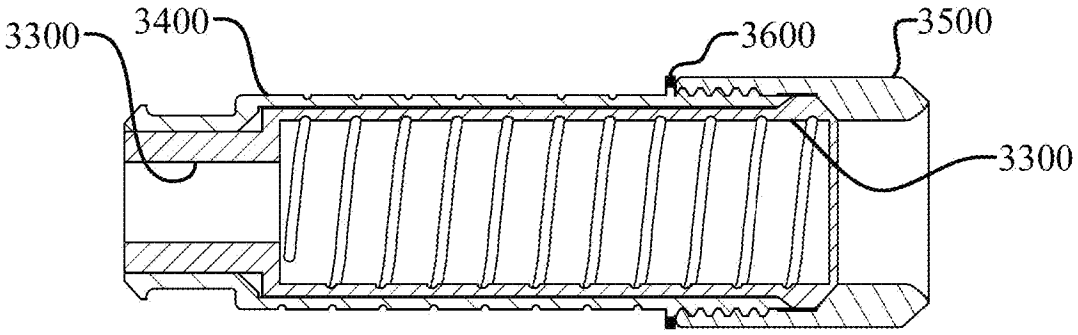
FIG. 21 shows a partial cross-sectional view of components of an embodiment of a coupler, not to scale.
Figure 22:
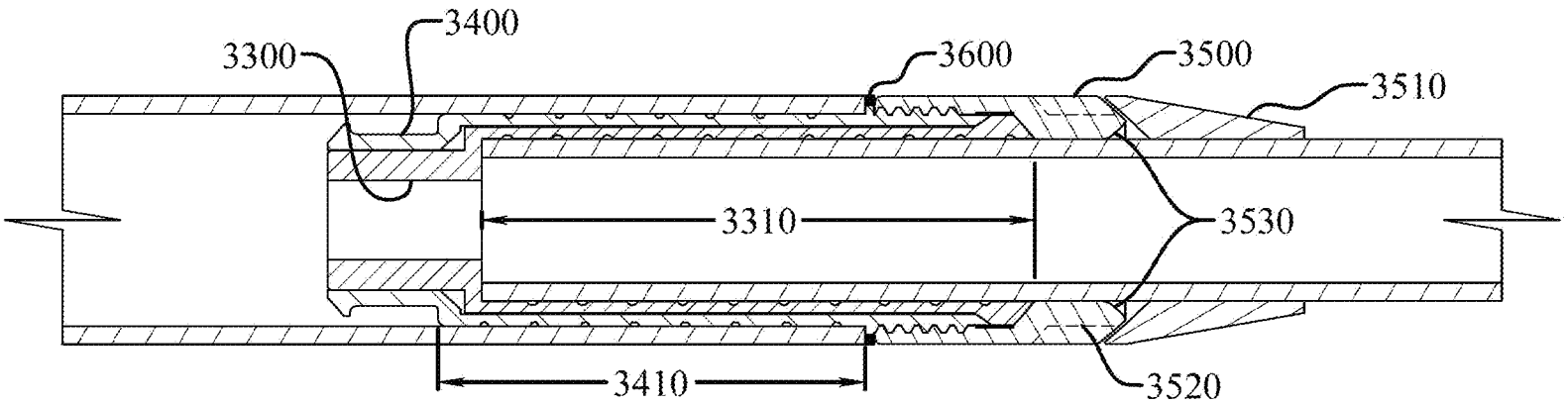
FIG. 22 shows a partial cross-sectional view of components of an embodiment of a coupler installed, not to scale.
Figure 23A:
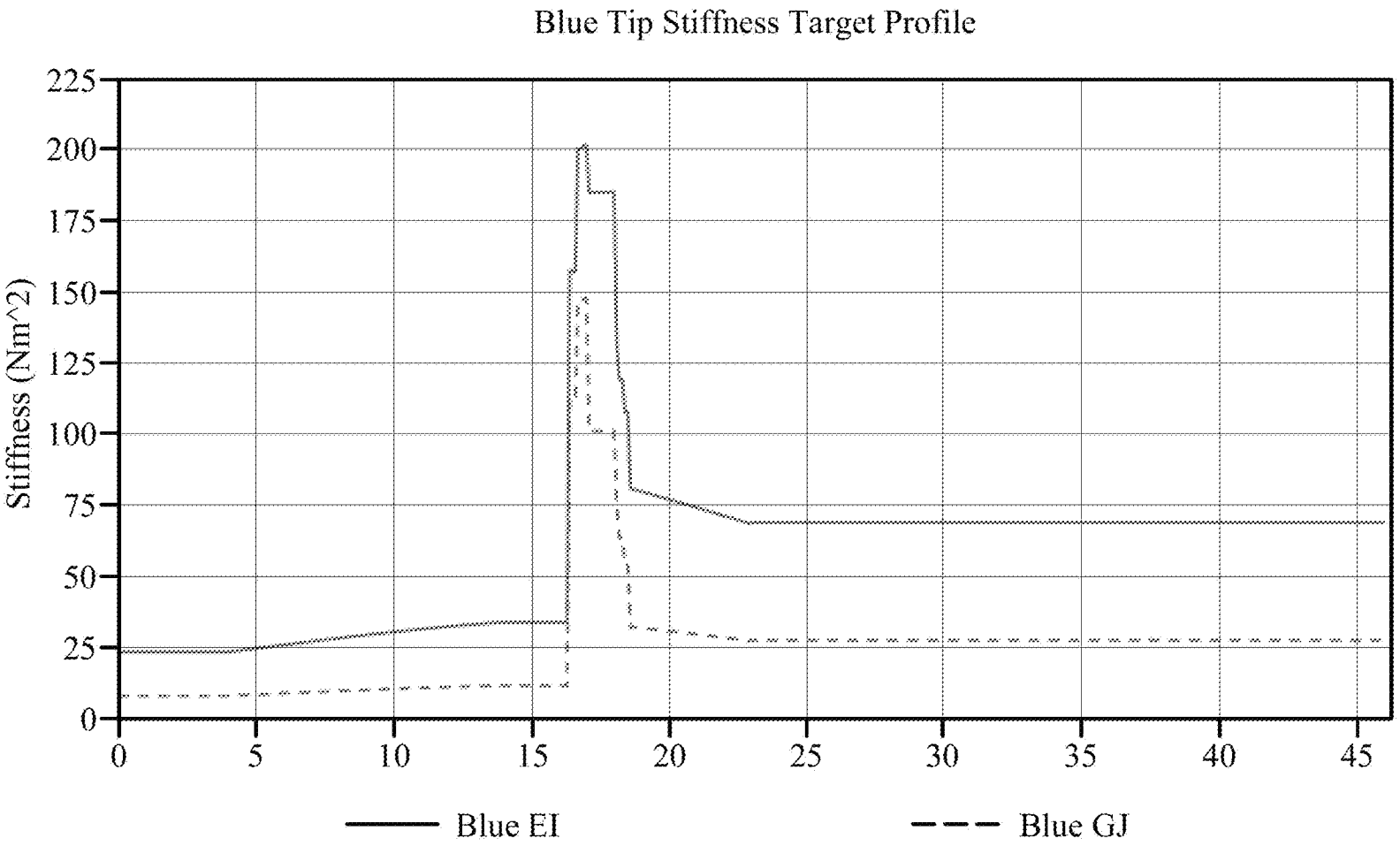
FIG. 23(A) shows a graph of the shaft stiffness profile of an embodiment of a tip portion with the vertical axis having units of $N*m^2$ and the horizontal axis having units of inches, not to scale.
Figure 23B:
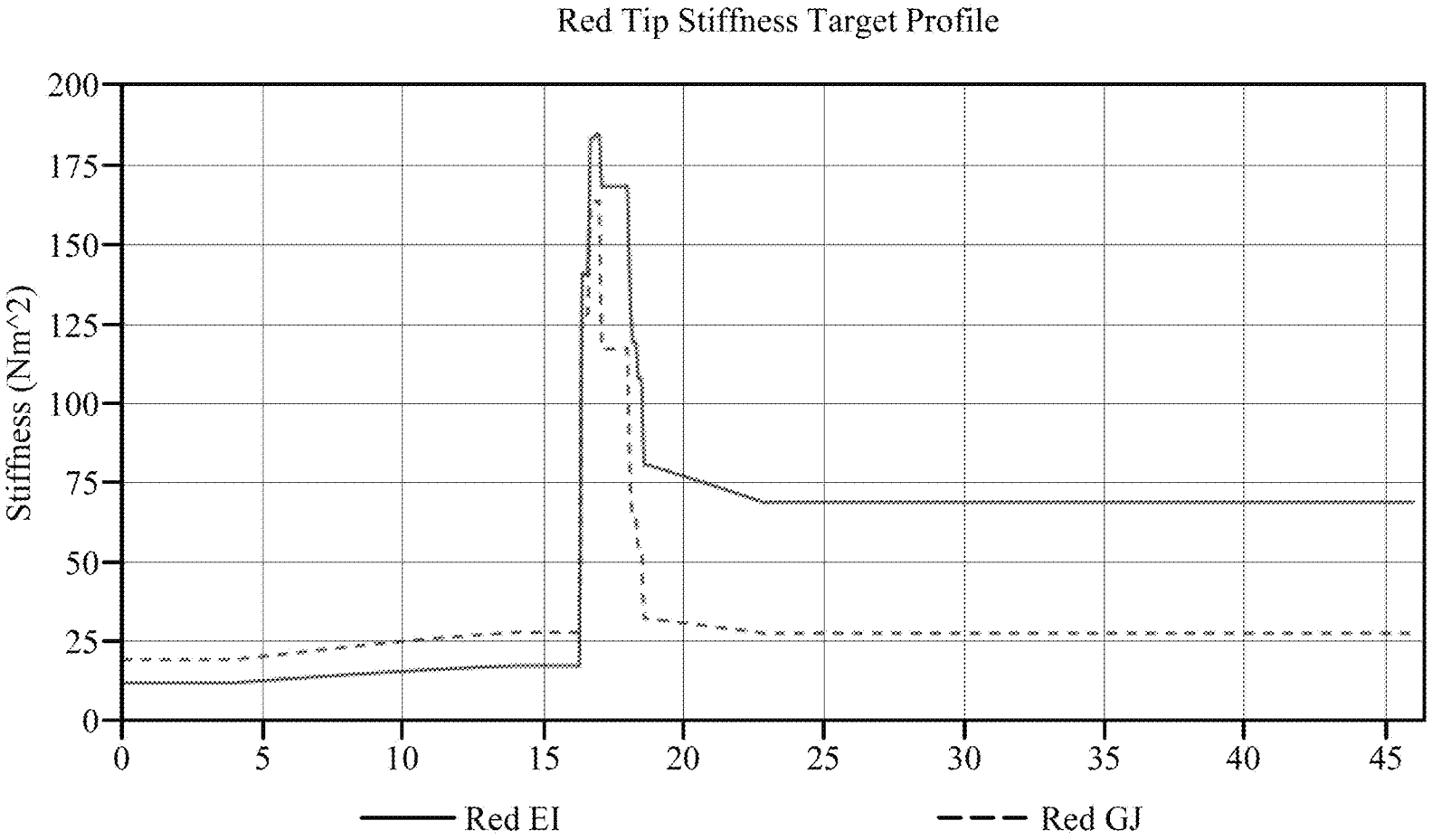
FIG. 23(B) shows a graph of the shaft stiffness profile of an embodiment of a tip portion with the vertical axis having units of $N*m^2$ and the horizontal axis having units of inches, not to scale.
Figure 23C:
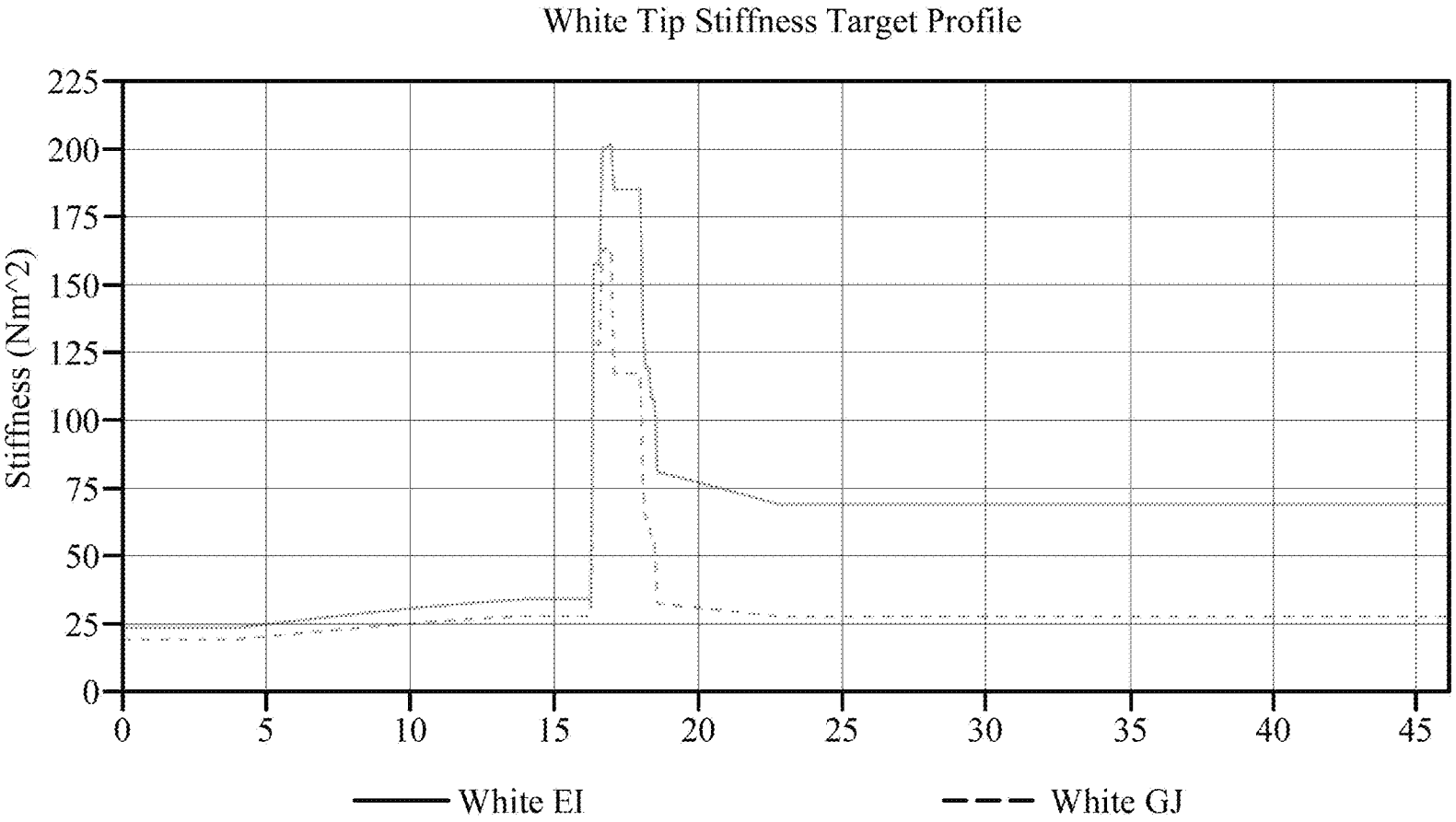
FIG. 23(C) shows a graph of the shaft stiffness profile of an embodiment of a tip portion with the vertical axis having units of $N*m^2$ and the horizontal axis having units of inches, not to scale.
Figure 23D:
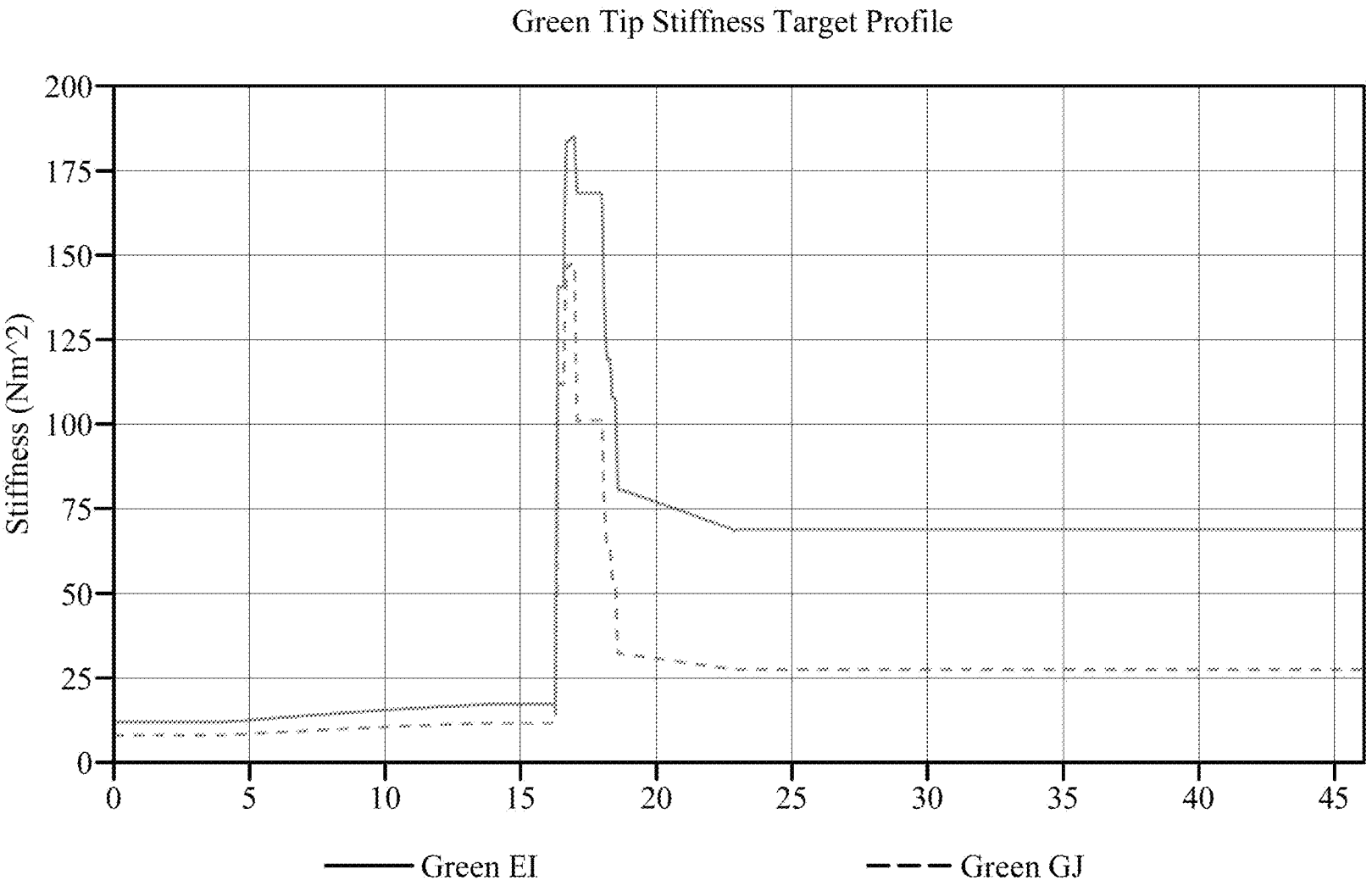
FIG. 23(D) shows a graph of the shaft stiffness profile of an embodiment of a tip portion with the vertical axis having units of $N*m^2$ and the horizontal axis having units of inches, not to scale.
Figure 24:
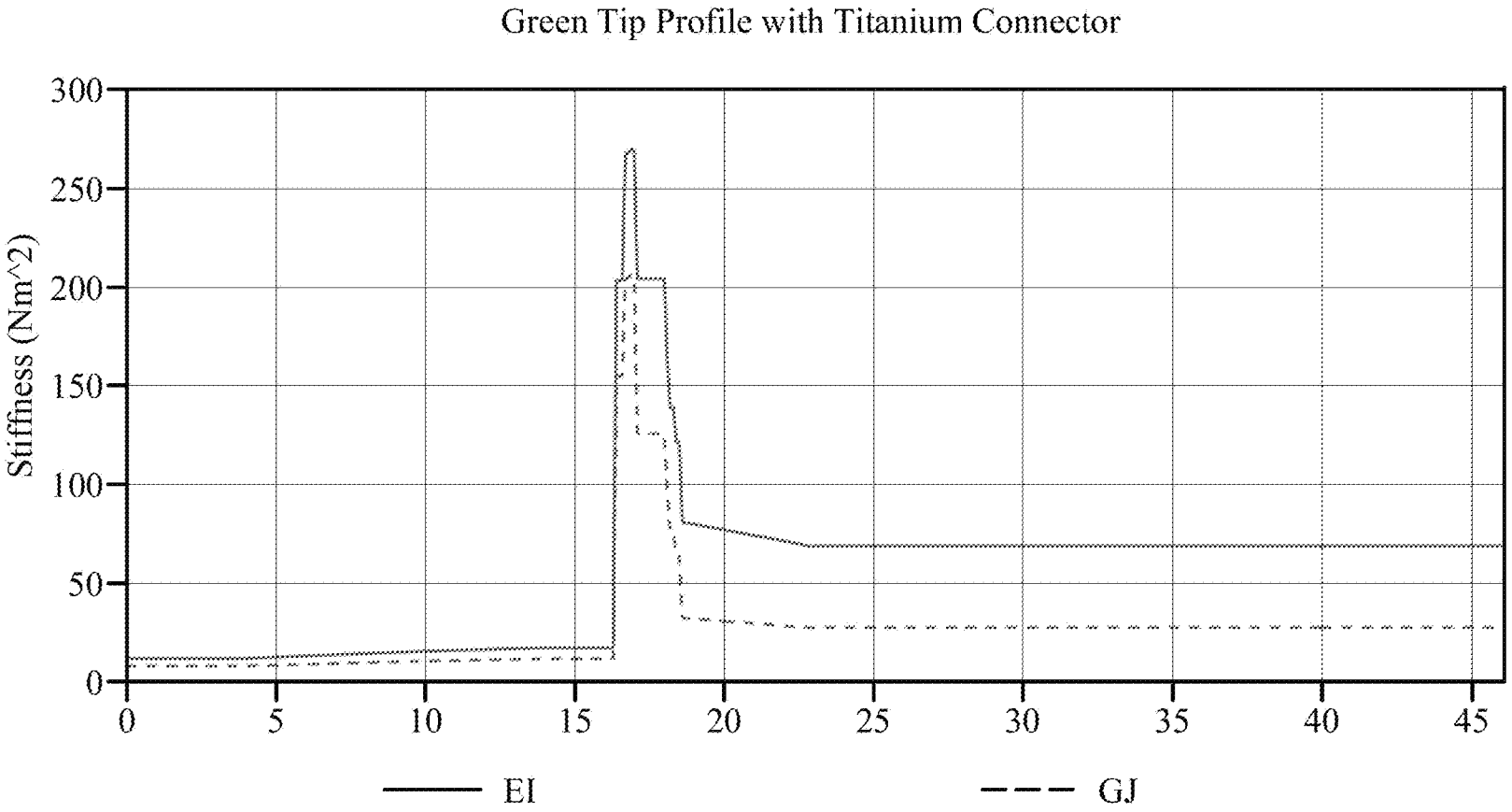
FIG. 24 shows a graph of the shaft stiffness profile of an embodiment of a tip portion with the vertical axis having units of $N*m^2$ and the horizontal axis having units of inches, not to scale.

The interchangeable coupler embodiment of FIGS. 21-22 incorporates a tip coupler portion (3300), a butt coupler portion (3400), and a fastening member (3500). The tip coupler portion (3300) engages with a tip portion (2000) along a tip engagement length (3310). In the illustrated embodiment the tip portion (2000) extends into the tip coupler portion (3300), although it may be vice versa. The tip engagement length (3310) need not be continuous contact between the tip portion (2000) and the tip coupler portion (3300), merely the length of cooperation, as most embodiments will incorporate grooves or passages on one or more of the surfaces to improve bond strength when the tip coupler portion (3300) is adhesively bonded to the tip portion (2000). Further, the "length of cooperation" does not require direct contact of the tip portion (2000) and the tip coupler portion (3300), as they may be separated by a layer of adhesive.

Similarly, the butt coupler portion (3400) engages with a butt portion (1000) along a butt engagement length (3410). In the illustrated embodiment the butt coupler portion (3400) extends into the butt portion (1000), although it may be vice versa. The tip engagement length (3310) and the butt engagement length (3410) significantly influence the previously disclosed large jump in rigidity over a relatively short length within a particular region, and the associated desirable attributes. The tip engagement length (3310) is at least as great as the tip portion outer diameter (2070), and in a further embodiment is double the tip portion outer diameter (2070). Likewise, the butt engagement length (3410) is at least as great as the tip portion outer diameter (2070), and in a further embodiment is double the tip portion outer diameter (2070). While increasing the tip engagement length (3310) and/or butt engagement length (3410) provide the benefits associated with greater bond area, load distribution, and lower stress, increases in these lengths can be detrimental to the performance of the shaft (100) as the jump in rigidity extends over too large of a portion of the shaft length (130).

Therefore, in one embodiment the tip engagement length (3310) and the butt engagement length (3410) are no more than ten times the tip portion outer diameter (2070), while no more than seven times the tip portion outer diameter (2070) in another embodiment, and no more than five times the tip portion outer diameter (2070) in still another embodiment. In another embodiment the tip engagement length (3310) and the butt engagement length (3410) are at least 0.500", and at least 0.625" in another embodiment, and at least 0.750" in still a further embodiment.

In the embodiment of FIGS. 21-22 the fastening member (3500) is configured to engage the tip coupler portion (3300) and the butt coupler portion (3400). In this embodiment the fastening member (3500) is a sleeve that is internally threaded to cooperate with external threads on the butt coupler portion (3400) and securing the tip coupler portion (3300) within the butt coupler portion (3400), however in another embodiment the configuration could be the opposite. Engagement of the fastening member (3500) to one of the tip coupler portion (3300) and the butt coupler portion (3400) need not be via threaded engagement and may incorporate other mechanical joining methods. Further, in some embodiments the fastening member (3500) need not engage both the tip coupler portion (3300) and the butt coupler portion (3400); for instance, in embodiments having a metallic tip portion (2000) the fastening member (3500) may directly engage the tip portion (2000). The butt coupler portion (3400) may be external to the butt portion (1000) and receive a portion of the butt portion (1000) within the butt coupler portion (3400). The fastening member (3500) provides another point of adjustability in the system and in one embodiment a kit includes at least 2 fastening members (3500) with one having a density that is at least twice that of the other.

In one embodiment at least a portion of the coupler (3000) is composed of metallic materials, while in a further embodiment the tip coupler portion (3300) and the butt coupler portion (3400) are formed of metallic materials, and in still a further embodiment the tip coupler portion (3300), the butt coupler portion (3400), and the fastening member (3500) are formed of metallic materials. In a further embodiment, a coupler density of any of the just disclosed metallic members is no more than 3 times the butt portion density. The coupler (3000) may further include a compressible joint member (3600) in positions prone to durability issues such as the interface between the exposed end of the butt portion (1000) and the fastening member (3500), as illustrated in FIG. 22. This is an area of significant deflection of the shaft (100) during the golf swing and contact of a metallic fastening member (3500) on the exposed end of the butt portion (1000) is likely to result in damage to the butt portion (1000), particularly when it is a non-metallic material. As such, in one embodiment the tip coupler portion (3300) and the butt coupler portion (3400) are designed to ensure there is a gap of at least 0.5 mm between a fully engaged fastening member (3500) and the end of the butt portion (1000), while in a further embodiment the gap is at least 1.0 mm, and in still a further embodiment the gap is no more than 5.0 mm.

The length of the fastening member (3500), measured along the shaft axis from one end to the other, seen in FIG. 22, is less than the tip engagement length (3310), and in a further embodiment is less than butt engagement length (3410), and in yet another embodiment is less than ½ the length of at least one of the tip engagement length (3310) and the butt engagement length (3410). The fastening member (3500) may be designed to be engaged by a fastening tool in order to adequately secure the components, and in a further embodiment the tool may be a torque limiting tool so that a user is prevented from overtightening and damaging any of the components, and in still another embodiment the fastening member (3500) is designed so that it cannot fully engage at least one of the other portions of the coupler (3000) without the use of the tool, in other words—bare hands cannot do the job. One or more tool engagement features (3520), which may include projections or recesses, may be formed in the exterior surface of the fastening member (3500) for engagement with complementary structure in a fastening tool, as seen in FIG. 22.

Further, the fastening member (3500) may incorporate a fastening member tapered portion (3510), which may be integral with the fastening member (3500) or may be a separate component as illustrated in FIG. 22. The fastening member tapered portion (3510) has a taper angle measured from the exterior surface to the interior surface, and the taper angle is 10-60 degrees, and 15-50 degrees in another embodiment, and 20-45 degrees in still a further embodiment. The fastening member tapered portion (3510) provides a more gradual transition from the butt portion to the tip portion and may serve to disguise the change in outer diameter and further distribute stress. The volume of the fastening member tapered portion (3510) is at least 50% of the volume of the fastening member (3500), but is no more than 25% of the mass of the fastening member (3500). Additionally, the fastening member (3500) may include an undercut (3530) to further distribute stresses and prevent stress risers associated with a sharp metallic edge. The undercut (3530) angle is at least 15 degrees from the horizontal and extends through at least 25% of the thickness of the fastening member (3500). Another benefit of the fastening member tapered portion (3510) embodiments is to conceal the undercut (3530), and in some embodiments extends into the undercut (3530). This is an area of significant flexure of the tip portion, and little flexure of the fastening member (3500), therefore avoidance of abrupt interface changes are preferred. The fastening member tapered portion (3510) may be formed of a non-metallic material and also serve to dampen vibrations transmitted across the fastening member (3500). In one embodiment the fastening member tapered portion (3510) is formed of an elastomeric material and has a mass of less than 10 grams.

Mass distribution and the disclosed rigidity relationships may be achieved in a number of fashions including one in which the tip portion (2000) may be hollow, or at least partially hollow, and have a tip portion sidewall thickness (2050) varying from a minimum tip portion sidewall thickness to a maximum tip portion sidewall thickness. In one such embodiment the maximum tip portion sidewall thickness is at least 25% greater than the minimum first tip portion sidewall thickness. In another embodiment the maximum tip portion sidewall thickness is 25-75% greater than the minimum tip portion sidewall thickness. Still further, the sidewall thickness of the tip coupler portion (3300) engaging the tip portion (2000) is less than the maximum tip portion sidewall thickness, in an embodiment, and the sidewall thickness of the butt coupler portion (3400) engaging the butt portion (1000) is less than the maximum butt portion sidewall thickness, in a further embodiment. Further, in still another embodiment the maximum tip portion sidewall thickness is greater than the butt portion sidewall thickness (4050) of a portion of the butt portion (4000).

Figure 17:
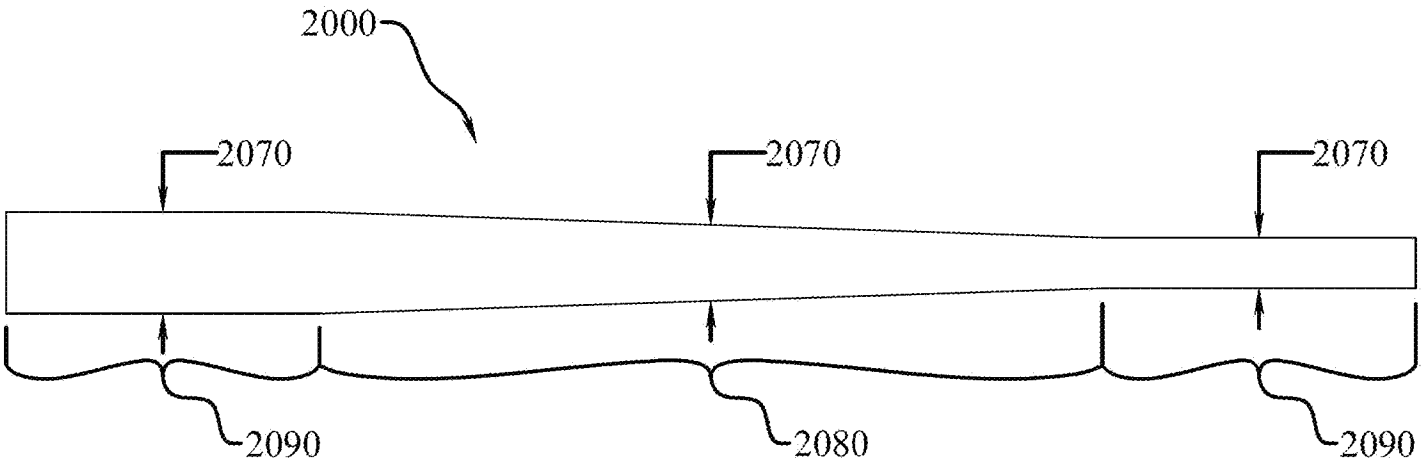
FIG. 17 shows a side elevation view view of an embodiment of a tip portion, not to scale.

The butt portion (1000) may have a constant outer diameter (1070) or it may taper, with or without steps, and similarly the tip portion (2000) may have a constant outer diameter (2070) or it may taper, with or without steps. In one embodiment at least one of the butt portion (1000) and the tip portion (2000) includes a portion having a constant outer diameter, while in another embodiment both the butt portion (1000) and the tip portion (2000) include a portion having a constant outer diameter. In one embodiment the entire butt portion (1000) has a constant outer diameter, while in another embodiment the tip portion (2000) has both a tip portion tapered section (2080) and a tip portion constant diameter section (2090), as seen in FIG. 17 where there are two tip portion constant diameter sections (2090) separated by tip portion tapered section (2080). A length of the tip portion tapered section (2080) is preferably greater than a length of the tip portion constant diameter section (2090), or sections, in one embodiment, while the length of the tip portion tapered section (2080) is 50-80% of the tip portion length (2030) in a further embodiment. Whether the taper is in the butt portion (1000), the tip portion (2000), or both, in a further embodiment the taper is such that the outer diameter changes by at least 5% (measured from the smallest outer diameter).

Locating a substantial change in the outer diameter at the location of the heightened rigidity provides the ability to significantly influence the location of the kickpoint of the shaft (100). In one such embodiment the shaft outer diameter reduces by at least 15% across the coupler (3000) from the butt portion (1000) to the tip portion (2000), and reduces by at least 20% in another embodiment, and at least 25% in still a further embodiment. However, too significant of a change in the shaft outer diameter across the coupler (3000) can negatively impact performance, durability, and the aesthetic of the shaft (100). Thus, in one embodiment the shaft outer diameter reduces by no more than 45% across the coupler (3000) from the butt portion (1000) to the tip portion (2000), and no more than 40% in another embodiment, and no more than 35% in still another embodiment. The outer diameter of the fastening member (3500) may taper to aid in visually disguising the significance of the change in the outer diameter of the shaft (100).

As previously touched upon, selectively engineering in a large jump in rigidity over a relatively short length within a particular region can induce a desirable kickpoint. Therefore, adjusting the location of the jump in rigidity, along with the length of the butt portion (1000) and tip portion (2000), allows great flexibility in locating the kickpoint. One such embodiment maintains very consistent kickpoint location while presenting the golfer with two different tip portions (2000) having very different flexural and torsional rigidities. In this embodiment the shaft has a first kickpoint distance when the shaft includes the first tip portion and a second kickpoint distance when the shaft includes the second tip portion, and the second kickpoint distance is within 5% of the first kickpoint distance regardless of the variations in properties disclosed herein between the first and second tip portions, and within 3% in another embodiment, and within 1% in still a further embodiment. The kickpoint distance is the distance measured along the initial shaft axis from the shaft proximal end (120) to the maximum deflection point. While the in the prior embodiments the kickpoint distance does not significantly change, in one embodiment the maximum kickpoint deflection, associated with the kickpoint distance, from the initial shaft axis is significantly different for the first tip portion compared to the second tip portion. In fact, in one embodiment the maximum kickpoint deflection associated with a shaft having one tip portion is at least 10% greater than another maximum kickpoint deflection associated with a shaft having a different tip portion, and at least 15% greater in another embodiment, and at least 20% greater in still a further embodiment, however in another series of embodiments it is no more than 100% greater, and no more than 90%, and 80% in still additional embodiments.

While the previous embodiment incorporates tip portions having the same length, the large jump in rigidity facilitates control of kickpoint location while accommodating up to a 20% variation in the tip portion lengths, however in these embodiments the first and second kickpoint distances are measured from the shaft distal end (110) rather than the shaft proximal end (120). In a further embodiment the kickpoint is located within 6" of an edge of the coupler. Various kit embodiments allow the user to analyze the impact of the kickpoint location by providing at least two tip portions having different tip portion lengths, which in one includes a long tip portion with a length at least 15% greater than a short tip portion, and at least 25% greater in another embodiment, and at least 35% greater in still a further embodiment. The two differing length tip portions may have the same flexural rigidity profile and/or torsional rigidity profile. The long tip portion is no more than 75% greater than the short tip portion in another embodiment, and no more than 65% greater in another embodiment, and no more than 50% greater in yet a further embodiment.

With reference to FIGS, 19(A)-19(D), one embodiment has at least one of (a) a minimum first tip portion flexural rigidity, and (b) a minimum second tip portion flexural rigidity, that is at least 30% less than the butt portion flexural rigidity of a portion of the butt portion, and the greatest butt portion flexural rigidity is no more than 70% of the greatest shaft flexural rigidity. In an even further embodiment at least one of (a) the minimum first tip portion flexural rigidity, and (b) the minimum second tip portion flexural rigidity, is at least 50% less than the butt portion flexural rigidity of a portion of the butt portion, the greatest butt portion flexural rigidity is no more than 55% of the greatest shaft flexural rigidity, and at least one of (a) the maximum first tip portion flexural rigidity, and (b) the maximum second tip portion flexural rigidity, is at least 30% of the greatest butt portion flexural rigidity.

Similarly, another embodiment has at least one of (a) a minimum first tip portion torsional rigidity, and (b) a minimum second tip portion torsional rigidity, that is at least 30% less than the butt portion torsional rigidity of a portion of the butt portion, and the greatest butt portion torsional rigidity is no more than 70% of the greatest shaft torsional rigidity. In an even further embodiment at least one of (a) the minimum first tip portion torsional rigidity, and (b) the minimum second tip portion torsional rigidity, is at least 50% less than the butt portion torsional rigidity of a portion of the butt portion, the greatest butt portion torsional rigidity is no more than 55% of the greatest shaft flexural rigidity, and at least one of (a) the maximum first tip portion torsional rigidity, and (b) the maximum second tip portion torsional rigidity, is at least 60% of the greatest butt portion torsional rigidity. Additionally, in one particular embodiment the shaft flexural rigidity is constant throughout at least 10% of the shaft length, and the shaft torsional rigidity is constant throughout at least 10% of the shaft length.

As seen in the embodiments of FIGS. 23(A)-23(D) the flexural and torsional rigidity varies throughout majority of the shaft located between the shaft proximal end (120) and the spike in rigidity, whereas the flexural and torsional rigidity is constant throughout majority of the shaft located between the spike in rigidity and the shaft distal end (110). In a further embodiment the flexural and torsional rigidity varies by less than 70% on the portion of the shaft located between the shaft proximal end (120) and the spike in rigidity, and less than 60% in another embodiment, and less than 50% in still a further embodiment. However, the flexural rigidity varies by at least 5% on the portion of the shaft located between the shaft proximal end (120) and the spike in rigidity.

Any of the above disclosure may be incorporated into embodiments directed to methods of fitting a golfer to a golf shaft, as well as methods of selling golf shafts, and methods of constructing, or assembling, golf shafts. References to a "kit" used throughout the disclosure includes, in one embodiment, a system of components sold together as a single sale unit such as when packaged together in a single box, however the "kit" also includes situations where the components are available together for trial and/or purchase even if the components are ultimately purchased individually, and even from a different location or source.

For example, this would be the case of a retail display containing multiple tip portions and/or multiple butt portions from which a consumer, or fitting professional, may mix and match the components for experimentation and/or purchase the components individually to construct a single shaft, even if ordered and assembled at a remote location. For instance a golf retail establishment may have an assortment of components, including at a minimum a plurality of different tip portions, that the potential consumer, or fitting professional, may combine and assemble into a golf shaft, preferably with some degree of fitting assistance (whether from a professional, an instruction sheet, or app or other software system). The potential consumer may then attach the assembled golf shaft to a club head to create a golf club, and then take the golf club into a hitting bay to assess the combination by hitting a plurality of golf balls. The potential consumer may repeat this process multiple times with different combinations of the components until they arrive at the combination that is best for their particular swing and their desired ball flight characteristics. A software system may guide the potential consumer with recommendations of component combinations based upon data the system is receiving from a launch monitor or other ball flight recording or simulation device; for example the system may analyze the collected data and identify, and optionally recommend, a different tip portion based upon different flexural and/or torsional rigidity properties that would benefit the user is more likely to produce experimental data more similar to a set of target ball flight characteristics selected by the user. The potential consumer then purchases only those components necessary to assemble their desired combination, or places an order for a shaft composed of the preferred components that may be assembled remotely and shipped to the consumer. Thus, in this embodiment the consumer is not purchasing a kit containing multiple versions of at least one of the components needed to construct a golf shaft, however multiple versions of at least one of the necessary components are available to the potential consumer to select from, and/or experiment with, and/or purchase or place an order. Therefore, in one embodiment the kit may be a retail display or even a self-service kiosk. Further, an online ordering system that allows a consumer to select from multiple versions of at least one of the necessary components, and purchase the other components necessary to create the finished shaft, whether purchased together at one time or separately over time, still functions as the disclosed kit.

One embodiment consists of the steps of (a) selecting a first tip portion from a plurality of different tip portions, (b) assembling a first shaft including the selected first tip portion, (c) joining a club head to the first shaft to create a first golf club, (d) hitting a plurality of golf balls with the first golf club and collecting a plurality of ball flight data associated with the first golf club, (e) selecting a second tip portion from the plurality of different tip portions based upon at least one of the plurality of ball flight data, (f) removing the club head and the first tip portion from the first shaft and installing the second tip portion to create to create a second shaft, (g) joining the club head to the second shaft to create a second golf club, and (h) hitting a plurality of golf balls with the second golf club and collecting a plurality of ball flight data associated with the second golf club. The software system may analyze the first and second ball flight data and prepare a visual comparison between the results of the two golf clubs. Further, the system may make a recommendation as to the suggested tip portion between the two, or make a suggestion to try a third tip portion and repeat the process. The method may further include the step of selecting the preferred combination of components based upon a comparison of ball flight data associated with the first golf club versus the second golf club, and may further include the step of making a purchasing decision.

Any, or all, of these steps may take place in a virtual or simulated environment. For instance a potential consumer may upload a video of their swing, or data representing their swing, to a computer system. A software system may evaluate the swing and attributes including swing speed and acceleration profile of the swing, and angle of attack, and make a suggestion of the best combination of components to create a preferred golf shaft tailored to achieve maximum performance in light of the evaluated golf swing. In a further embodiment the system may simulate multiple shafts and determine simulated performance characteristics for each shaft, and display the simulated performance characteristics to the potential consumer so they can see how the combination is impacting the simulated ball flight. The software system may further include the step of evaluating ball flight data, including any, or all, of the data collected by commercially available systems such as SkyGolf SkyTrak, Rapsodo, FlightScope Mevo, Voice Caddie SC300, and equivalents.

Additionally, the disclosed interchangeable tip portion embodiments and methods may be used in the process of creating a single piece composite golf club shaft possessing the flexural and torsional rigidity profiles established to best match a particular consumers golf swing. In other words, in one embodiment the interchangeable tip portion shaft system is used in the fitting process to experimentally identify a preferred flexural and torsional rigidity profile, which is then provided to a manufacturing facility to construct a single piece composite golf club shaft having the preferred flexural and torsional rigidity profile, which may be accomplished via a combination of the pre-preg lay-up, orientation of individual layers and/or pieces, material properties of the fibers, and/or the resin content and material properties of the resin, just to name a few. Thus, the present invention includes single piece golf club shafts incorporating any of the disclosed flexural or torsional rigidity profiles, which in further embodiments uniformly taper over at least 70% of the shaft length, and in a further embodiment is entirely free of any traditional shaft "steps" whereby the outside diameter changes by more than 1 mm.

Further, while some of the disclosed embodiments focus on a coupler (3000) configured to releasably join the butt portion (1000) and the tip portion (2000), a further series of embodiments may incorporate mid-section portion and a second coupler. In these embodiments the coupler (3000) releasably joins the tip portion (2000) and the mid-section portion, while the second coupler releasably joins the mid-section portion and the butt portion (1000). In one embodiment the flexural and torsional rigidity of the mid-section portion varies by less than 70% on the portion of the shaft located between the couplers, and less than 60% in another embodiment, and less than 50% in still a further embodiment. However, in another embodiment the flexural rigidity varies by at least 5% on the portion of the shaft located between couplers, and at least 10% in another embodiment, and at least 15% in still a further embodiment. These embodiments selectively engineer another large jump in rigidity over a relatively short length within a particular region to further induce a desirable kickpoint location. This is contrary to conventional shaft designs that strive to achieve smooth transitions in rigidity throughout the length and would characterize large jumps in rigidity as undesirable. Further, the large jump in rigidity over a relatively short length within a particular region results in more efficient transfer of energy for some swing types.

In one such embodiment the shaft flexural rigidity at the second coupler exceeds 125 $N*m^2$ for a distance of no more than 15% of the shaft length (130), and the shaft torsional rigidity exceeds 100 $N*m^2$ for a distance of no more than 15% of the shaft length (130). In a further embodiment the shaft flexural rigidity at the second coupler exceeds 150 $N*m^2$ for a distance of no more than 15% of the shaft length (130), and the shaft torsional rigidity exceeds 115 $N*m^2$ for a distance of no more than 15% of the shaft length (130). Further embodiments recognize a minimum distance over which the aforementioned jumps in rigidity should occur. For instance in such embodiments the disclosed rigidity levels are not only limited to occurring for a distance of no more than 15% of the shaft length (130), but in these embodiments must also occur for a distance of at least 3.5% of the shaft length (130), and at least 5% in even further embodiments. The shaft (100) may further include a second reinforced region located between a first point located 5" from the shaft distal end (110) and a second point located 36" from the shaft distal end (110), and the shaft flexural rigidity at a location within the second reinforced region is (A) at least 100% greater than both a minimum first tip portion flexural rigidity and a minimum second tip portion flexural rigidity, and (B) at least 50% greater than a minimum butt portion flexural rigidity. In a further embodiment the shaft flexural rigidity at a location within the second reinforced region is (A) at least 125 $N*m^2$, (B) at least 200% greater than both a minimum first tip portion flexural rigidity and a minimum second tip portion flexural rigidity, and (C) at least 75% greater than a minimum butt portion flexural rigidity.

In a further embodiment at least one of the tip portion or the butt portion contains a portion having a filler material such that a cross-section, perpendicular to the shaft axis, is fully occupied by the filler material, which is not to say that the filler material may not contain voids, or air pockets, because in certain embodiments it does. A hollow portion of the tip portion, the butt portion, or the entire shaft, may be partially or entirely filled with an elastic polymer or elastomer material (e.g., a viscoelastic urethane polymer material), a thermoplastic elastomer material (TPE), a thermoplastic polyurethane material (TPU), and/or other suitable types of materials to absorb shock, isolate vibration, and/or dampen noise. Another embodiment incorporates a polymer material such as an ethylene copolymer material to absorb shock, isolate vibration, and/or dampen noise when a golf club head strikes a golf ball. Embodiments include a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. Further embodiments may incorporate a polymeric material and a plurality of microscopic bubbles made of glass, ceramic, and/or plastic, also referred to herein as microscopic, hollow beads. The microscopic bubbles serve two purposes when incorporated with a polymeric material: (1) they lighten the overall fill weight by replacing elastomer with air, thus lowering the material's specific gravity; and (2) they increase the porosity of the fill material, allowing for the formation of micro-holes in the polymeric material. The micro-holes are little air pockets that allow the polymer to flex while at the same time maintaining the sound improvement provided by the polymer itself, such as reduction in dB level and duration. The polymeric material preferably is an elastomer such as polyurethane or silicone having a Poisson's ratio of 0.00-0.50, and more preferably 0.40-0.50, and the microscopic bubbles preferably are measured in D50 micron, which is the median particle size for a measured sample, each microscopic bubble having a diameter of approximately 18-50 microns. In one embodiment, the Shore hardness of the filler material is within the range of approximately A20 to D90. For instance, the filler material may be an acrylic epoxy. Other filler material embodiments include urethanes, polyurethanes, ionomers, elastomers, silicones, rubbers, and other similar materials. Still further embodiments incorporate filler material with a hardness less than that of the tip portion or the butt portion, and optionally comprises a resilient material such as a polymeric material, natural or synthetic rubber, polyurethane, thermoplastic polyurethane (TPU), an open- or closed-cell foam, a gel, a metallic foam, a visco-elastic material, or resin. In one embodiment the filler material has a density of less than 0.9 g/cc, and less than 0.75 g/cc, 0.60 g/cc, and 0.45 g/cc in still further embodiments.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A golf club shaft, comprising:

a shaft having a shaft distal end, a shaft proximal end, a shaft outer diameter, a shaft length, a shaft mass, a shaft center of gravity located a shaft CG distance from the shaft proximal end, a kickpoint located a kickpoint distance from the shaft proximal end, wherein each point along the shaft length has (i) a shaft flexural rigidity including a maximum shaft flexural rigidity, and (ii) a shaft torsional rigidity including a maximum shaft torsional rigidity;

the shaft having a butt portion joined by a coupler to a tip portion;

the butt portion having a butt portion distal end, a butt portion proximal end, a butt portion length of 20-40", and a butt portion mass of no more than 60 grams;

the tip portion having a tip portion distal end, a tip portion proximal end, a tip portion length that is (a) 8-26", (b) 25-75% of the butt portion length, and (c) at least 20% of the shaft length, and a tip portion mass of no more than 35 grams and less than 75% of the butt portion mass;

the butt portion formed of a butt portion material having a butt material density, a butt portion mass, a butt portion elastic modulus, a butt portion shear modulus, and each point along the butt portion length having (i) a butt portion area moment of inertia, (ii) a butt portion polar moment of inertia, (iii) a butt portion flexural rigidity including an average butt portion flexural rigidity, a maximum butt portion flexural rigidity, and a minimum butt portion flexural rigidity, and (iv) a butt portion torsional rigidity including an average butt portion torsional rigidity, a maximum butt portion torsional rigidity, and a minimum butt portion torsional rigidity;

the tip portion formed of a tip portion material having a tip material density, a tip portion elastic modulus, and a tip portion shear modulus, and each point along the tip portion length having (i) a tip portion area moment of inertia, (ii) a tip portion polar moment of inertia, (iii) a tip portion flexural rigidity including an average tip portion flexural rigidity, a maximum tip portion flexural rigidity, and a minimum tip portion flexural rigidity, and (iv) a tip portion torsional rigidity including an average tip portion torsional rigidity, a maximum tip portion torsional rigidity, and a minimum tip portion torsional rigidity;

wherein:

the average tip portion flexural rigidity is 10-50 $N*m^2$ and the average tip portion torsional rigidity is 5-40 $N*m^2$;

the flexural rigidity of a portion of the shaft located 5-36" from the shaft proximal end is at least 100% greater than the minimum tip portion flexural rigidity, and at least 50% greater than the minimum butt portion flexural rigidity; and the maximum shaft flexural rigidity is no more than 600 $N*m^2$ and the maximum shaft torsional rigidity is no more than 450 $N*m^2$.

2. The golf club shaft of claim 1, wherein the butt portion mass is no more than 50 grams, the tip portion mass is no more than 30 grams, the coupler mass is no more than 60% of the tip portion mass, the tip portion length is 10-22", and the butt portion length is 26-36".

3. The golf club shaft of claim 2, wherein the butt portion mass is no more than 45 grams, the tip portion mass is no more than 25 grams, and the coupler mass is 25-75% of the tip portion mass.

4. The golf club shaft of claim 2, wherein the butt portion mass is 40-50 grams, the tip portion mass is 20-30 grams, the tip portion length is 10-22", and the butt portion length is 26-36".

5. The golf club shaft of claim 2, wherein the tip portion mass is no more than 70% of the butt portion mass.

6. The golf club shaft of claim 5, wherein the tip portion mass is 35-60% of the butt portion mass, and the coupler has a coupler mass of 5-17.5 grams.

7. The golf club shaft of claim 2, wherein the shaft CG distance is no more than 65% of the shaft length.

8. The golf club shaft of claim 7, wherein the shaft CG distance is no more than 55% of the shaft length.

9. The golf club shaft of claim 7, wherein the shaft CG distance is greater than a distance of any portion of the coupler from the shaft proximal end.

10. The golf club shaft of claim 7, wherein the maximum shaft flexural rigidity is no more than 300 $N*m^2$ and the maximum shaft torsional rigidity is no more than 250 $N*m^2$.

11. The golf club shaft of claim 10, wherein the maximum shaft flexural rigidity is no more than 250 $N*m^2$ and the maximum shaft torsional rigidity is no more than 200 $N*m^2$.

12. The golf club shaft of claim 7, wherein the flexural rigidity of a portion of the shaft located 5-36" from the shaft proximal end is at least 125 $N*m^2$ and at least 200% greater than the minimum tip portion flexural rigidity, and at least 75% greater than the minimum butt portion flexural rigidity.

13. The golf club shaft of claim 12, wherein the flexural rigidity of the shaft exceeds 125 $N*m^2$ for no more than 15% of the shaft length.

14. The golf club shaft of claim 13, wherein the flexural rigidity of the shaft exceeds 125 $N*m^2$ for at least 3.5% of the shaft length.

15. The golf club shaft of claim 13, wherein the torsional rigidity of a portion of the shaft located 5-36" from the shaft proximal end is at least 100 $N*m^2$, and the torsional rigidity of a portion of the shaft exceeds 100 $N*m^2$ for no more than 15% of the shaft length.

16. The golf club shaft of claim 15, wherein the flexural rigidity of a portion of the shaft exceeds 150 $N*m^2$ and the torsional rigidity of a portion of the shaft exceeds 115 $N*m^2$, and the tip material density that is within 15% of the butt material density.

17. The golf club shaft of claim 2, wherein the kickpoint is within 6" of a portion of the coupler.

18. The golf club shaft of claim 2, wherein the average butt portion flexural rigidity is 50-110 $N*m^2$ and the average butt portion torsional rigidity is 20-70 $N*m^2$.

19. A golf club shaft, comprising:

a shaft having a shaft distal end, a shaft proximal end, a shaft outer diameter, a shaft length, a shaft mass, a shaft center of gravity located a shaft CG distance from the shaft proximal end, a kickpoint located a kickpoint distance from the shaft proximal end, wherein each point along the shaft length has (i) a shaft flexural rigidity including a maximum shaft flexural rigidity, and (ii) a shaft torsional rigidity including a maximum shaft torsional rigidity;

the shaft having a butt portion joined by a coupler to a tip portion;

the butt portion having a butt portion distal end, a butt portion proximal end, a butt portion length of 20-40", and a butt portion mass;

the tip portion having a tip portion distal end, a tip portion proximal end, a tip portion length that is (a) 8-26", (b) 25-75% of the butt portion length, and (c) at least 20% of the shaft length, and a tip portion mass of no more than 35 grams and less than 75% of the butt portion mass;

the butt portion formed of a butt portion material having a butt material density, a butt portion mass, a butt portion elastic modulus, a butt portion shear modulus, and each point along the butt portion length having (i) a butt portion area moment of inertia, (ii) a butt portion polar moment of inertia, (iii) a butt portion flexural rigidity including an average butt portion flexural rigidity, a maximum butt portion flexural rigidity, and a minimum butt portion flexural rigidity, and (iv) a butt portion torsional rigidity including an average butt portion torsional rigidity, a maximum butt portion torsional rigidity, and a minimum butt portion torsional rigidity;

the tip portion formed of a tip portion material having a tip material density, a tip portion elastic modulus, and a tip portion shear modulus, and each point along the tip portion length having (i) a tip portion area moment of inertia, (ii) a tip portion polar moment of inertia, (iii) a tip portion flexural rigidity including an average tip portion flexural rigidity, a maximum tip portion flexural rigidity, and a minimum tip portion flexural rigidity, and (iv) a tip portion torsional rigidity including an average tip portion torsional rigidity, a maximum tip portion torsional rigidity, and a minimum tip portion torsional rigidity;

wherein:

the average butt portion flexural rigidity is 50-110 $N*m^2$ and the average butt portion torsional rigidity is 20-70 $N*m^2$;

the flexural rigidity of a portion of the shaft located 5-36" from the shaft proximal end is at least 125 $N*m^2$ and at least 50% greater than the minimum butt portion flexural rigidity, the flexural rigidity of the shaft exceeds 125 $N*m^2$ for no more than 15% of the shaft length, the torsional rigidity of a portion of the shaft located 5-36" from the shaft proximal end is at least 100 $N*m^2$, and the torsional rigidity of a portion of the shaft exceeds 100 $N*m^2$ for no more than 15% of the shaft length;

the maximum shaft flexural rigidity is no more than 600 $N*m^2$ and the maximum shaft torsional rigidity is no more than 450 $N*m^2$; and the shaft CG distance is no more than 65% of the shaft length, and the shaft CG distance is greater than a distance of any portion of the coupler from the shaft proximal end.

20. The golf club shaft of claim 19, wherein the kickpoint is within 6" of a portion of the coupler.

* * * * *